US006416915B1

(12) United States Patent
Kikuchi et al.

(10) Patent No.: US 6,416,915 B1
(45) Date of Patent: Jul. 9, 2002

(54) ELECTROPHOTOGRAPHIC PHOTOSENSITIVE MEMBER, PROCESS CARTRIDGE AND ELECTROPHOTOGRAPHIC APPARATUS

(75) Inventors: Toshihiro Kikuchi, Yokohama; Akio Maruyama, Tokyo; Hiroki Uematsu, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/438,529

(22) Filed: Nov. 12, 1999

(30) Foreign Application Priority Data

| | | |
|---|---|---|
| Nov. 13, 1998 | (JP) | 10-323066 |
| Nov. 13, 1998 | (JP) | 10-323067 |
| Nov. 13, 1998 | (JP) | 10-323084 |
| Nov. 13, 1998 | (JP) | 10-323085 |

(51) Int. Cl.[7] ..... G03G 5/04

(52) U.S. Cl. ..... 430/56; 430/58.45; 430/58.7; 430/66; 430/73; 430/75; 399/116; 399/159

(58) Field of Search ..... 430/56, 58.4, 58.45, 430/58.7, 59.6, 96, 66, 67, 73, 74, 75, 72; 399/116, 159

(56) References Cited

U.S. PATENT DOCUMENTS

| | | | | |
|---|---|---|---|---|
| 4,798,777 A | | 1/1989 | Takiguchi et al. | 430/84 |
| 4,818,650 A | * | 4/1989 | Limburg et al. | 430/56 |
| 5,176,976 A | | 1/1993 | Kikuchi et al. | 430/70 |
| 5,352,552 A | | 10/1994 | Maruyama et al. | 430/18 |
| 5,422,210 A | | 6/1995 | Maruyama et al. | 430/66 |
| 5,427,880 A | | 6/1995 | Tamura et al. | 430/83 |
| 5,455,135 A | | 10/1995 | Maruyama et al. | 430/66 |
| 5,561,017 A | * | 10/1996 | Nagao et al. | 430/58.45 |
| 5,677,095 A | | 10/1997 | Kikuchi et al. | 430/75 |
| 5,734,003 A | | 3/1998 | Iwasaki et al. | 528/89 |
| 5,811,212 A | * | 9/1998 | Tanaka | 430/56 |
| 5,846,680 A | * | 12/1998 | Adachi et al. | 430/73 |
| 6,016,414 A | | 1/2000 | Anayama et al. | 399/159 |
| 6,180,303 B1 | * | 1/2001 | Uematsu et al. | 430/59.6 |

FOREIGN PATENT DOCUMENTS

| | | |
|---|---|---|
| DE | 4339711 | 5/1995 |
| EP | 0295126 | 12/1988 |
| JP | 54-143645 | 11/1979 |
| JP | 2-127652 | 5/1990 |
| JP | 5-216249 | 8/1993 |
| JP | 7-072640 | 3/1995 |
| JP | 8-248649 | 9/1996 |
| WO | WO 97/33193 | 9/1997 |

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member is provided by forming a photosensitive layer on an electroconductive support. The photosensitive layer is provided with particularly excellent durability while retaining good electrophotographic performances when formed as a layer comprising a polymerizate of a hole-transporting compound having at least two chain polymerization function groups in its molecule represented by formula (1) below:

$$(P^1)_a A (Z-(P^2)_d)_b \quad (1),$$

wherein A denotes a hole-transporting group, $P^1$ and $P^2$ independently denote a chain polymerization function group and Z denotes a bonding organic group; a, b and d are independently an integer of at least 0 satisfying $a+b\times d \geqq 2$ provided that if $a \geqq 2$. plural groups $P^1$ can be identical or different; if $b \geqq 2$, plural groups Z can be identical or different; and if $b\times d \geqq 2$, plural groups $P^2$ can be identical or different.

17 Claims, 1 Drawing Sheet

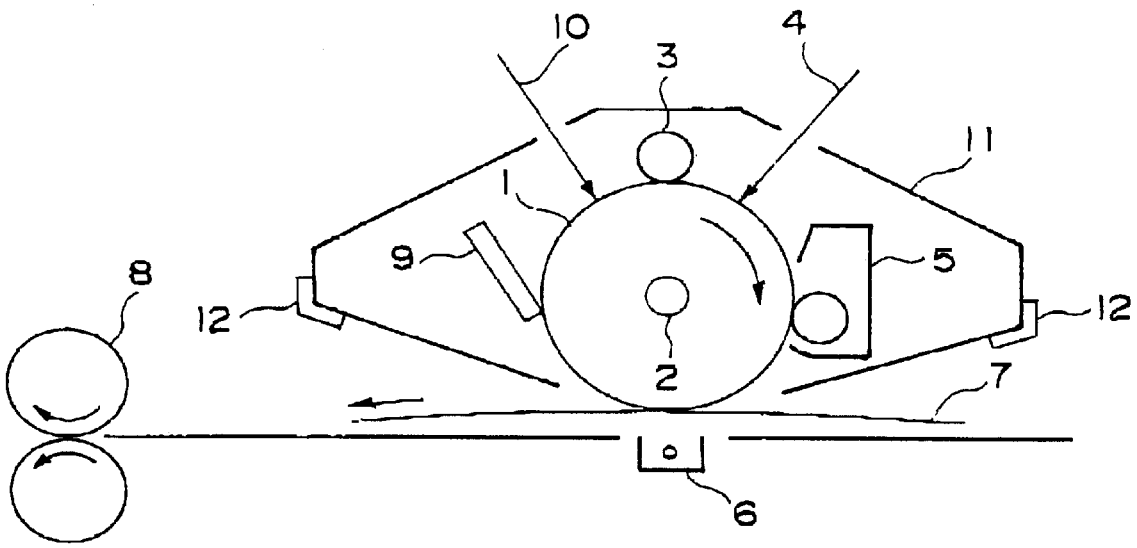
10
4
3
11
1
9
5
8
12
12
2
7
6

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member, particularly one having a photosensitive layer comprising a specific resin, a process cartridge and an electrophotographic apparatus including the electrophotographic photosensitive member, and a process for producing the electrophotographic photosensitive member.

Hitherto, as photoconductor materials for use in electrophotographic photosensitive members, inorganic materials, such as selenium, cadmium sulfide and zinc oxide, have been known. On the other hand, organic photoconductor materials, such as polyvinylcarbazole, phthalocyanine and azo pigments, are noted for their advantages, such as high productivity and non-pollution characteristic and have been widely used while they tend to be inferior in photoconductor performances and durability compared with inorganic materials.

In many cases, there have been used function separation-type electrophotographic photosensitive members having a structure including a charge generation layer and a charge transport layer in lamination so as to satisfy both electrical and mechanical characteristics. On the other hand, an electrophotographic photosensitive member is required to satisfy sensitivity, electrical characteristic, optical characteristic and durability corresponding to an electrophotographic process where it is used, as a matter of course.

Particularly, the surface of a photosensitive member is directly subjected to various electrical and mechanical external forces during various steps of charging, exposure, development with a toner, transfer onto paper and cleaning, so that durability against these forces is required. More specifically, the photosensitive member is required to exhibit durability against abrasion and occurrence of scars at the surface due to abrasion and also durability against surface abrasion due to charging.

The surface layer of the electrophotographic photosensitive member using an organic photoconductor is a thin resin layr, and the property of the resin is very important. As resins satisfying the above-mentioned requirements to some extent, acrylic resin, polycarbonate resin, etc., have been used commercially in recent years. However, this does not mean that all the above-mentioned properties are satisfied by these resins. Particularly, it is difficult to say that these resins have a sufficiently high film hardness in order to realize a higher durability. More specifically, a surface layer of these resins has been liable to cause abrasion or scars during repetitive use.

Further, in compliance with a demand for a higher sensitivity in recent years, relatively large amounts of low-molecular weight compounds, such as a charge-transporting compound, are added in many cases. In such cases, the film strength can be remarkably lowered due to a plasticizer effect of such low-molecular weight compounds, so that the occurrence of abrasion and scars at the surface layer on repetitive use becomes further serious problem. Further, a problem is liable to be encountered that such low-molecular weight compounds are precipitated or exuded during a storage of the electrophotographic photosensitive member.

For solving these problems, the use of a cured resin for constituting a charge transport layer has been proposed, e.g., in Japanese Laid-Open Patent Application (JP-A) 2-127652. According to this proposal, the resultant charge transport layer comprising a cured and crosslinked resin has provided remarkably increased durabilities against abrasion and scars during repetitive use. However, even in such a cured resin, a low-molecular weight compound-still functions as a plasticizer, and the above-mentioned precipitation or exudation thereof has not been basically solved.

Further, in a charge transport layer composed of an organic charge-transporting material and a binder resin, the charge-transporting performance is largely affected by the resin, and in case of using a cured resin having a sufficiently high hardness, the charge-transporting performance is liable to be lowered to result in an increased residual potential on repetitive use, so that it has not fully succeeded in satisfying both the hardness and electro-photographic performances.

JP-A 5-216249 and JP-A 7-72640 have disclosed an electrophotographic photosensitive member having a charge transport layer formed through reaction of a monomer having a carbon-to-carbon double bond and a charge-transporting material having a carbon-to-carbon double bond contained in the charge transport layer under application of heat or light energy. However, the charge-transporting material in the resultant charge transport layer is attached to the main chain of the binder polymer in the form of pendanrts, so that its plasticizer effect is not sufficiently excluded and the resultant charge transport layer does not exhibit a fully improved mechanical strength. Further, if the concentration of the charge-transporting material is increased, the crosslinkage density is lowered to fail in ensuring a sufficient mechanical strength.

As another solution, JP-A 8-248649 has disclosed an electrophotographic photosensitive member having a charge transport layer comprising a thermoplastic polymer having a main chain into which a group having a charge transporting function has been introduced. This is effective in preventing the precipitation of a low-molecular weight compound and improving the mechanical strength. As the binder is basically a thermoplastic resin, the mechanical strength thereof is limited, and the handling and productivity inclusive of the dissolving power for the resin cannot yet be said to be sufficient.

For the above reason, a research and. development work for providing a charge transport layer satisfying higher levels of mechanical strength and charge transporting performance in combination, is still being made.

SUMMARY OF THE INVENTION

A generic object of the present invention is to provide an electrophotographic photosensitive member having solved the above mentioned problems.

A more specific object of the present invention is to provide an electrophotographic photosensitive member having a surface layer exhibiting a high film strength leading to improved anti-abrasion and anti-scar characteristics, and also a good anti-precipitation characteristic.

Another object of the present invention is to provide an electrophotographic photosensitive member exhibiting very little change or deterioration of photosensitive member performances, such as increase in residual potential in repetitive use, thus being capable of exhibiting stable performances in repetitive use.

A further object of the present invention is to provide a process cartridge and an electrophotographic apparatus including such an electrophotographic photosensitive member.

A still further object of the present invention is to provide a process for producing such an electrophotographic photosensitive member.

According to the present invention, there is provided an electrophotographic photosensitive member, comprising: an electroconductive support and a photosensitive layer disposed on the electroconductive support; wherein the photosensitive layer comprises a polymerizate of a hole-transporting compound having at least two chain-polymerization function groups in its molecule represented by formula (1) below:

$$-(P^1)_{\underline{a}}-A-(Z-(P^2)_d)_b,$$

wherein A denotes a hole-transporting group, $P^1$ and $P^2$ independently denote a chain-polymerization function group and Z denotes a bonding organic group; $\underline{a}$ and b and d are independently an integer of at least 0 satisfying $a+b\times d\geqq 2$ provided that if $\underline{a}\geqq 2$, plural groups $P^1$ can be identical or different: if $b\geqq 2$, plural groups Z can be identical or different; and if $b\times d\geqq 2$, plural groups $P^2$ can be identical or different; and the hole-transporting group A is such that a combination of A with a number (a+b) of hydrogen atoms instead of $-(P^1)_{\underline{a}}$ and $-(Z-((P_2)_d)_b$ as in the formula (1) would provide a hole-transporting compound that is a compound represented by a formula selected from formulae (2), (3), (4) and (6), or a condensed cyclic hydrocarbon compound or condensed. heterocyclic compound having a group represented by formula (5) below:

(2)

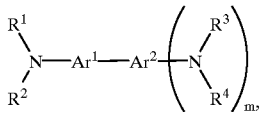

wherein $R^1$, $R^2$, $R^3$ and $R^4$ independently denote an alkyl group, aralkyl group or aryl group each capable of having a substituent; $Ar^1$ and $Ar^2$ independently denote an arylene group capable of having a substituent; and m is 0 or 1;

(3)

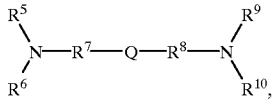

wherein $R^5$, $R^6$, $R^9$ and $R^{10}$ independently denote an alkyl group, aralkyl group or aryl group each capable of having a substituent; $R^7$ and $R^8$ independently denote an alkylene group or arylene group each capable of having a substituent and Q denotes an organic group capable of having a substituent;

(4)

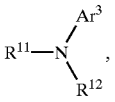

wherein $R^{11}$ and $R^{12}$ independently denote an alkyl group, aralkyl group or aryl group each capable of having a substituent; and $Ar^3$ denotes an aryl group capable of having a substituent with the proviso that the compound of the formula (4) includes at least one group represented by formula (5) below:

(5)

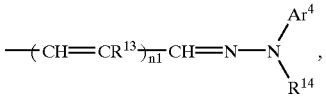

wherein $R^{13}$ and $R^{14}$ independently denote an alkyl group, aralkyl group or aryl group each capable of having a substituent, or a hydrogen atom; $Ar^4$ denotes an aryl group capable of having a substituent; and $n^1$ denotes 0, 1 or 2;

(6)

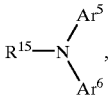

wherein $Ar^5$ and $Ar^6$ independently denote an aryl group capable of having a substituent; and $R^{15}$ denotes an alkyl group, aralkyl group or aryl group each capable of having a substituent with the proviso that the compound of the formula (6) includes at least one group represented by formula (7) below:

(7)

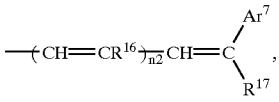

wherein $R^{16}$ and $R^{17}$ independently denote an alkyl group, aralkyl group or aryl group each capable of having a substituent, or a hydrogen atom; $Ar^7$ denotes an aryl group capable of having a substituent; $n^2$ is 0, 1 or 2.

According to the present invention, there is further provided a process cartridge, comprising: the above-mentioned electrophotographic photosensitive member and at least one means selected from the group consisting of charging means, developing means and cleaning means: said electrophotographic photosensitive member and said at least one means being integrally supported and detachably mountable to a main assembly of an electrophotographic apparatus.

The present invention further provides an electrophotographic apparatus, comprising: the above-mentioned electrophotographic photosensitive member, and charging means, developing means and transfer means respectively disposed opposite to the electrophotographic photosensitive member.

According to another aspect of the present invention, there is provided a process for producing an electrophotographic photosensitive member, comprising a photosensitive layer-forming step of forming a photosensitive layer on an electroconductive support; the photosensitive layer-forming step including a step of forming a coating layer comprising the above-mentioned hole-transporting compound of the formula (1) on the electroconductive support, and a step of polymerizing the hole-transporting compound in the coating layer.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE in the drawing illustrates an electrophotographic apparatus equipped with a process cartridge including an electrophotographic photosensitive member according to the invention.

DETAILED DESCRIPTION OF THE INVENTION

The electrophotographic photosensitive member according to the present invention is characterized by having a photosensitive layer comprising a polymerizate of a hole-transporting compound having at least two chain-polymerization function groups in its molecule represented by the above-mentioned formula (1).

Polymer producing reactions may be roughly divided into chain-polymerization and successive polymerization. The term "chain-polymerization" is used herein in this sense. More specifically, as described, e.g., at page 26 of "Basic: Chemistry of Synthetic Resin (New Edition)" (in Japanese) written by Tadahiro Miwa and published from Gihoudo Shuppan K. K. (Jul. 25, 1995) (First Ed. 8th Print), the chain-polymerization is a mechanism of polymerization inclusive of unsaturation polymerization, ring-opening polymerization and isomerization polymerization wherein polymerization proceeds mainly via radicals or ions, as intermediate.

The chain-polymerization function groups $P^1$ and $P^2$ in the above formulae refer to functional groups susceptible of polymerization according to the above-mentioned mechanism. However, as majority of the chain-polymerization function groups having a wide applicability, unsaturation polymerization function groups and ring-opening polymerization function are described below with specific examples thereof.

Unsaturation polymerization is a reaction mechanism wherein unsaturated groups, such as C=C, C≡C, C=O, C=N and C≡N, are polymerized via radicals or ions, but principally via C=C groups. Specific examples of unsaturation polymerization function groups are enumerated herein below, but the following are not exhaustive:

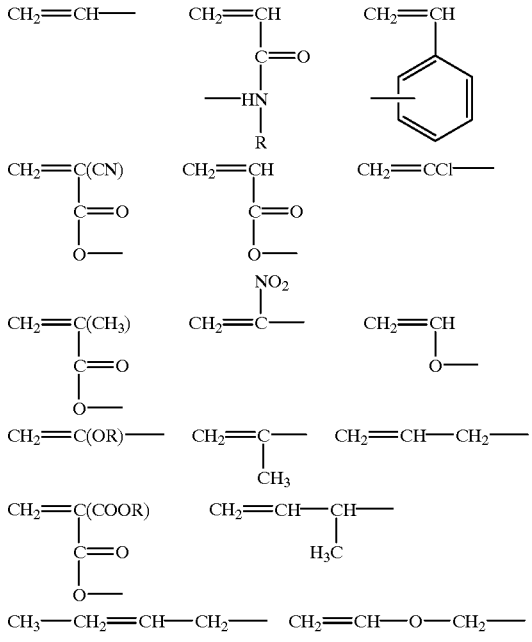

In the above formula representing unsaturation polymerization function groups, R denotes an alkyl group, such as methyl, ethyl or propyl, each capable of having a substituent; an aralkyl group, such as benzyl or phenethyl, each capable of having a substituent: an aryl group, such as phenyl, naphthyl or anthryl, each capable of having a substituent; or a hydrogen atom.

Ring-opening polymerization is a reaction mechanism wherein a distorted unstable ring structure, such as a carbon ring, oxo ring or nitrogen-containing hetero ring, is activated by a catalyst to cause ring-opening and simultaneously repetitive polymerization to provide chain-polymeric products. The reaction proceeds by ions as active species in many cases. Specific examples of ring-opening polymerization function groups are enumerated hereinbelow, but these are not exhaustive.

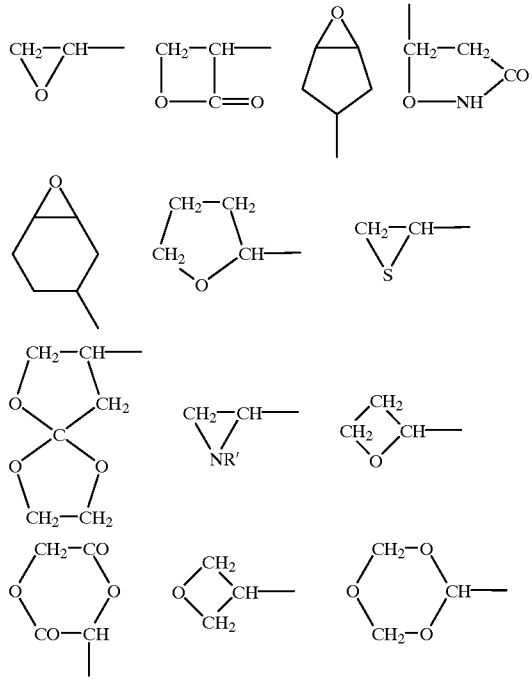

In the above formula representing ring-opening polymerization function groups, R' denotes an alkyl group, such as methyl, ethyl or propyl, each capable of having a substituent; an aralkyl group, such as benzyl or phenethyl, each capable of having a substituent; an aryl group, such as phenyl, naphthyl or anthryl, each capable of having a substituent; or a hydrogen atom.

Among the above-mentioned chain-polymerization function groups, those represented by formulae (8)–(10) below are preferred:

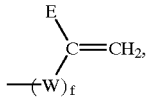

(8)

wherein E denotes a hydrogen atom; a halogen atom, such as fluorine, chlorine or bromine; an alkyl group, such as methyl, ethyl, propyl or butyl, each capable of having a substituent; an aralkyl group, such as benzyl, phenethyl, naphthylmethyl, furfuryl or thienyl, each capable of having a substituent; an aryl group, such as phenyl, naphthyl, anthryl, pyrenyl, thiophenyl or furyl, each capable of having a substituent; CN group, nitro group, an alkoxy group, such as methoxy, ethoxy or propoxy, —$COOR^{18}$ or —$CONR^{19}R^{20}$;

W denotes a divalent group, inclusive of an arylene group, such as phenylene, naphthylene or anthracenylene, each capable having a substituent; an alkylene group, such as methylene, ethylene, or butylene, each capable of having a substituent; —COO—, —O—, —OO—, —S— or —$CONR^{21}$;

$R^{18}$–$R^{21}$ independently denote a hydrogen atom; a halogen atom, such as fluorine, chlorine or bromide, an alkyl group, such as methyl, ethyl or propyl, each capable of having a substituent; an aralkyl group, such as benzyl or phenethyl, each capable of having a substituent; or an aryl group, such as phenyl, naphthyl or anthryl, each capable of having a substituent; and f is 0 or 1.

Examples of the substituent optionally possessed by E or W may include: halogen atoms, such as fluorine, chlorine, bromine and iodine; nitro group, cyano group, hydroxyl group, such as methyl, ethyl, propyl and butyl; alkoxy groups, such as methoxy, ethoxy and propoxy; aryloxy groups, such as phenoxy and naphthoxy; aralkyl groups, such as benzyl, phenethyl, naphthylmethyl, furfuryl and thienyl; and aryl groups such as phenyl, naphtyl, anthryl and pyneryl;

(9)

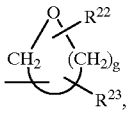

wherein $R^{22}$ and $R^{23}$ independently denote a hydrogen atom; an alkyl group, such as methyl, ethyl or propyl, each capable of having a substituent; an aralkyl group, such as benzyl or phenethyl, each capable of having a substituent; or an aryl group, such as phenyl or naphthyl, each capable of having a substituent; and g is an integer of 1–10;

(10)

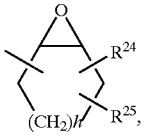

wherein $R^{24}$ and $R^{25}$ independently denote a hydrogen atom; an alkyl group, such as methyl, ethyl or propyl, each capable of having substituent; an aralkyl group, such as benzyl or phenethyl, each capable of having a substituent; or an aryl group, such as phenyl or naphthyl, each capable of having a substituent; and h is 0 or an integer of 1–10. In formulae (9) and (10) the R groups and the hole-transporting compound are bonded to the epoxy ring by replacing hydrogen(s) in the ring ($CH_2$) groups.

Examples of the substituent optionally possessed by $R^{22}$–$R^{25}$ In the formulae (9) and (10) may include: halogen atoms, such as fluorine, chlorine, bromine and iodine; nitro group, cyano group, hydroxyl group; alkyl groups, such as methyl, ethyl, propyl and butyl; alkoxy groups, such methoxy, ethoxy and propoxy; aryloxy groups, such as phenoxy and naphthoxy; aralkyl group, such as benzyl, phenethyl, naphthylmethyl, furfuryl and thienyl; and aryl groups such as phenyl, naphthyl, anthryl and pyrenyl.

Particularly, preferred examples of the chain-polymerization function groups among those represented by the above formulae (8)–(10) may include those of the following formuale (11)–(17).

(11)

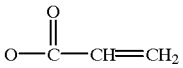

(12)

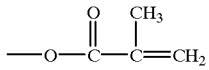

(13)

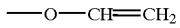

(14)

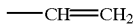

(15)

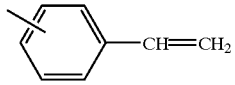

(16)

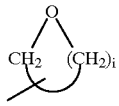

(i = 1, 2 or 3)

(17)

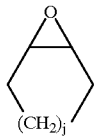

(j = 1, 2 or 3).

In the formula (16) the bond —( to the hole transporting compound is formed by replacing a hydrogen in the ring methylene groups.

Among the groups of the above formulae (11)–(17), acryloyloxy group of the formula (11) and methacryloyloxy group of the formula (12) are especially preferred in view of their polymerization characteristics, etc.

The "hole-transporting compound having at least two chain-polymerization function groups in its molecule" is a hole-transporting compound having at least two of the above-mentioned chain-polymerization function groups, and such at least two chain-polymerization function groups may be identical or different from each other. Such hole-transporting compounds having at least two chain-polymerization function groups in each molecule may be inclusively represented by the above-mentioned formula (1).

The proviso that "if a≧2, plural groups $P^1$ can be identical or different" is satisfied, e.g., in case of a=3, by any case of all three $P^1$ groups being identical, two identical $P^1$ groups and one $P^1$ group being different from the two, and three $P^1$ groups being all different from each other. The proviso regarding the cases of b≧2 and b×d≧2 for $-(Z-(P^2)_d)_b$ similarly allows all possible combinations of plural groups Z, $P^2$.

Further, the group A is a hole-transporting group such that a combination of A with a number (a+b) of hydrogen atoms instead of $-(P^1)_a$ and $-(Z-((P_2)_d)_b$ as in the formula (1) would provide a hole-transporting compound that is a compound represented by a formula selected from the above-mentioned formulae (2), (3), (4) and (6), or a condensed cyclic hydrocarbon compound or condensed heterocyclic compound having a group represented by the formula (5) mentioned above.

More specifically, in the above-mentioned formula (2), m is 0 or 1; $R^1$–$R^4$ independently denote an alkyl group having 1–10 carbon atoms, such as methyl, ethyl, propyl or butyl, each capable of having a substituent; an aralkyl group such as benzyl, phenethyl, naphthylmethyl, furfuryl or thienyl, each capable of having a substituent; or an aryl group, such as phenyl, naphthyl, anthryl, phenanthryl, pyrenyl, thiophenyl, furyl, pyridyl, quinolyl, benzoquinolyl, carbazolyl, phenothiazinyl, benzofuryl, benzothiophenyl, dibenzofuryl, or dibenzothiophenyl, each capable of having a substituent, $Ar^1$ denotes an arylene group (examples of which include those obtained by subtracting two hydrogens from benzene, naphthalene, anthracene, phenanthrene, pyrene, thiophene, pyridine, quinoline, benzoquinoline, carbazole, phenothiazine, benzofuran, benzothiophene, dibenzofuran and dibenzothiophene) each capable of having a substituent; in case of m=0, $Ar^2$ denotes an aryl group, such as phenyl, naphthyl, anthryl, phenanthryl, pyrenyl, thiophenyl, furyl, pyridyl, quinolyl, benzoquinolyl, carbazolyl, phenothiazinyl, benzofuryl, benzothiophenyl, dibenzofuryl or dibenzothiophenyl, each capable of having a substituent; and in case of m=1, Ar denotes an arylene group capable of having a substituent similar to $Ar^1$, and $Ar^1$ and $Ar^2$ can be identical or different.

Among the above, it is preferred that $R^1$ and $R^2$ in the formula (2) are aryl groups each capable of having a substituent, and it is particularly preferred that $R^1$–$R^4$ are all aryl groups each capable of having a substituent. Further, in the formula (2), each pair of $R^1$ and $R^2$, $R^3$ and $R^4$ or $Ar^1$ and $Ar^2$ can be connected additionally with each other directly or via a bonding group to form a ring. Examples of the bonding group may include: alkylene groups, such as methylene, ethylene and propylene; hetero atoms, such as oxygen and sulfur; and —CH=CH—.

In the above-mentioned formula (3), $R^5$ $R^6$, $R^9$ and $R^{10}$ Independently denote an alkyl group having 1–10 carbon atoms, such as methyl, ethyl, propyl or butyl, each capable of having a substituent; an aralkyl group such as benzyl, phenethyl, naphthylmethyl, furfuryl or thienyl, each capable of having a substituent; or an aryl group, such as phenyl, naphthyl, anthryl, phenanthryl, pyrenyl, thiophenyl, furyl, pyridyl, quinolyl, benzoquinolyl, carbazolyl, phenothiazinyl, benzofuryl, benzothiophenyl, dibenzofuryl, or dibenzothiophenyl, each capable of having a substituent.

$R^7$ and $R^8$ independently denote an alkylene group having 1–10 carbon atoms, such as methylene, ethylene or propylene, each capable having a substituent; or an arylene group (examples of which include those obtained by subtracting two hydrogens from benzene, naphthalene, anthracene, phenanthrene, pyrene, thiophene, pyridine, quinoline, benzoquinoline, carbazole, phenothiazine, benzofuran, benzothiophene, dibenzofuran and dibenzothiophene) each capable of having a substituent. $R^7$ and $R^8$ can be identical or different. Q is an organic group capable of having a substituent.

Among the above, it is preferred in the formula (3) that at least two of $R^5$, $R^6$, $R^9$ and $R^{10}$ are aryl groups each capable of having a substituent and $R^7$ and $R^8$ are arylene groups each capable of having a substituent, and it is particularly preferred that $R^5$, $R^6$, $R^9$ and $R^{10}$ are all aryl groups each capable of having a substituent. Further, in the formula (3), a pair of arbitrary two among $R^5$, $R^6$ and $R^7$ or a pair of arbitrary two among $R^8$, $R^9$ and $R^{10}$ can be connected additionally with each other directly or via a bonding group to form a ring. Examples of the bonding group may include: alkylene groups, such as methylene, ethylene and propylene; hetero atoms, such as oxygen and sulfur; and —CH=CH—.

Further, each of the group Z in the formula (1) and the group O in the formula (3) may denote an organic group obtained by selecting one member or combining at least two members arbitrarily selected from an alkylene group capable of having a substituent, an arylene group capable having a substituent, —$CR^{26}$=$CR^{27}$— (wherein $R^{26}$ and $R^{27}$ independently denote an alkyl group, an aryl group or a hydrogen atom), —CO—, —SO, —$SO_2$—, an oxygen atom and a sulfur atom. Among them, those represented by formula (18) below are preferred, and those represented by formula (19) below are particularly preferred.

$$-(X^1)_p-(Ar^7)_q-(X^2)_r-(Ar^8)_s-(X^3)_t- \quad (18)$$

$$-(X^4)_u-(Ar^9)_v-(X^5)_w- \quad (19)$$

In the above formula (18), $X^1$–$X^3$ independently denote an alkylene group having at most 20 carbon atoms, such as methylene, ethylene or propylene, each capable of having a substituent; —$(CR^{28}=CR^{29})_{m1}$, —CO—, —SO—, —$SO_2$—, —O— or —S—; $Ar^7$ and $Ar^8$ independent denote an arylene group (examples of which include those obtained by subtracting two hydrogens from benzene, naphthalene, anthracene, phenanthrene, pyrene, thiophene, pyridine, quinoline, benzoquinoline, carbazole, phenothiazine, benzofuran, benzothiophene, dibenzofuran and dibenzothiophene) each capable of having a substituent. $R^{28}$ and $R^{29}$ independently denote an alkyl group, such as methyl, ethyl or propyl, each capable having a substituent; an aryl group, such as phenyl, naphthyl or thiophenyl each capable of having a substituent; or a hydrogen atom; m1 is an integer of 1–5; p to t independently denote an integer of 0–10 provided that p to t cannot be simultaneously 0.

In the above formula (19), $X^4$ and $X^5$ independently denote —$(CH_2)_x$, —$(CH=CR^{30})_y$, —CO—, —O—; $Ar^9$ denotes an arylene group (examples of which include those obtained by subtracting two hydrogens from benzene, naphthalene, anthracene, phenanthrene, pyrene, benzothlophene, pyridine, quinoline, benzoquinoline, carbazole, phenothiazine, benzofuran, benzothiophene, dibenzofurane and dibenzothiophene) each capable of having a substituent. $R^{30}$ denotes an alkyl group, such as methyl, ethyl or propyl, each capable of having a substituent; an aryl group, such as phenyl, naphthyl or thiophenyl, each capable of having a substituent; or a hydrogen atom, x is an integer of 1–10, y is an integer of 1–5, and u to w are independently an integer of 0–10, preferably 0–5, provided that u to w cannot be simultaneously 0.

Examples of the substituent optionally possessed by the groups $R^1$–$R^{10}$, $R^{26}$–$R^{30}$, $Ar^1$, $Ar^2$, $Ar^7$–$Ar^9$, $X^1$–$X^5$, Z and Q in the above-mentioned formulae (1)–(3), (18) and (19) may include: halogen atoms, such as fluorine, chlorine, bromine and iodine; nitro group, cyano group, hydroxyl group; alkyl groups, such as methyl, ethyl, propyl and butyl; alkoxy groups, such as methoxy, ethoxy and propoxy; aryloxy groups, such as phenoxy and naphthoxy; aralkyl groups, such as benzyl, phenethyl, naphthylmethyl, furfuryl and thienyl; and aryl groups such as phenyl, naphthyl, anthryl and pyrenyl; substituted amino groups, such as dimethylamino, diethylamino, dibenzylamino, diphenylamino and di(p-tolyl)amino and arylvinyl groups, such as styryl and naphthylvinyl.

In the formulae (4) and (5), $Ar^3$ and $Ar^4$ respectively denote an aryl group, such as phenyl, naphthyl, anthryl, phenanthryl, pyrenyl, thiophenyl, furyl, pyridyl, quinolyl, benzoquinolyl, carbazolyl, phenothiazinyl, benzofuryl, benzothiophenyl, dibenzofuryl or dibenzothiophenyl, each capable of having a substituent; $R^{11}$ and $R^{12}$ independently denote an alkyl group having at most 10 carbon atoms, such as methyl, ethyl propyl or butyl, each capable of having a substituent; an aralkyl group, such as benzyl, phenethyl, naphthylmethyl, furfuryl or thienyl, each capable of having a substituent; or an aryl group, such as phenyl, naphthyl, anthryl, phenanthryl, pyrenyl, thiophenyl, furyl, pyridyl, quinolyl, benzoquinolyl, carbazolyl,phenothiazinyl, benzofuryl, benzothiophenyl, dibenzofuryl or dibenzothiophenyl, each capable of having a substituent; and $R^{13}$ and $R^{14}$ can independently denote a hydrogen atom in addition to the above-mentioned alkyl group, aralkyl group or aryl group each capable of having a substituent.

Among the above, the case of $R^{14}$ being an aryl group capable of having a substituent is preferred, and the case of $R^{11}$ and $R^{12}$ being both aryl groups each capable of having a substituent in the formula (4) is particularly preferred. Arbitrarily selected two of $R^{11}$, $R^{12}$ and $Ar^3$, or a pair of $Ar^4$ and $R^{14}$, can be further bonded with each other directly or with a bonding group to form a ring. Examples of the bonding group include: alkylene groups, such as methylene, ethylene and propylene; hetero atoms, such as —O— and —S—; and —CH═CH—. $n^1$ is 0 1 or 2.

In the formulae (6) and (7), $Ar^5$, $Ar^6$ and $Ar^7$ independently denote an aryl group, such as phenyl, naphthyl, anthryl, phenanthryl, pyrenyl, thiophenyl, furyl, pyridyl, quinolyl, benzoquinolyl, carbazolyl, phenothiazinyl, benzofuryl, benzothiophenyl. dibenzofuryl or dibenzothiophenyl, each capable of having a substituent; $R^{15}$ denotes an alkyl group having at most 10 carbon atoms, such as methyl, ethyl propyl or butyl, each capable of having a substituent; an aralkyl group, such as benzyl, phenethyl, naphthylmethyl, furfuryl or thienyl, each capable of having a substituent; or an aryl group, such as phenyl, naphthyl, anthryl, phenanthryl, pyrenyl, thiophenyl, furyl, pyridyl, quinolyl, benzoquinolyl, carbazolyl,phenothiazinyl, benzofuryl, benzothiophenyl, dibenzofuryl or dibenzothiophenyl, each capable of having a substituent: and $R^{16}$ and $R^{17}$ can independently denote a hydrogen atom in addition to the above-mentioned alkyl group, aralkyl group or aryl group each capable of having a substituent.

Among the above, the case of $R^{15}$ and $R^{17}$ being aryl groups each capable of having a substituent is particularly preferred. Arbitrary selected two of $R^{15}$, $Ar^5$ and $Ar^6$, or a pair of $Ar^7$ and $R^{17}$, can be further bonded with each other directly or with a bonding group to form a ring. Examples of the bonding group include: alkylene groups, such as methylene, ethylene and propylene; hetero atoms, such as —O— and —S—; and —CH═CH—. $n^2$ is 0 1 or 2.

Examples of the substituent optionally possessed by the groups $R^{11}$–$R^{17}$ and $Ar^3$–$Ar^7$ in the above-mentioned formulae (4)–(7) may include: halogen atoms, such as fluorine, chlorine, bromine and iodine; nitro group, cyano group, hydroxyl group; alkyl groups, such as methyl, ethyl, propyl and butyl; alkoxy groups, such as methoxy, ethoxy and propoxy; aryloxy groups, such as phenoxy and naphthoxy; aralkyl groups, such as benzyl, phenethyl, naphthylmethyl, furfuryl and thienyl; and aryl groups such as phenyl, naphthyl, anthryl and pyrenyl; substituted amino groups, such as dimethylamino, diethylamino, dibenzylamino, diphenylamino and di(p-tolyl)amino and arylvinyl groups, such as styryl and naphthylvinyl.

Examples of the compound having the above-mentioned formula (5) may include: as base compound structures, condensed cyclic hydrocarbon compounds, such as naphthalene, anthracene, phenanthrene, pyrene, fluorene, fluoranthene, azulene, indene, perylene, chrysene and coronene, each capable of having a substituted; and condensed heterocyclic compounds, such as benzofuran, indole, carbazole, benzcarbazole, acridine, phenothiazine and quinoline. Compared with these compounds, however, the compounds represented by the formulae (4) and (6) are further preferred.

The hole-transporting compound having at least two chain-polymerization function groups in its molecule used in the present invention may preferably have an oxidation potential to at most 1.2 volts, more preferably 0.4–1.2 volts. If the oxidation potential exceeds 1.2 volts, the injection of charge (holes) from the charge-generating material becomes difficult, thus resulting in problems, such as an increase of residual potential, sensitivity lowering and potential change during repetitive use. Below 0.4 volt, the chargeability is liable to be lowered, and the compound per se is liable to be deteriorated by oxidation, thus being liable to result in sensitivity lowering, image blurring and increased potential change during repetitive use.

The oxidation potential values referred to herein are based on values measured in the following manner.

<Oxidation Potential Measurement>

Measurement was performed by using a saturated calomel electrode as a reference electrode and a 0.1 N—$(n\text{–}Bu)_4N^+$ $ClO_4^-$acetonitrile solution as an electrolytic solution, and sweeping the potentials applied to an operating electrode (of platinum) by means of a potential sweeper to obtain a current-potential curve, on which a peak top potential was taken as an oxidation potential. More specifically, a sample charge-transporting compound was dissolved in 0.1 N—$(n\text{–}Bu)_4ClO_4^-$ acetonitrile solution to provide a concentration of 5–10 mmol. %. Then, the sample solution was supplied with linearly increasing voltages of from 0 volt to +1.5 volts between the operating electrode and the reference electrode dipped in the sample solution to measure current changes, from which a current-potential curve was obtained. On the current-potential curve, a peak (a first peak in case of plural peaks) was determined and a peak-top potential of the peak was taken as an oxidation potential.

Further, the hole-transporting compound having chain-polymerization function groups may preferably exhibit a hole-transporting ability in terms of a drift mobility of at least $1\times10^7$ ($cm^2$/V.sec) as measured under an applied electric field of $5\times10^4$ (V/cm). At a lower drift mobility, in the resultant photosensitive member, holes generated by exposure cannot be sufficiently moved, thus being liable to result in an apparent decrease of sensitivity and an increased residual potential in some cases.

Preferred examples of the hole-transporting compound having at least two chain-polymerization function groups (curable hole transporting compounds) are enumerated hereinbelow, but these are not exhaustive.

EXAMPLES OF CURABLE HOLE-TRANSPORTING COMPOUNDS

1

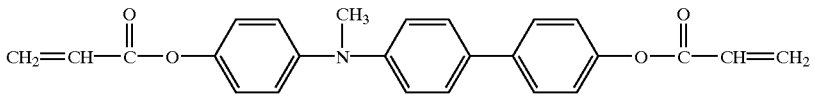

-continued
2
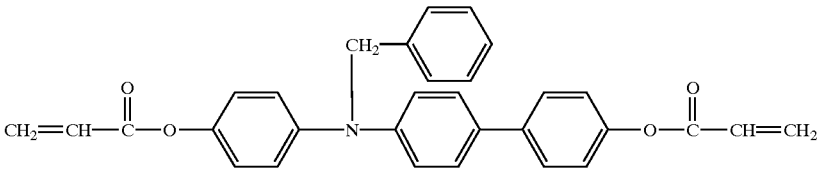
3
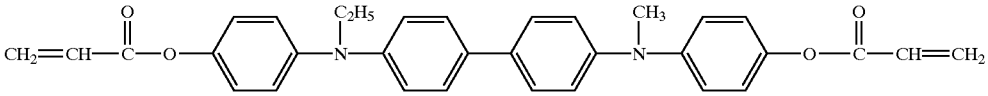
4
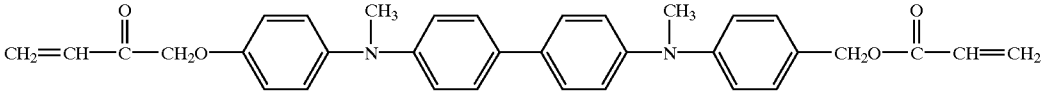
5
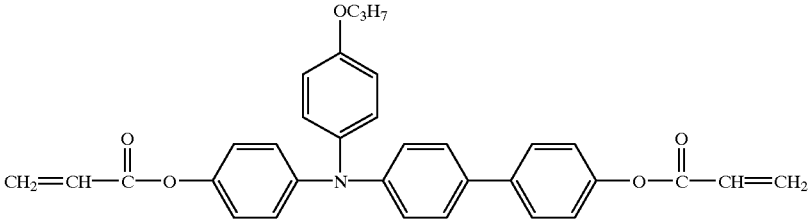
6
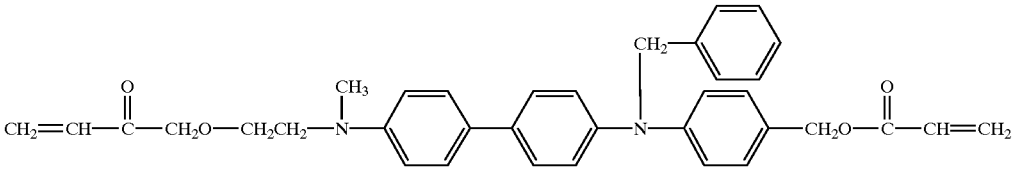
7
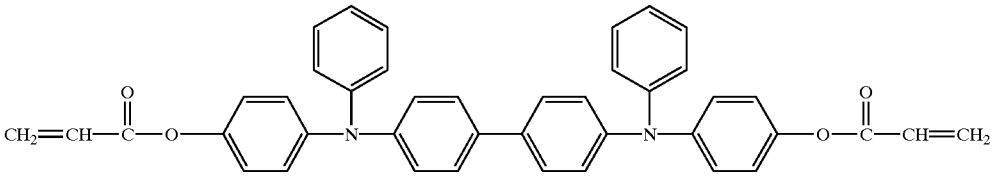
8
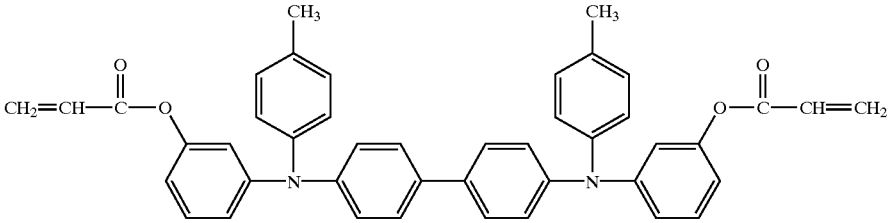
9
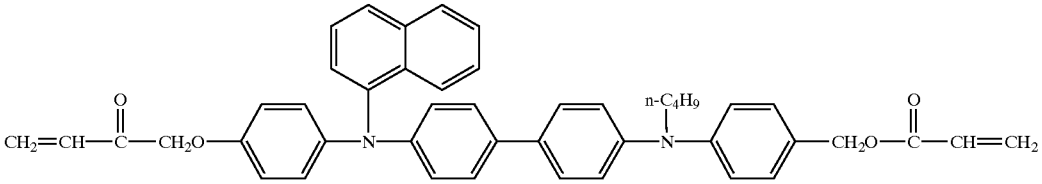
10
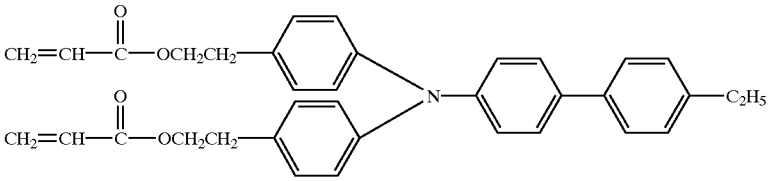

-continued
11
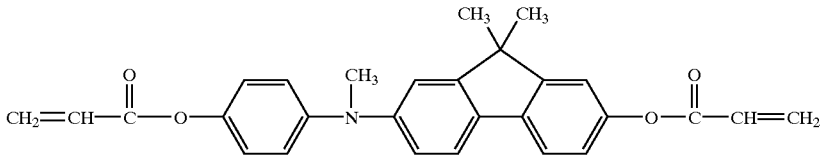
12
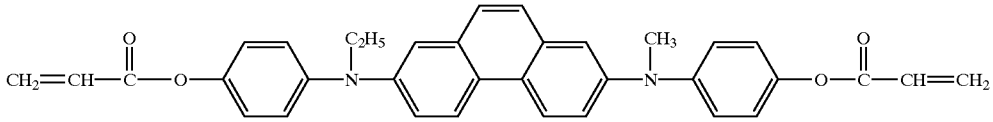
13
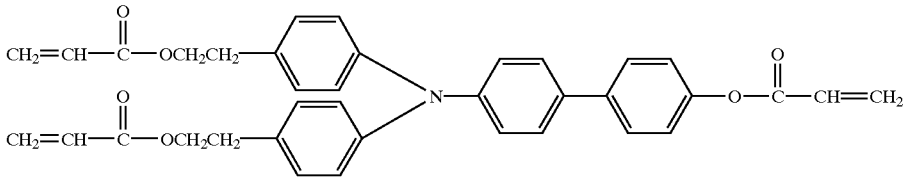
14
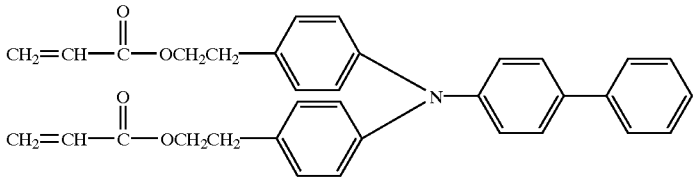
15
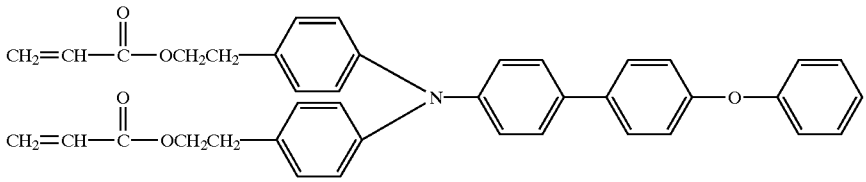
16
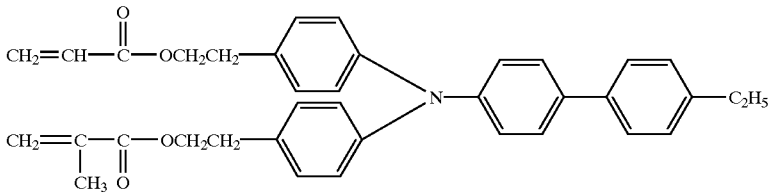
17
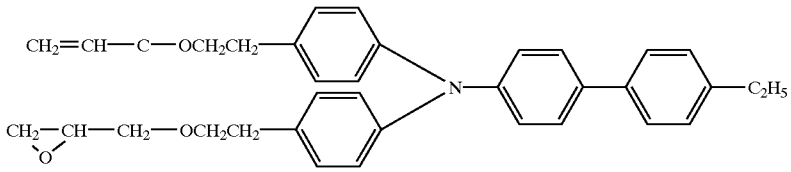
18
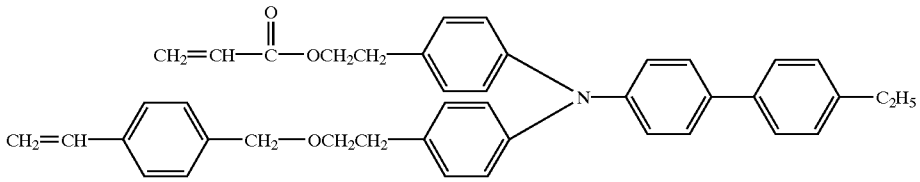

-continued
19
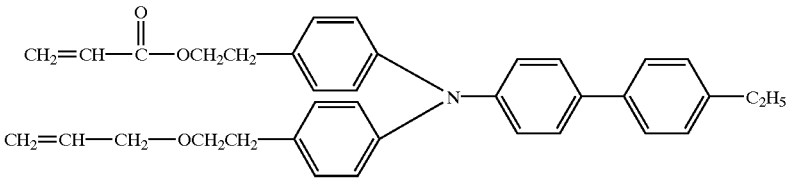
20
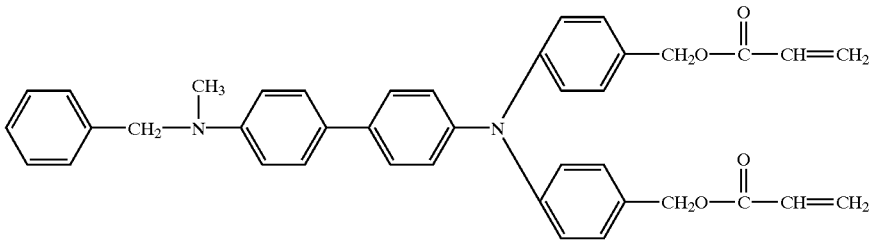
21
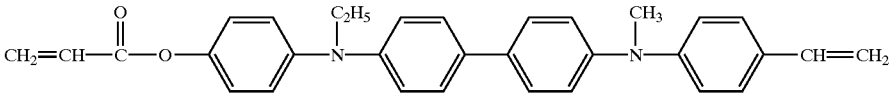
22
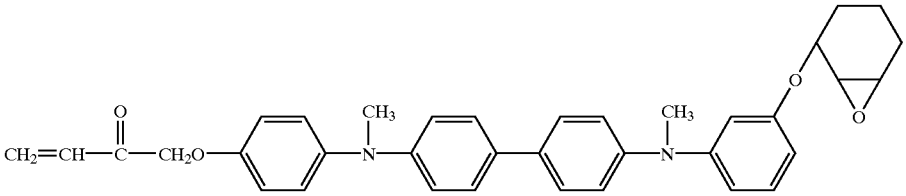
23
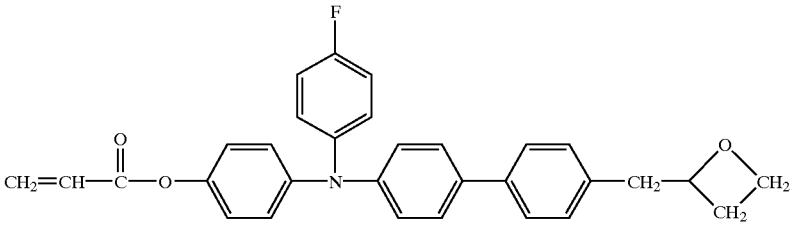
24
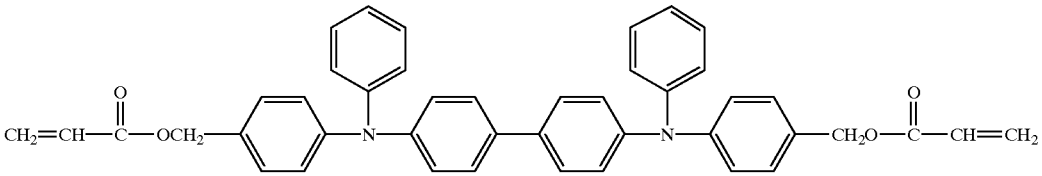
25
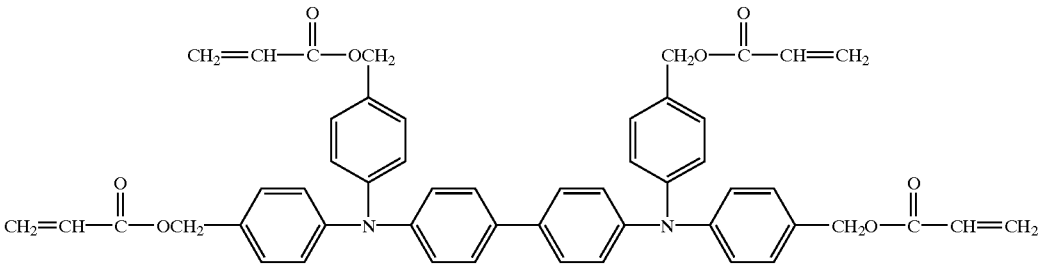

-continued
26
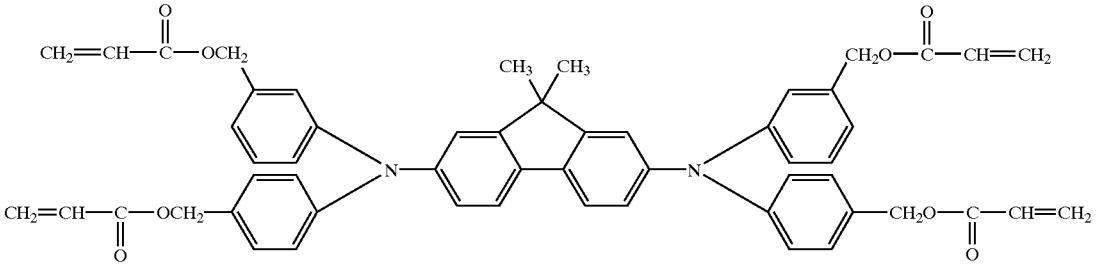
27
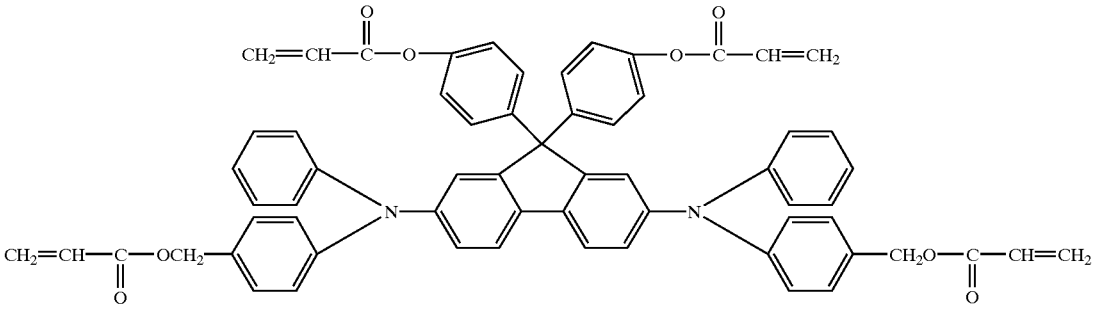
28
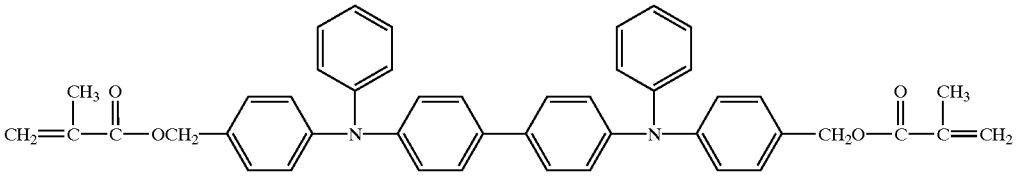
29
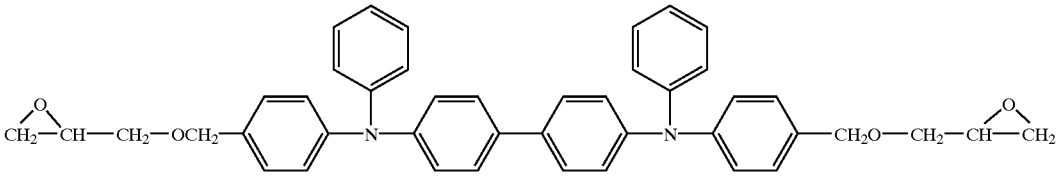
30
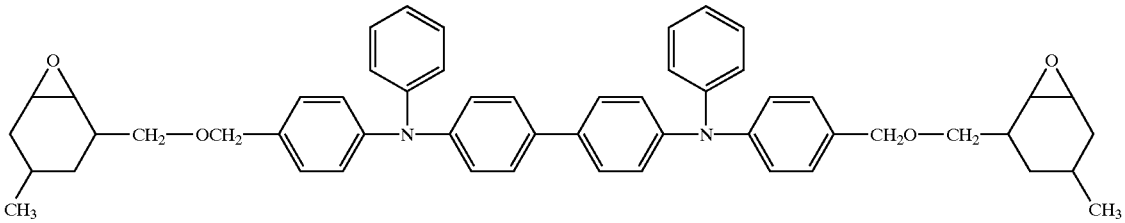
31
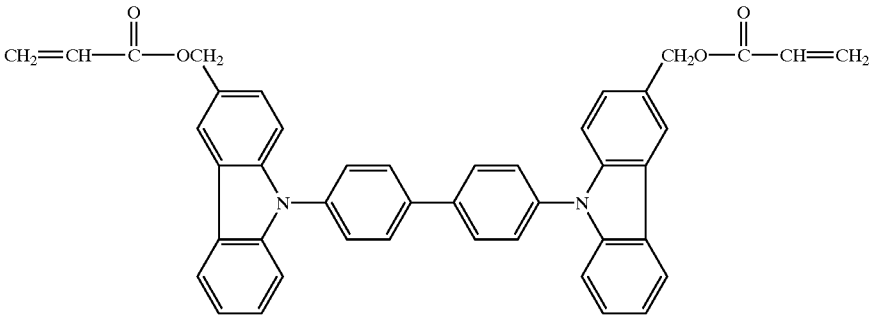

-continued
32
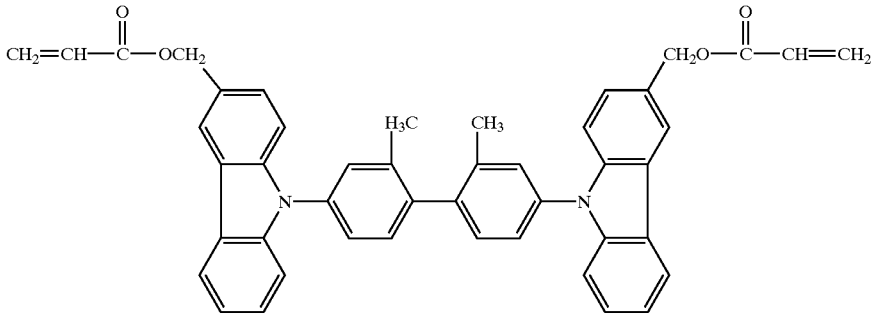
33
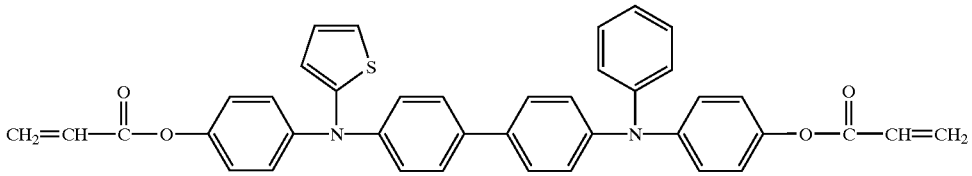
34
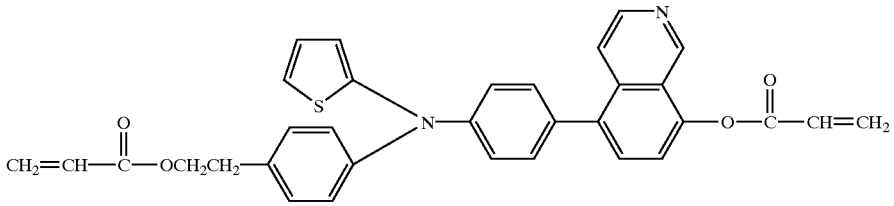
35
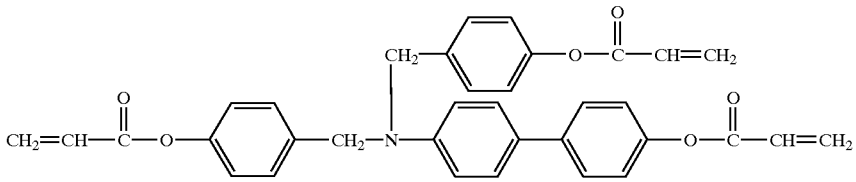
36
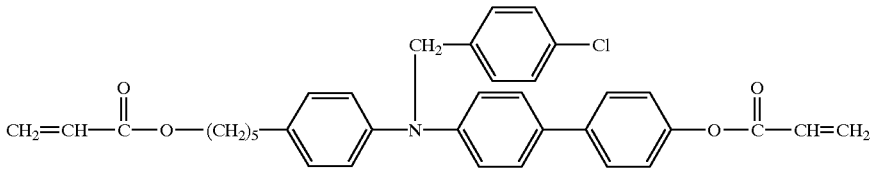
37
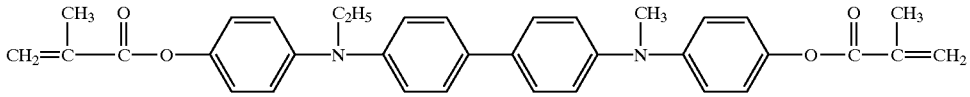
38
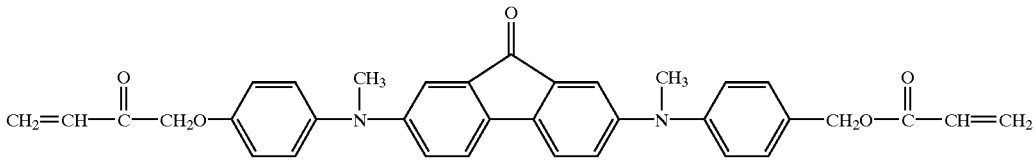

-continued
39
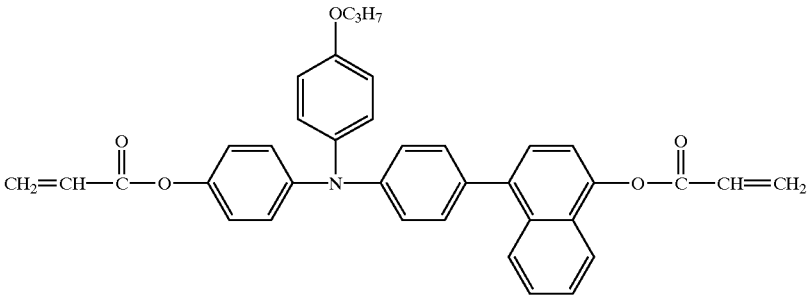
40
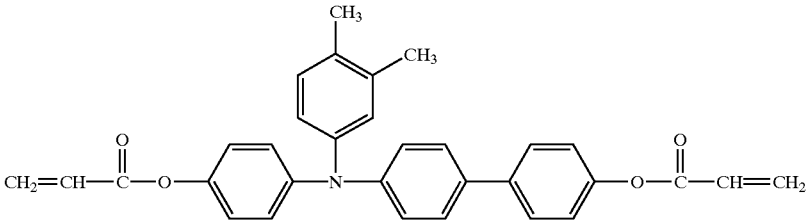
41
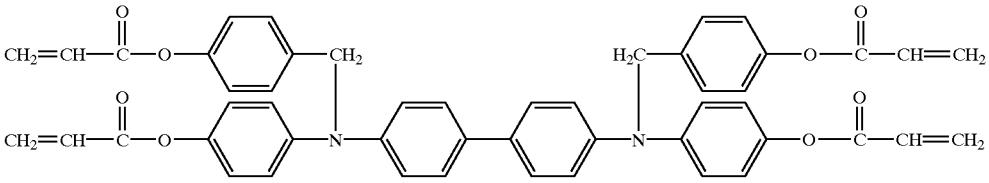
42
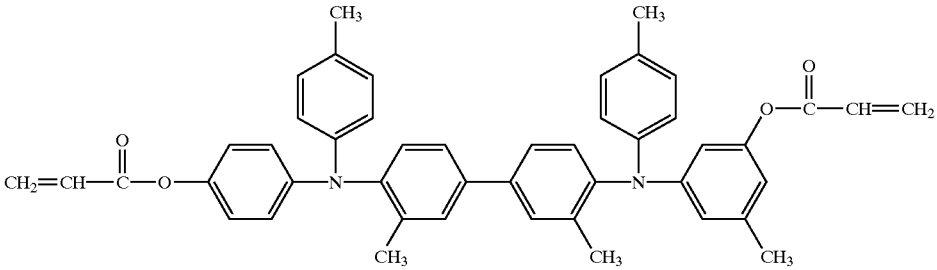
43
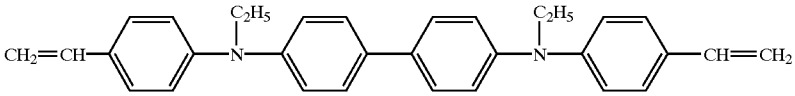
44
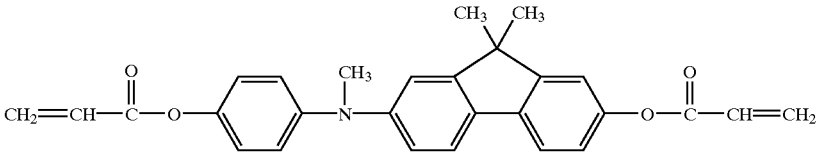
45
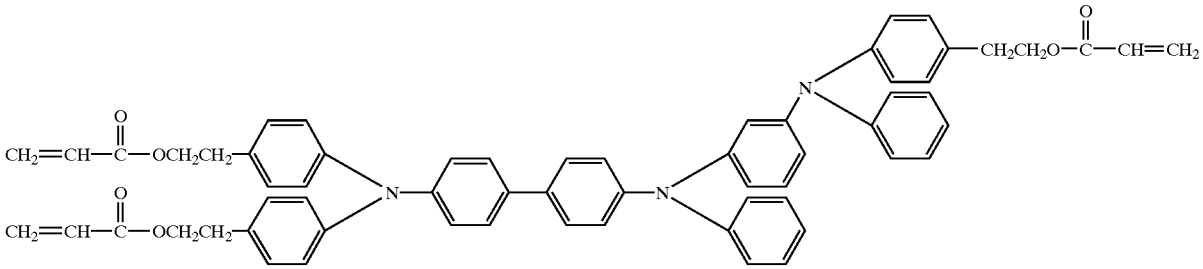

-continued
46
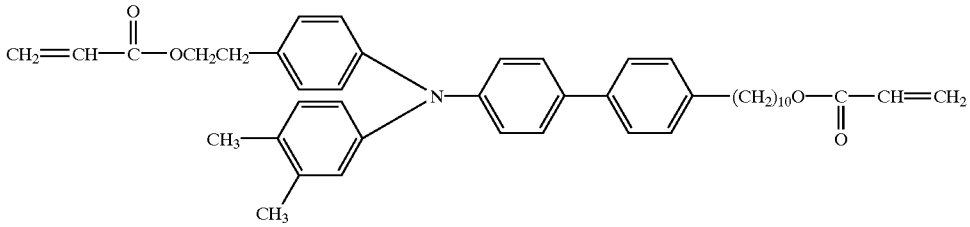
47
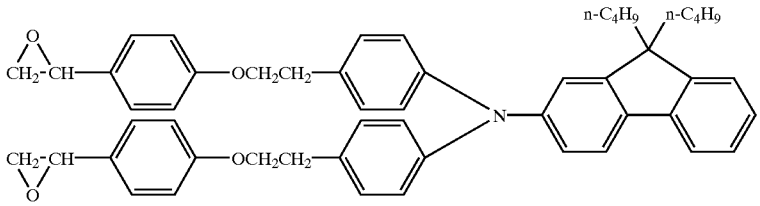
48
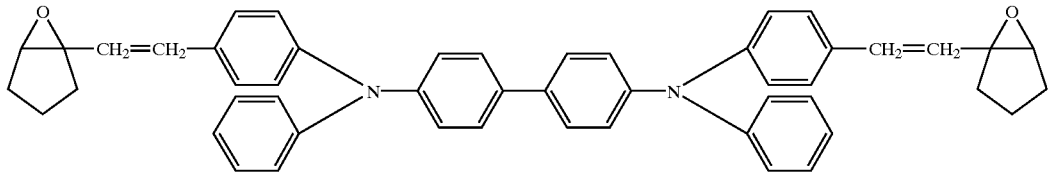
49
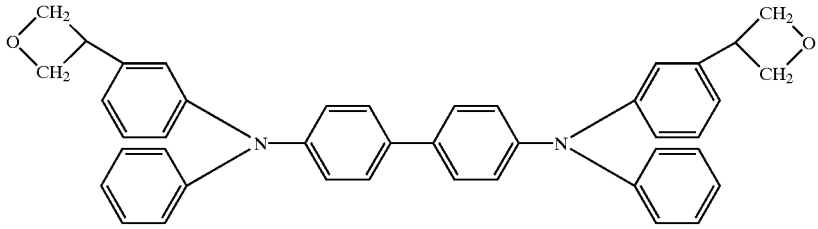
50
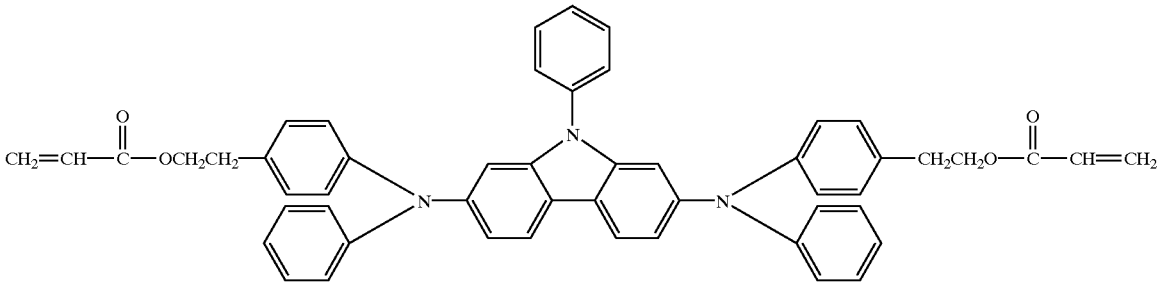
51
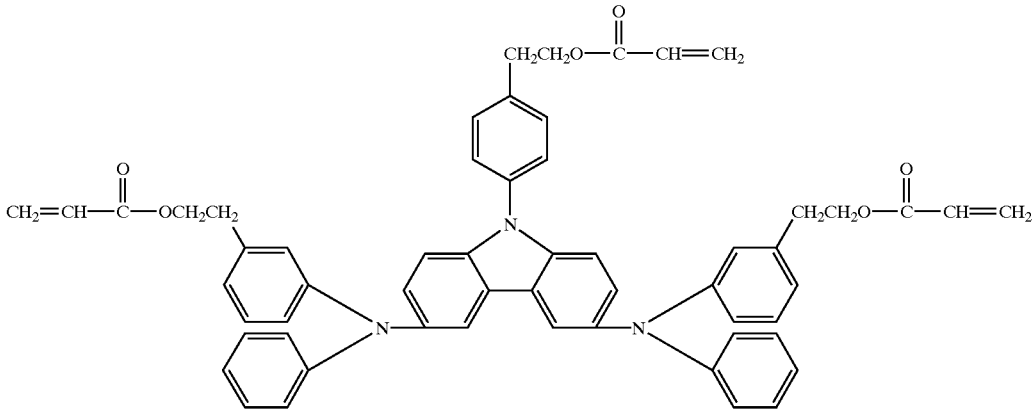

-continued
52
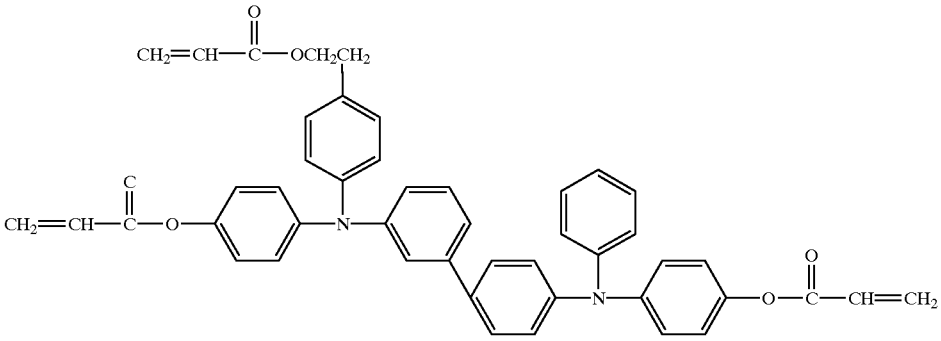
53
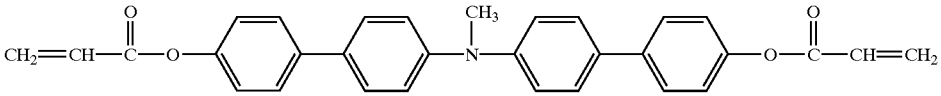
54
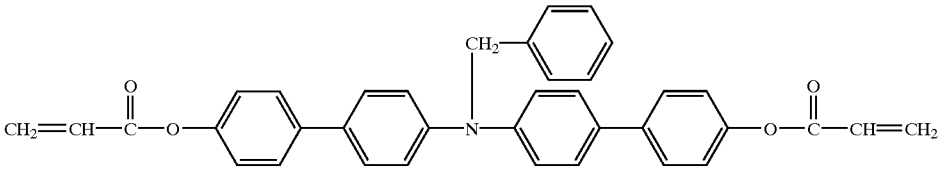
55
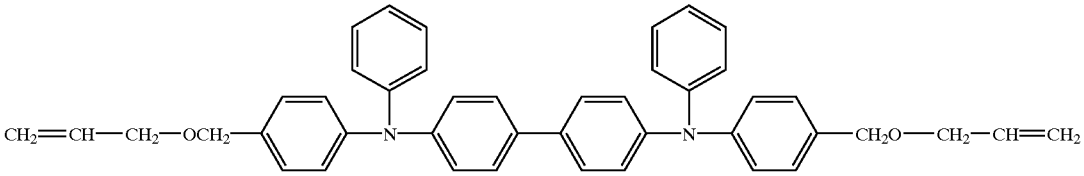
56
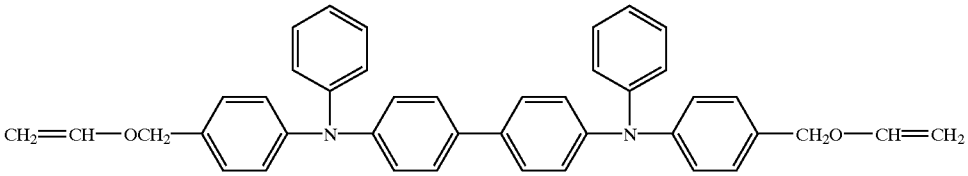
57
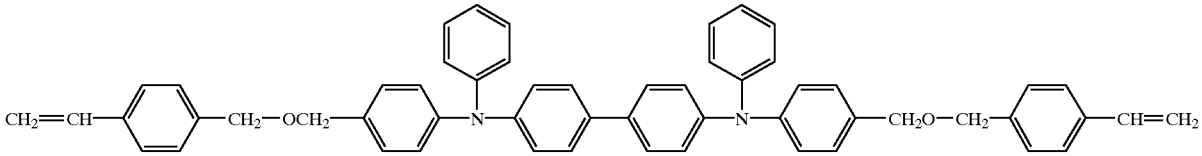
58
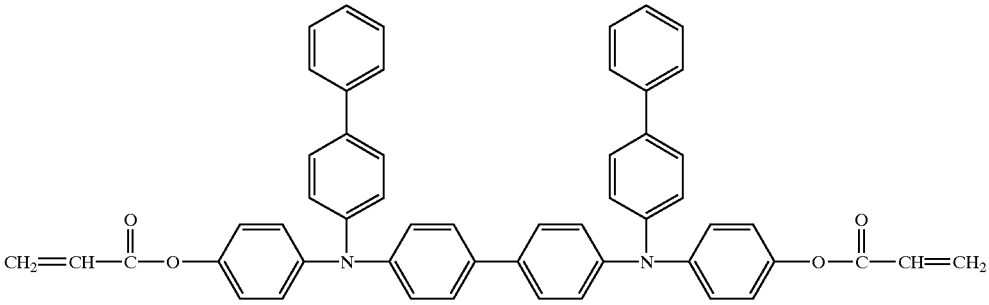

-continued
59
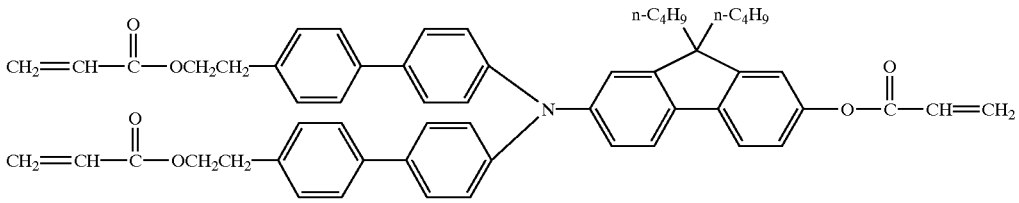
60
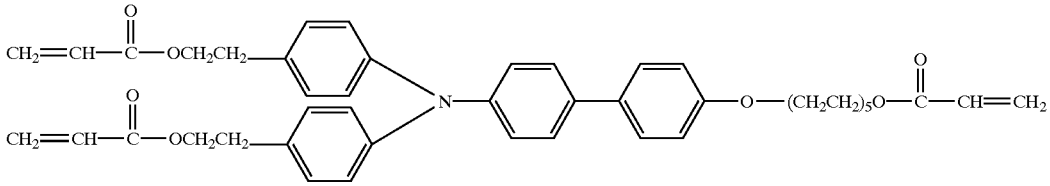
61
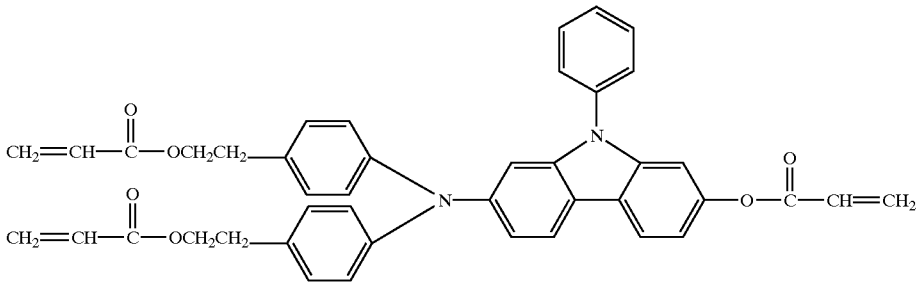
62
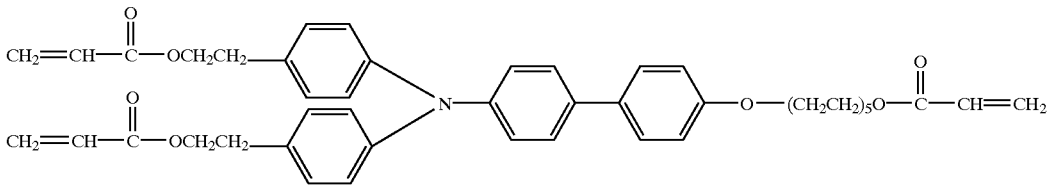
63
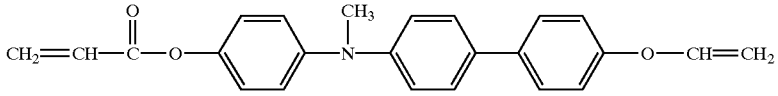
64
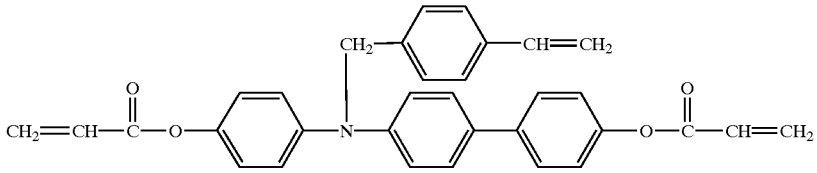
65
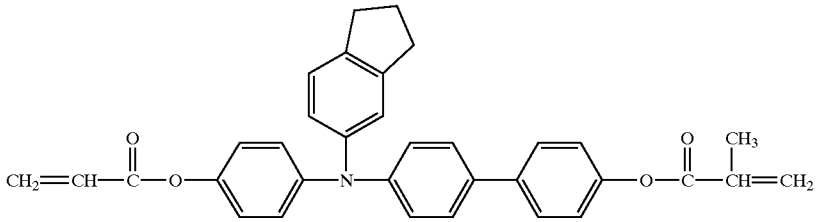

-continued
66
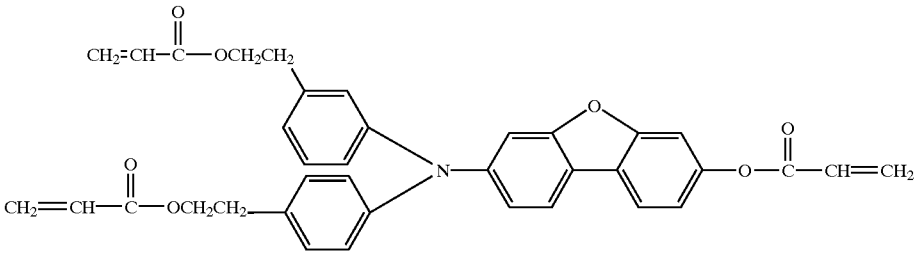
67
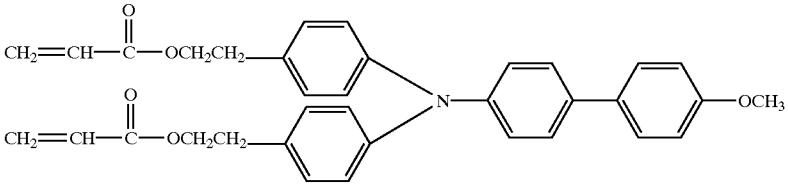
68
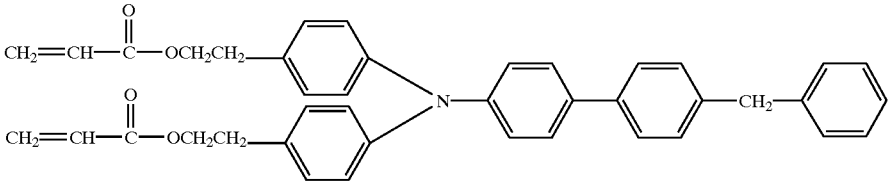
69
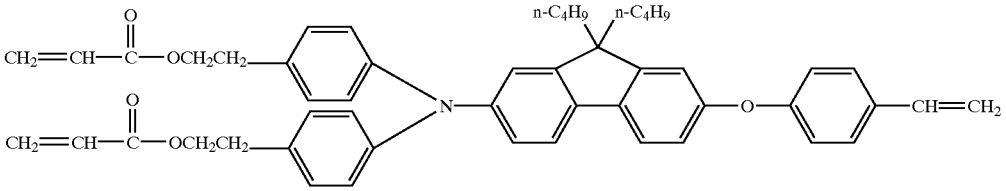
70
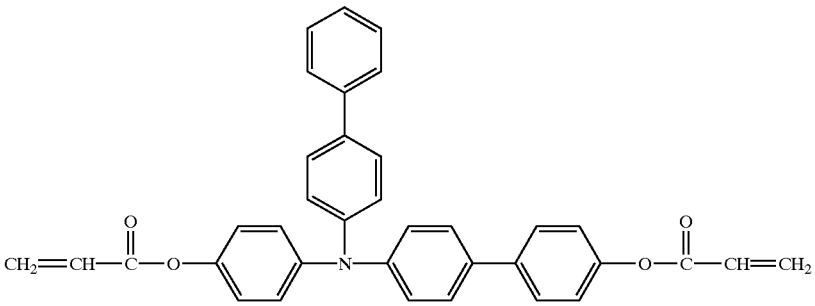
71
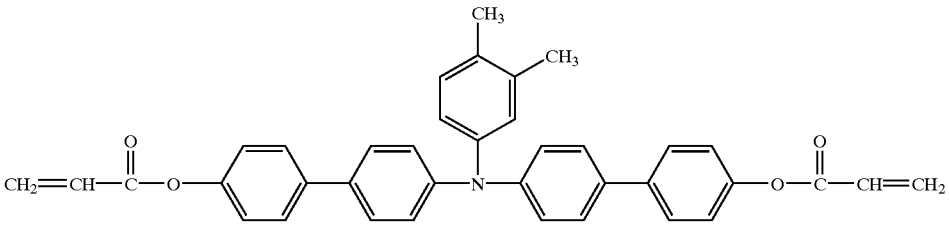

-continued
72
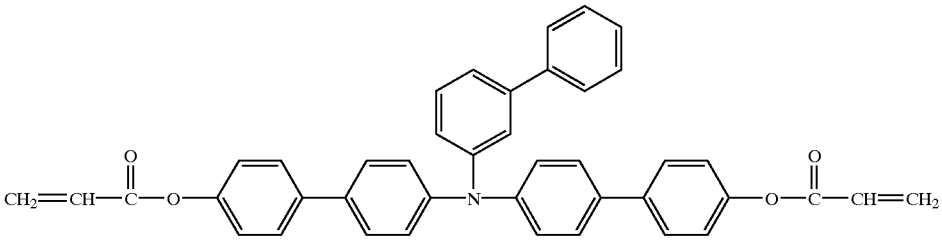
73
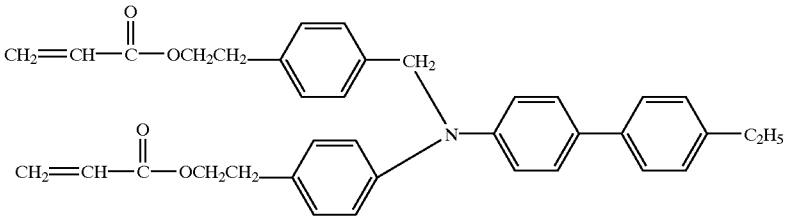
74
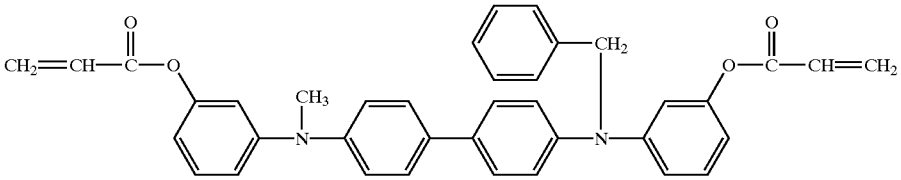
75
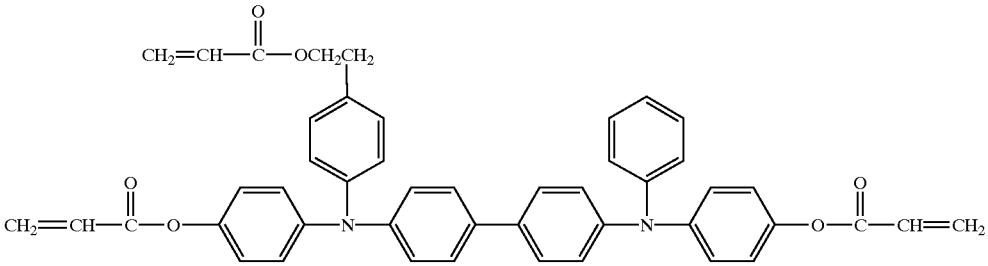
76
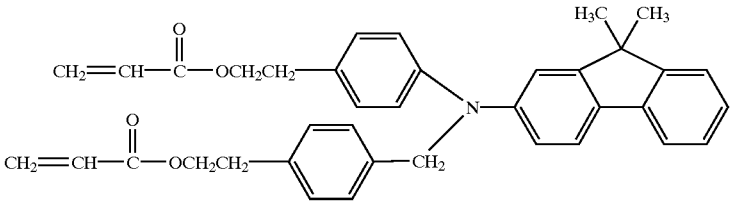
77
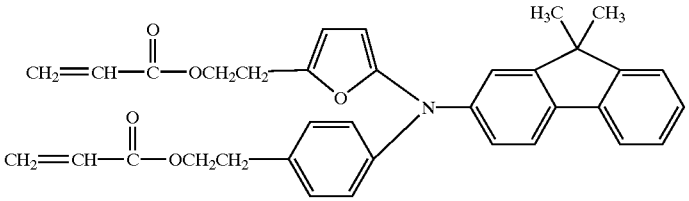
78
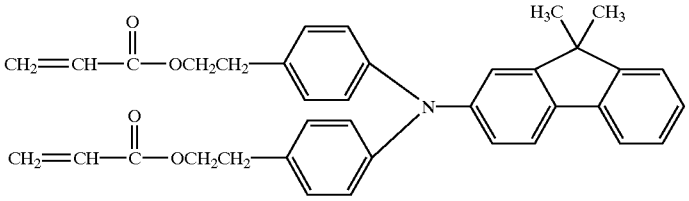

-continued
79
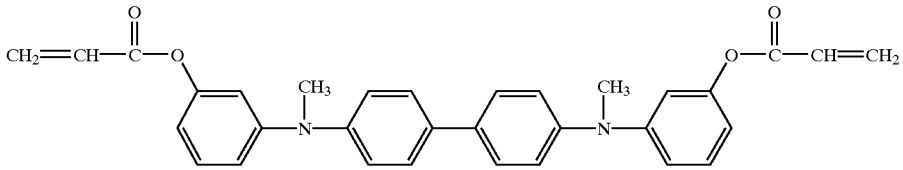
80
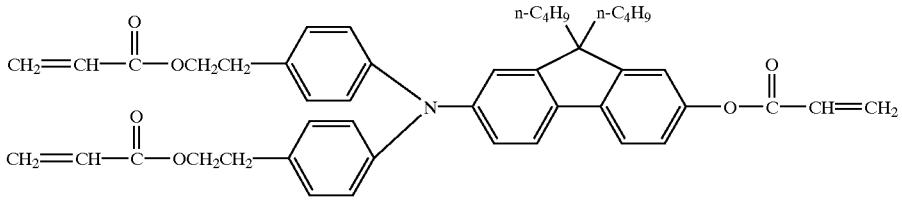
81
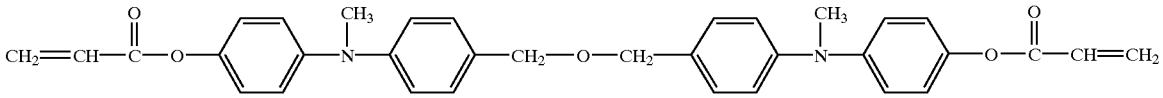
82
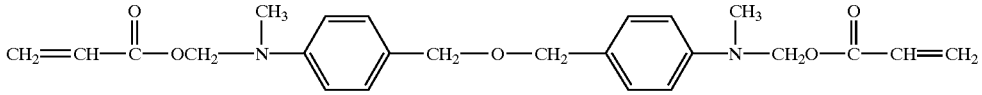
83
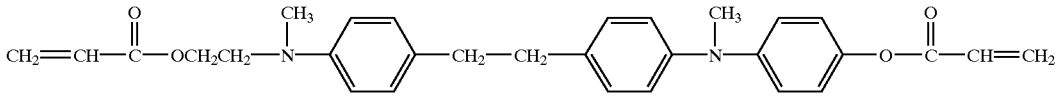
84
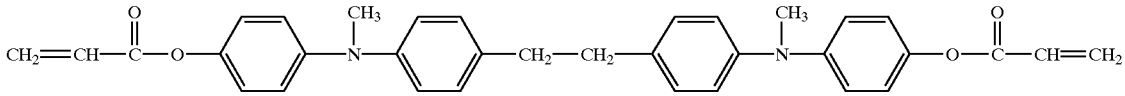
85
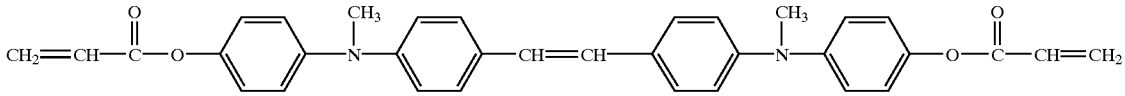
86
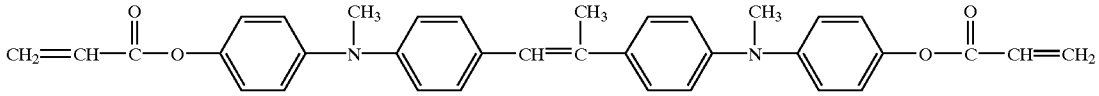
87
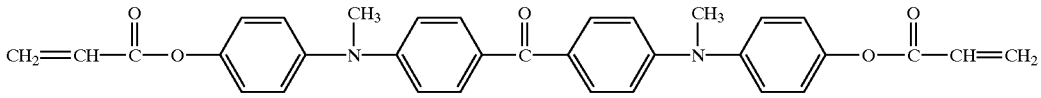
88
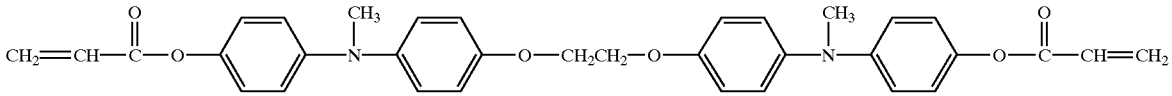
89
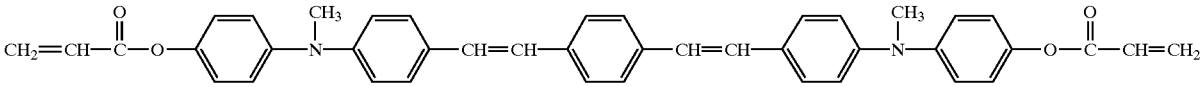
90
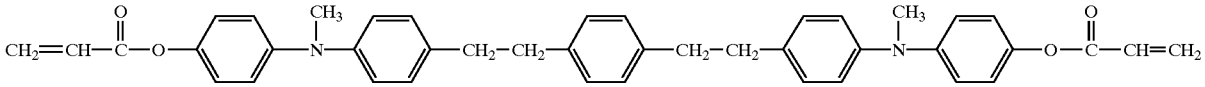

-continued
91
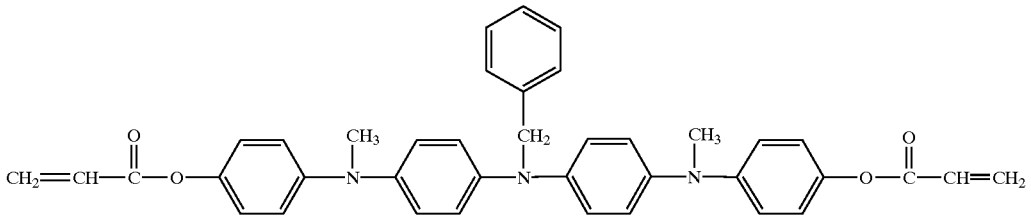
92
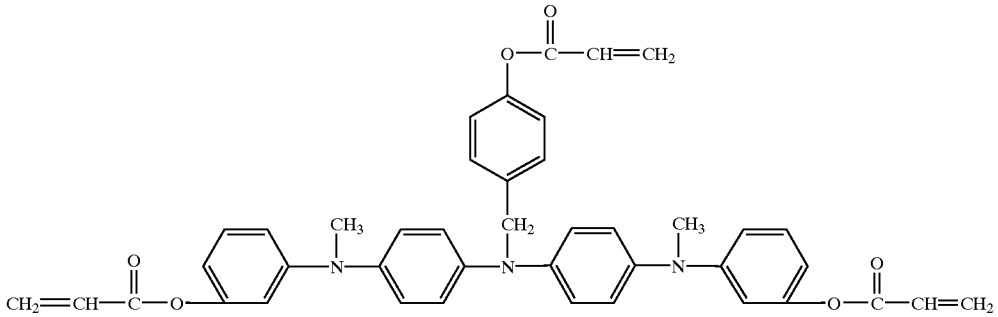
93
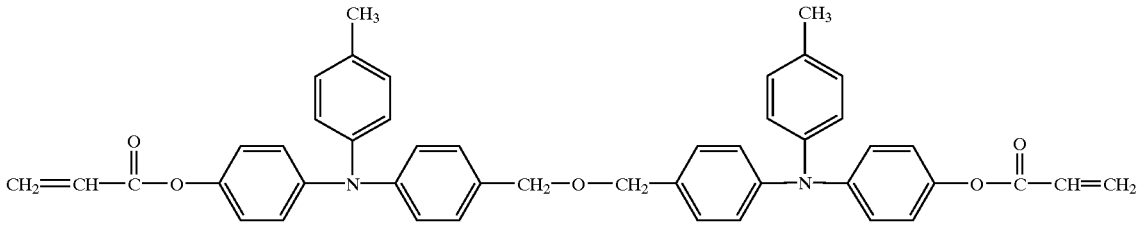
94
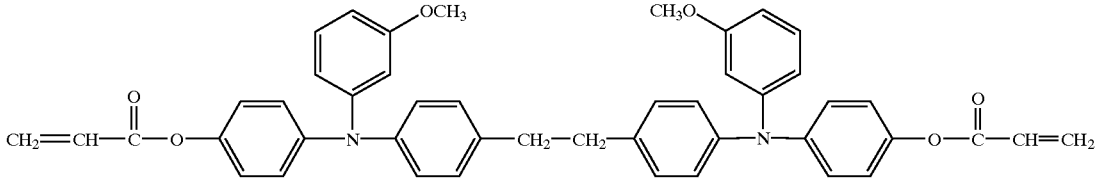
95
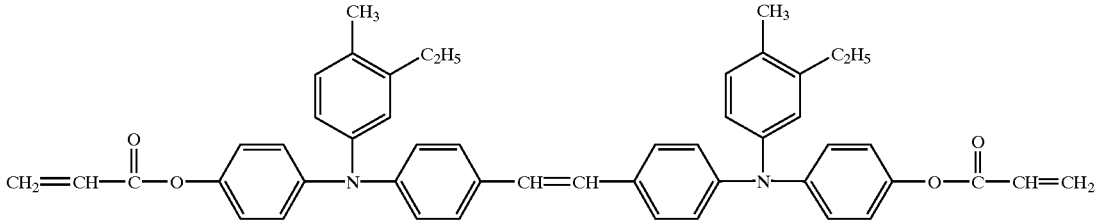
96
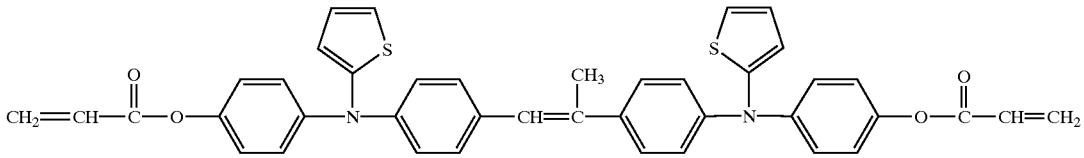
97
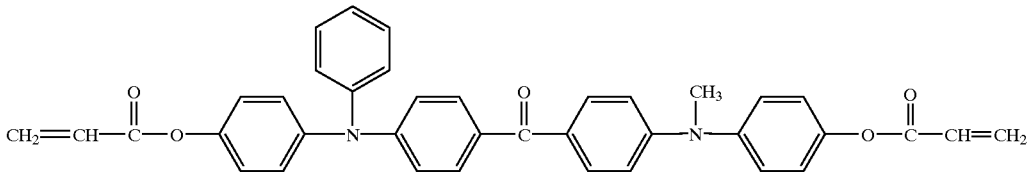

-continued
98
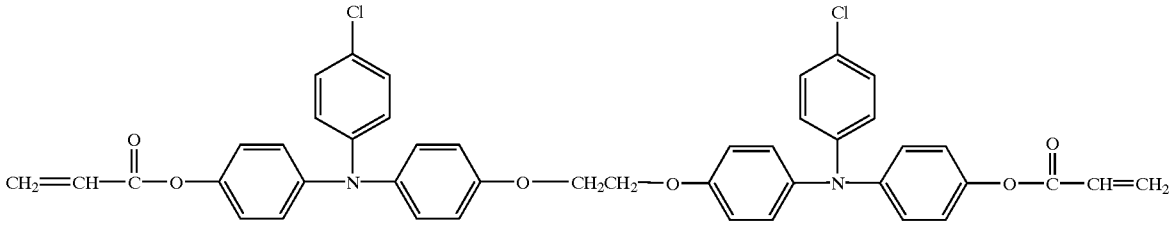
99
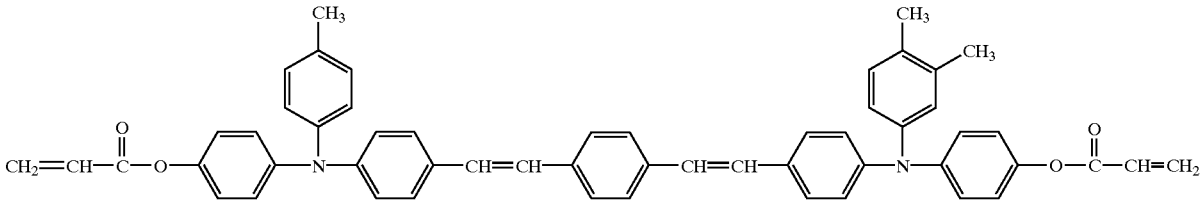
100
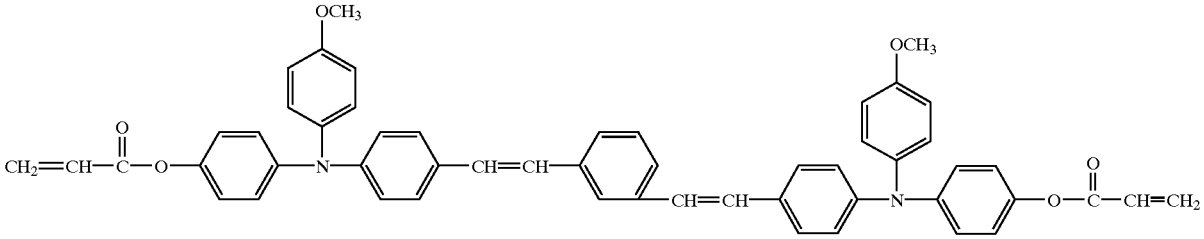
101
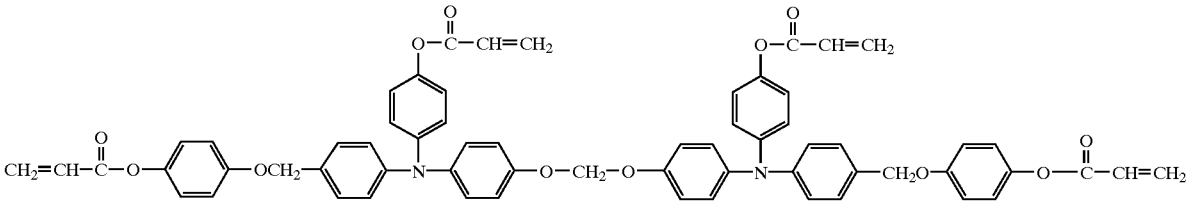
102
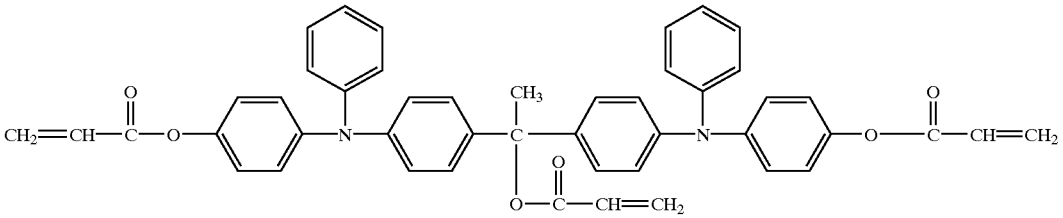
103
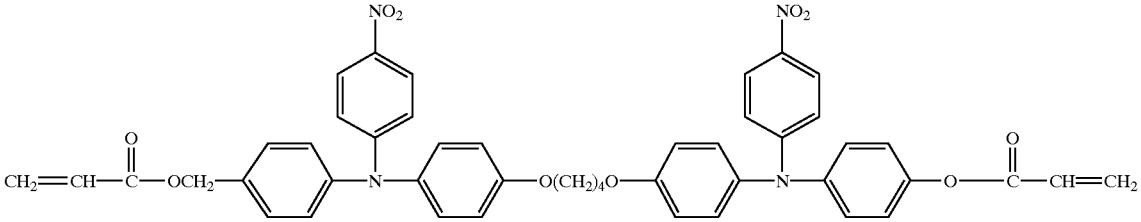

-continued
104
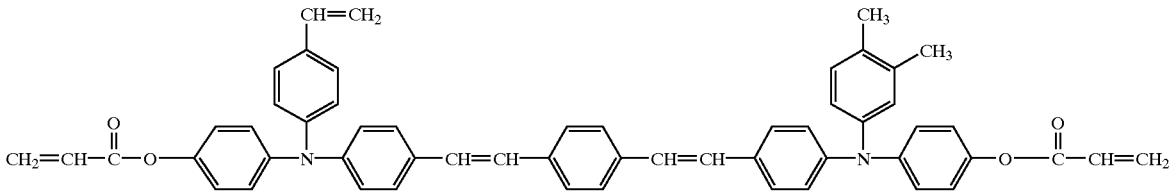
105
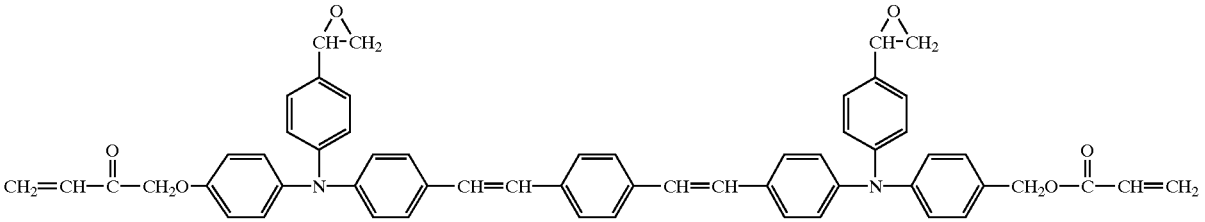
106
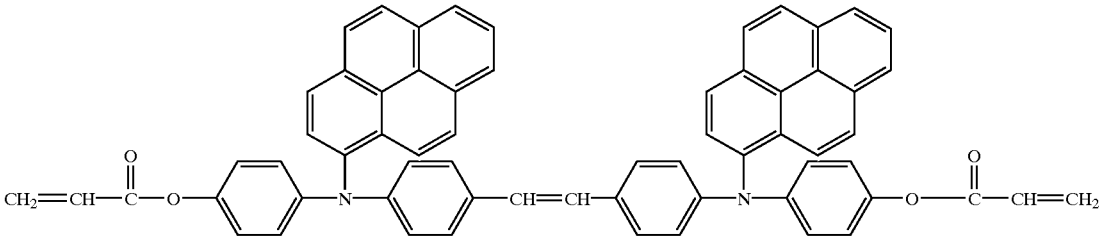
107
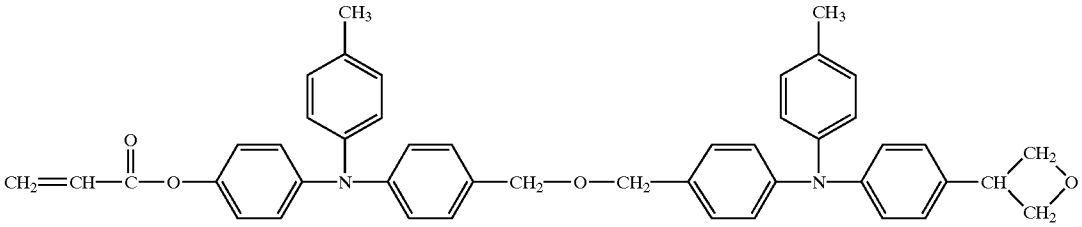
108
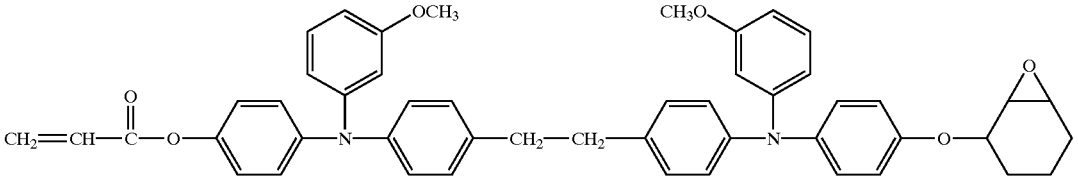
109
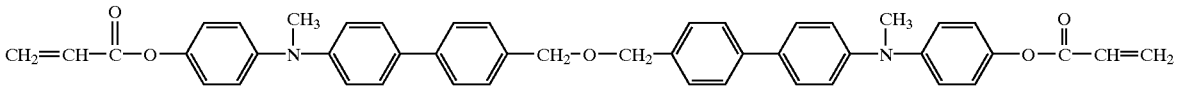
110
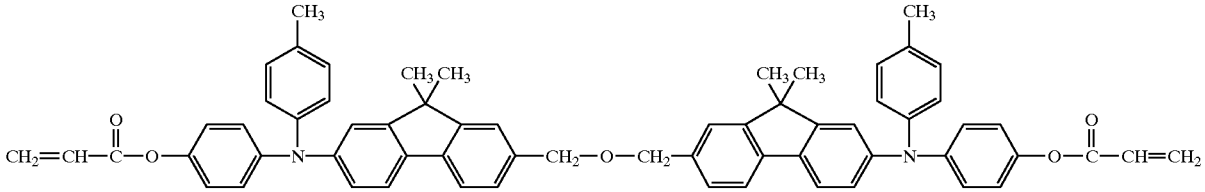
111
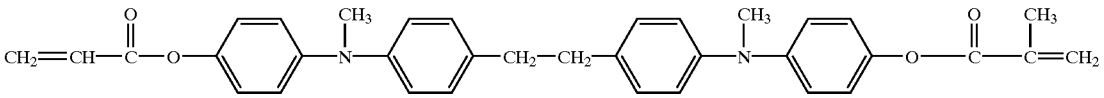

-continued
112
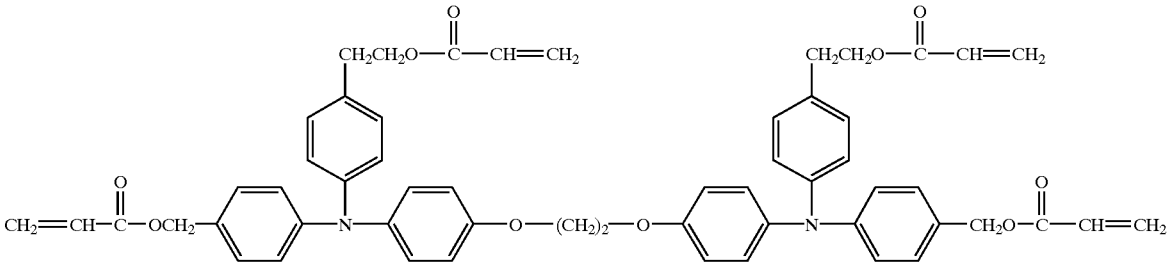
113
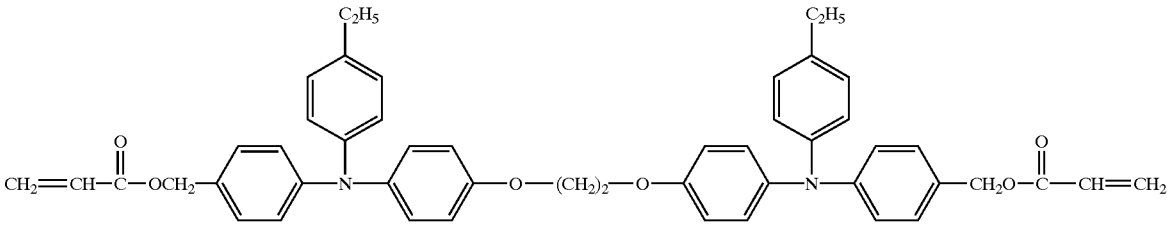
114
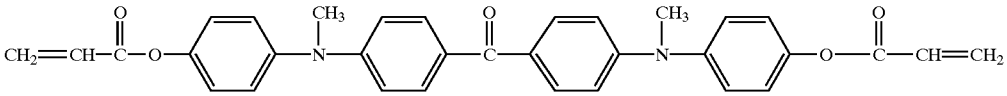
115
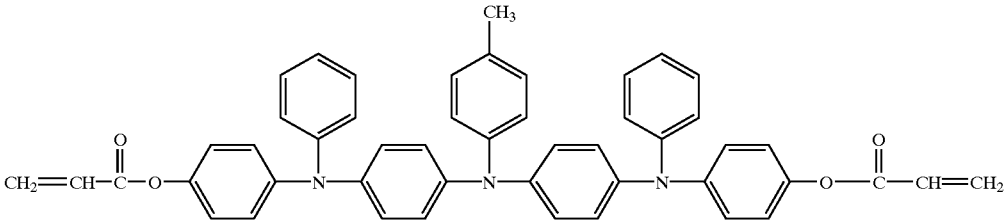
116
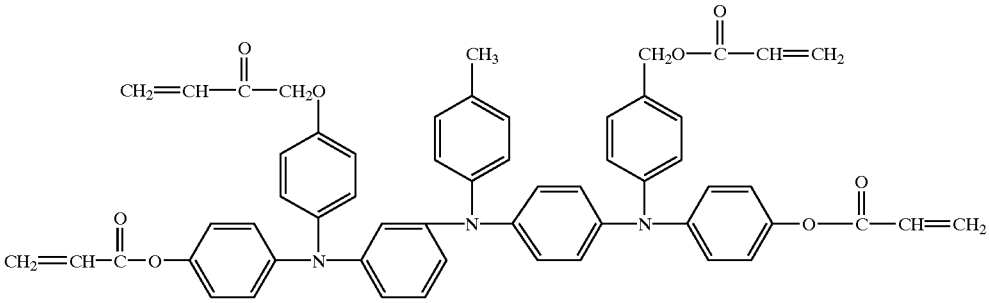
117
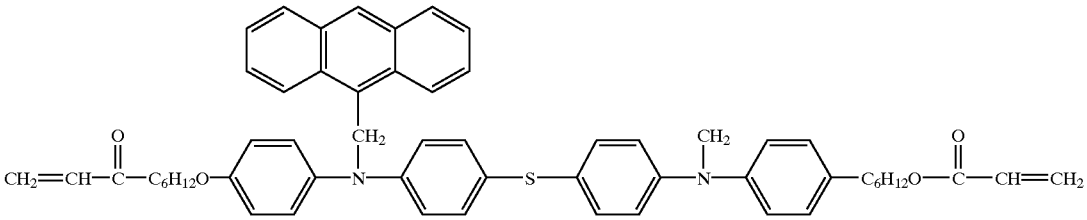

-continued
118
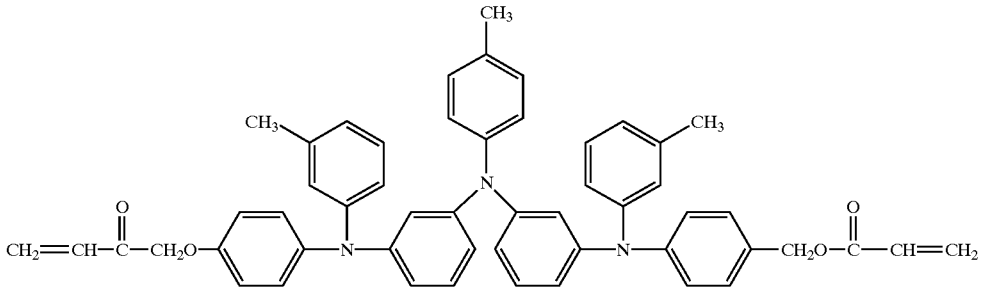
119
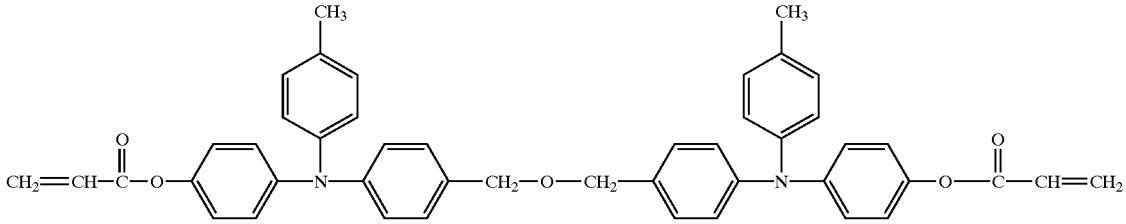
120
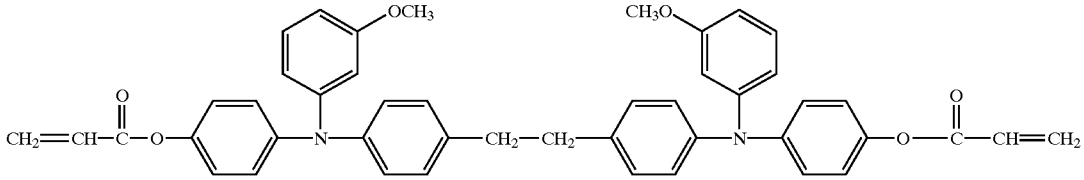
121
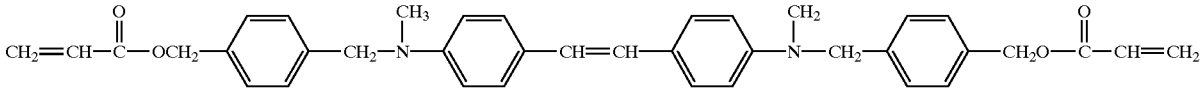
122
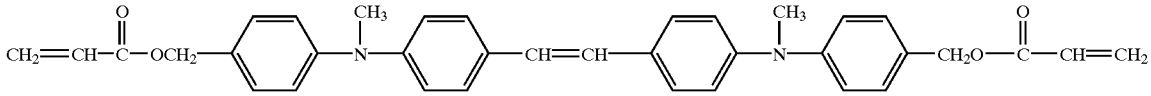
123
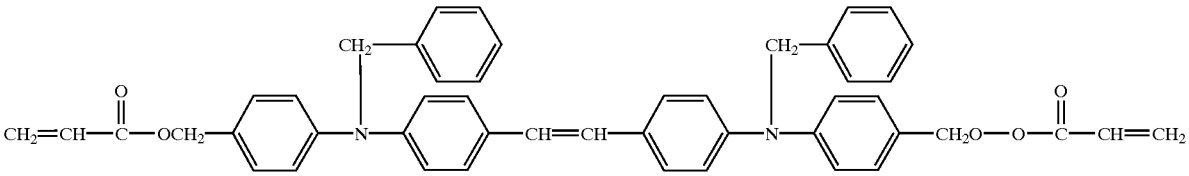
124
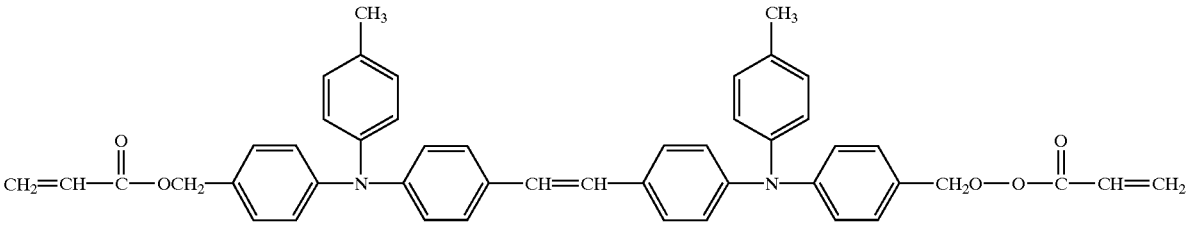

-continued
125
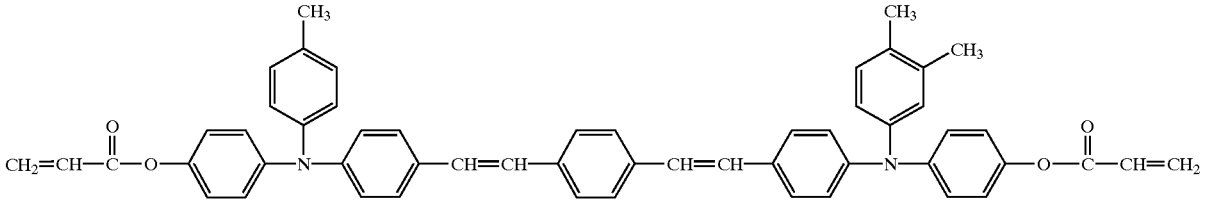
126
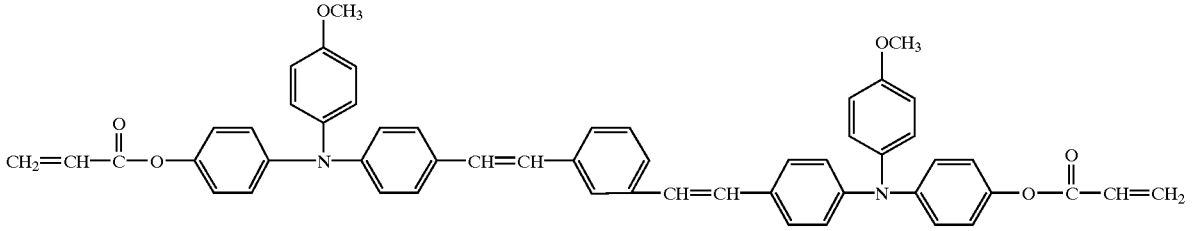
127
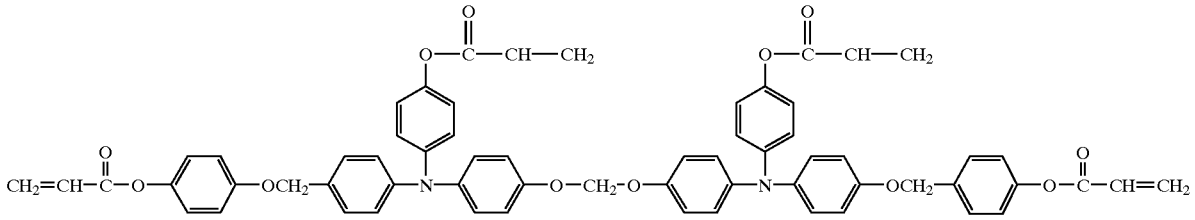
128
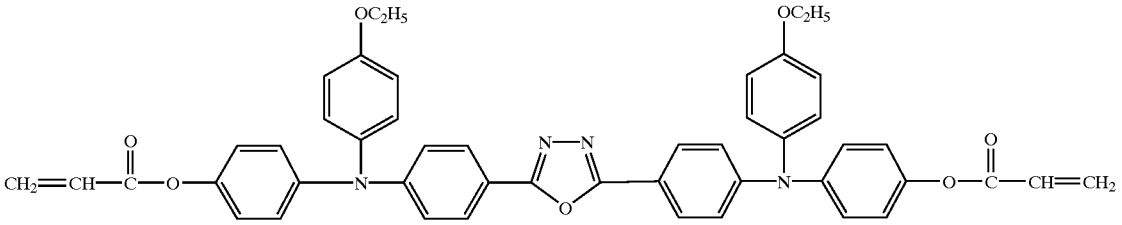
129
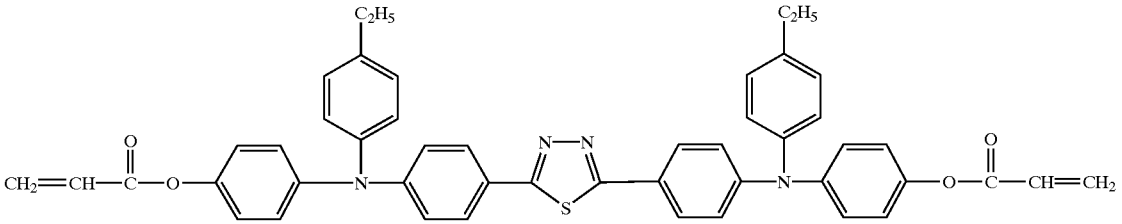
130
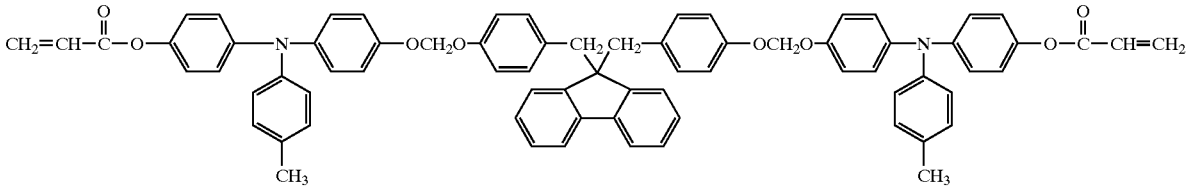

-continued
131
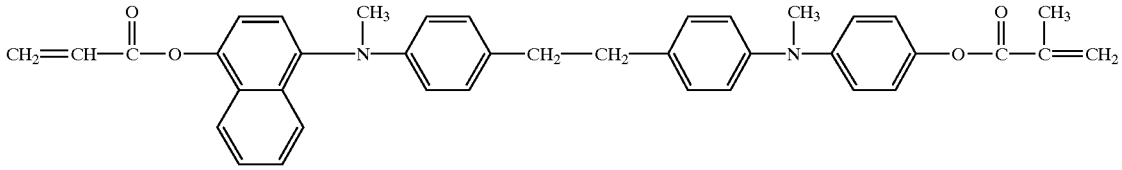
132
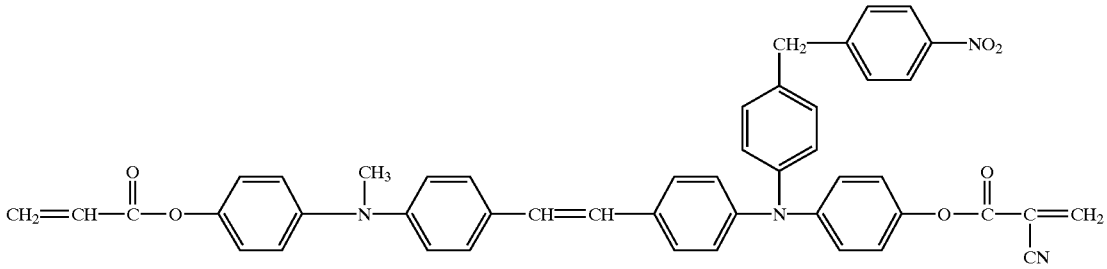
133
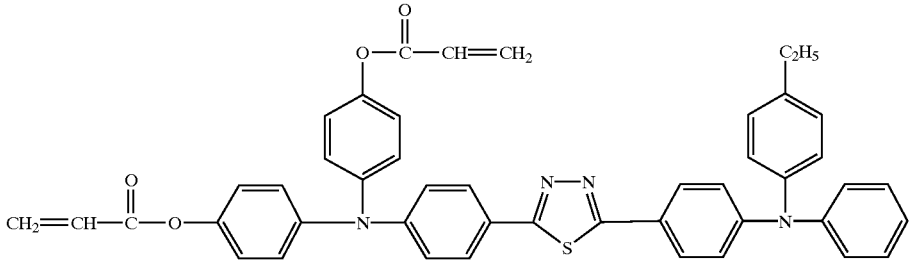
134
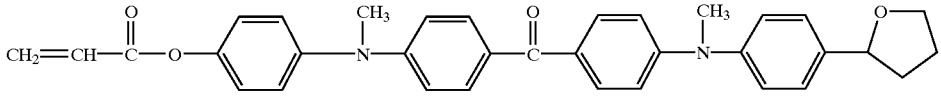
135
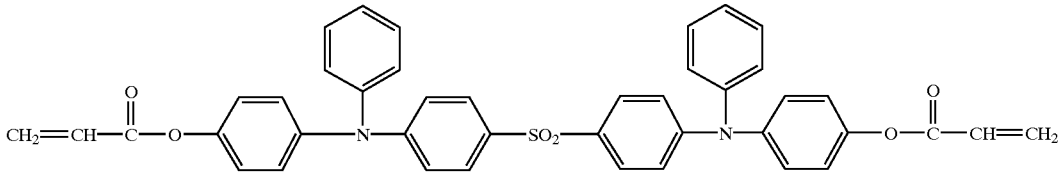
136
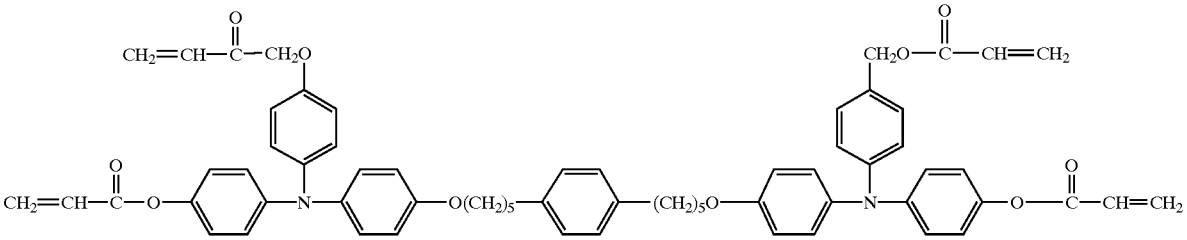
137
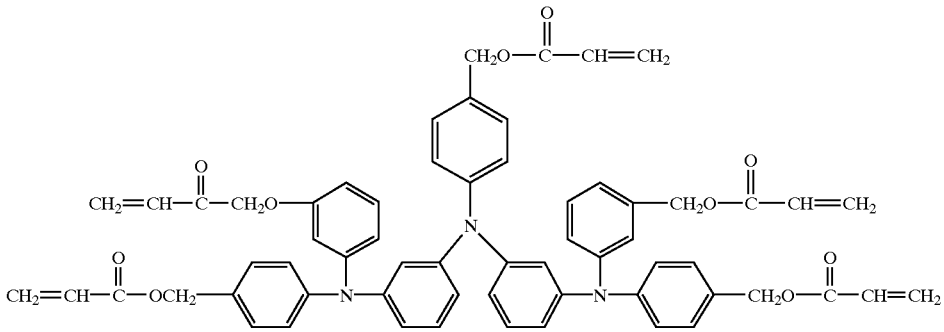

-continued
138
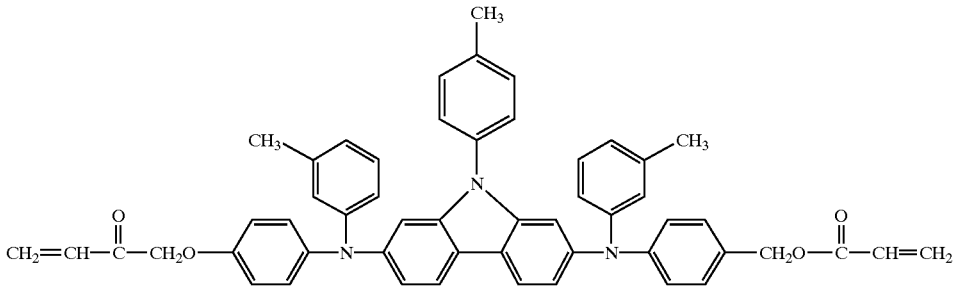
139
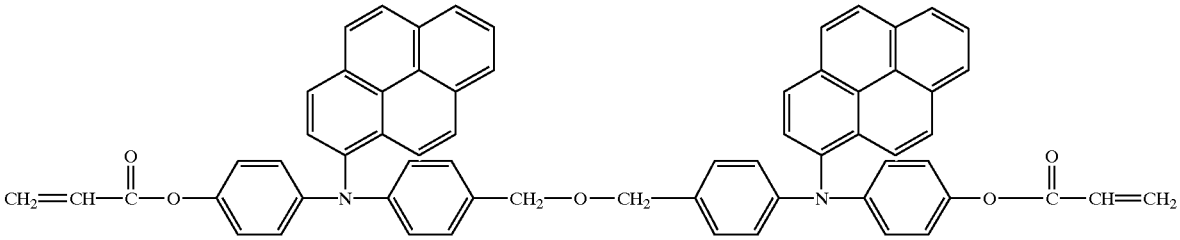
140
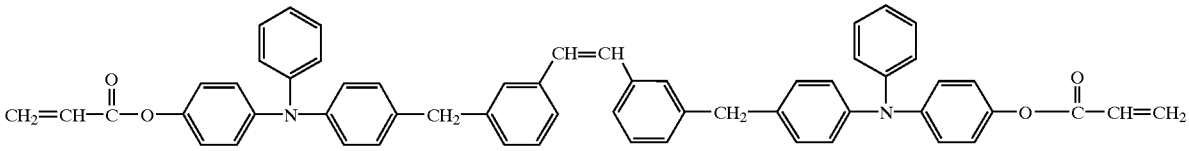
141
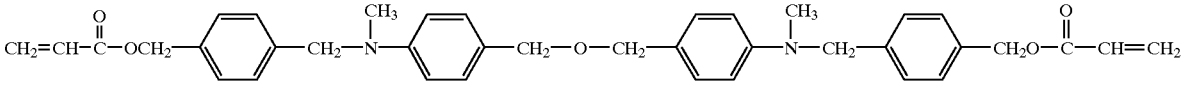
142
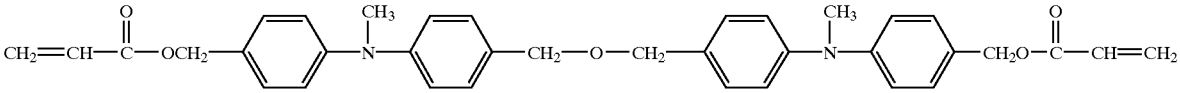
143
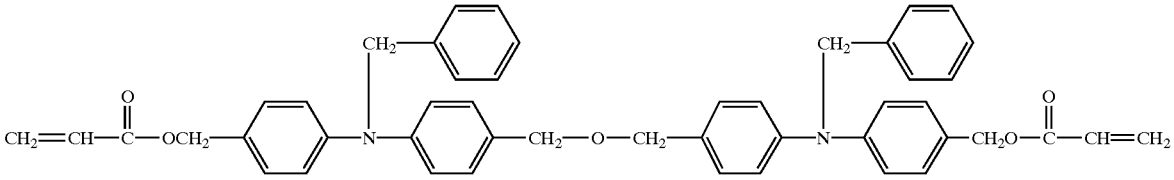
144
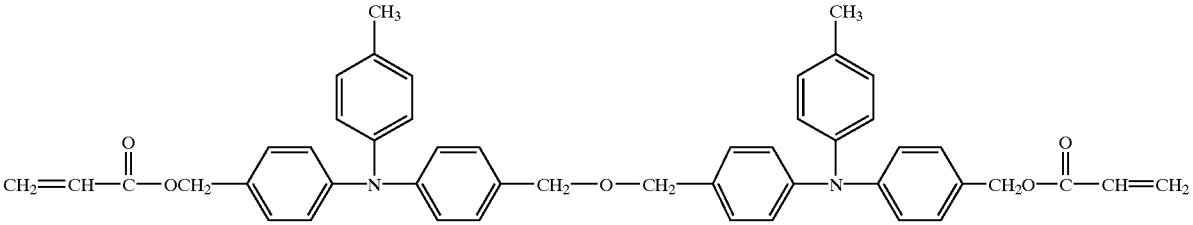
145
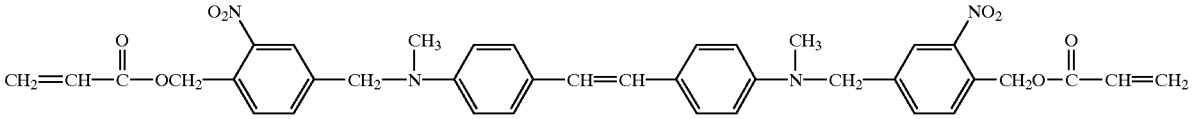

-continued
146
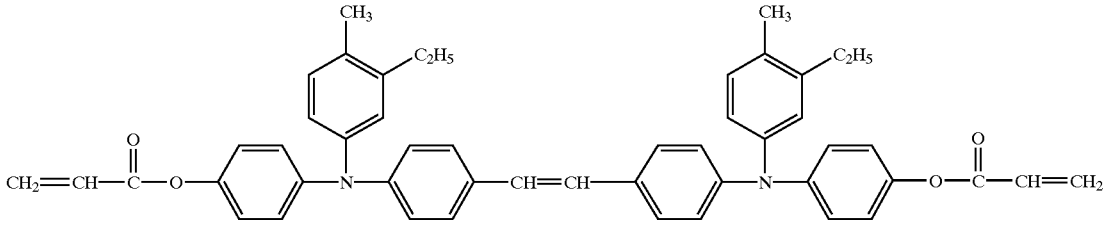
147
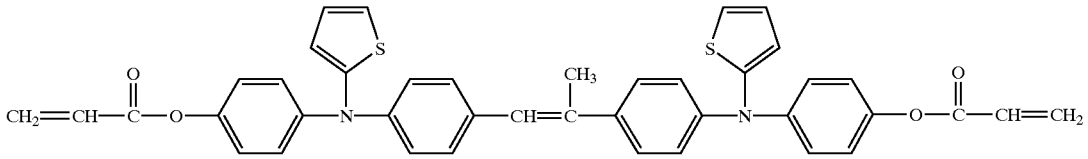
148
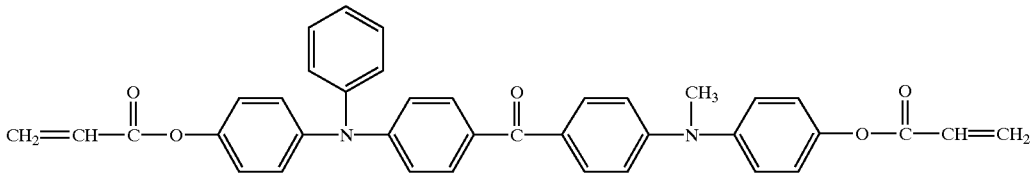
149
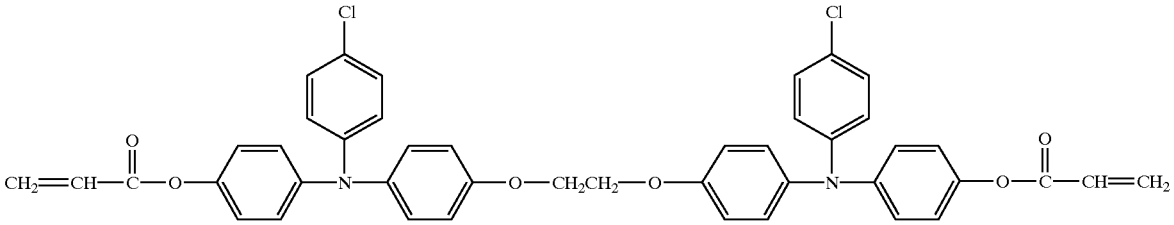
150
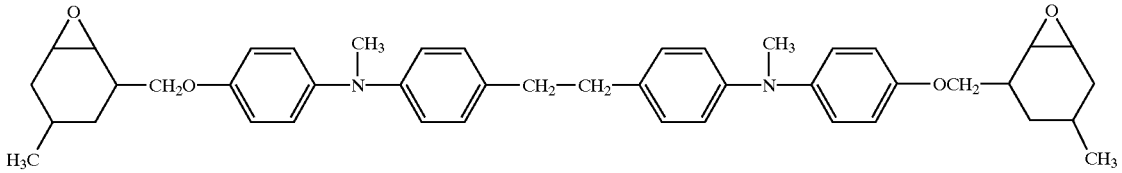
151
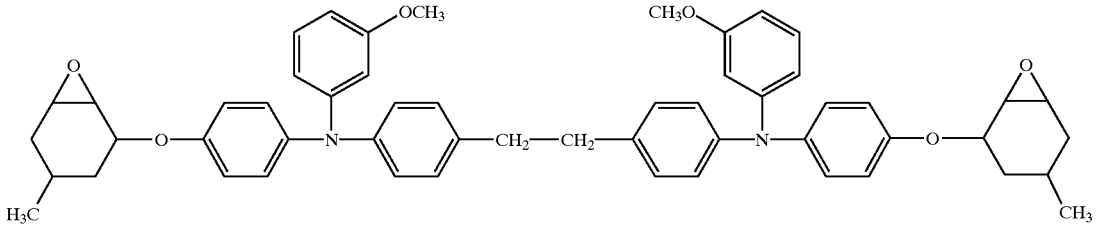
152
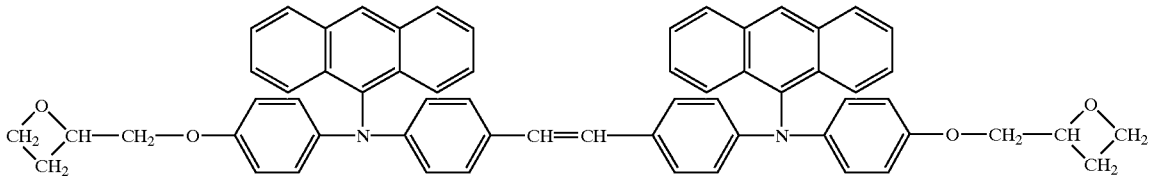

-continued
153
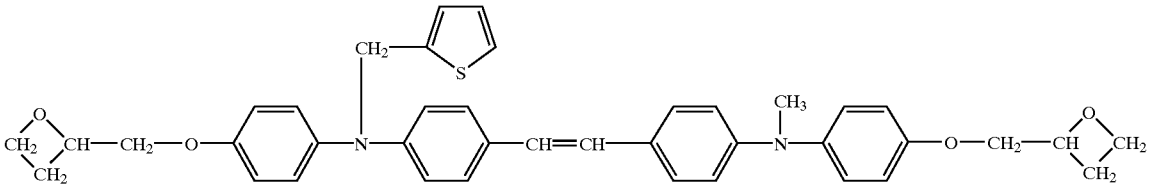
154
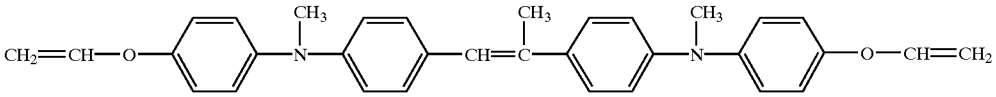
155
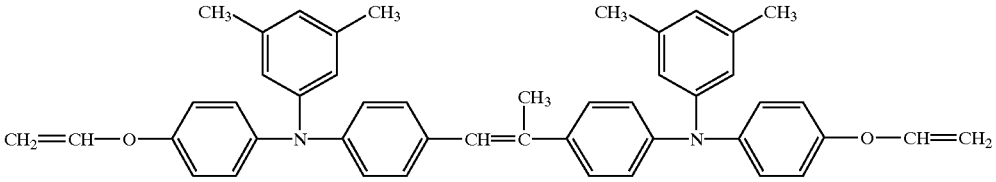
156
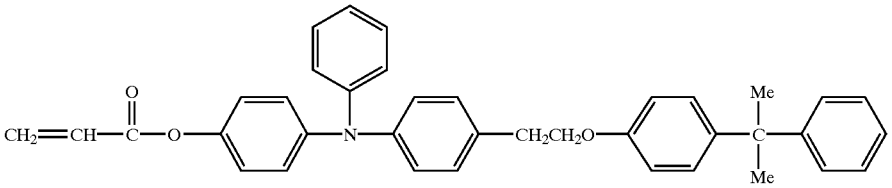
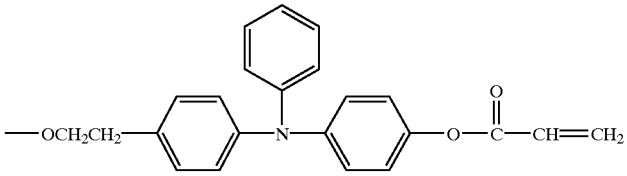
157
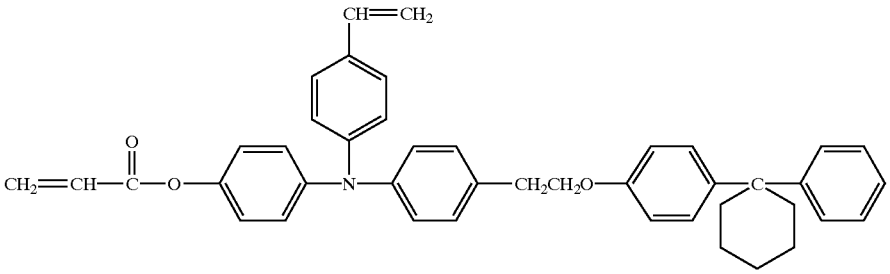
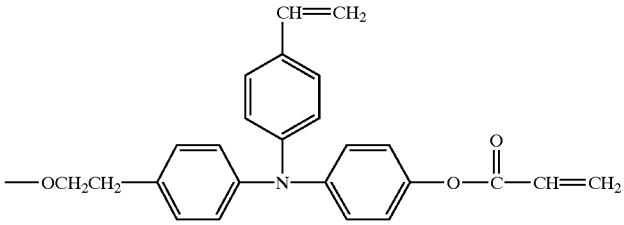
158
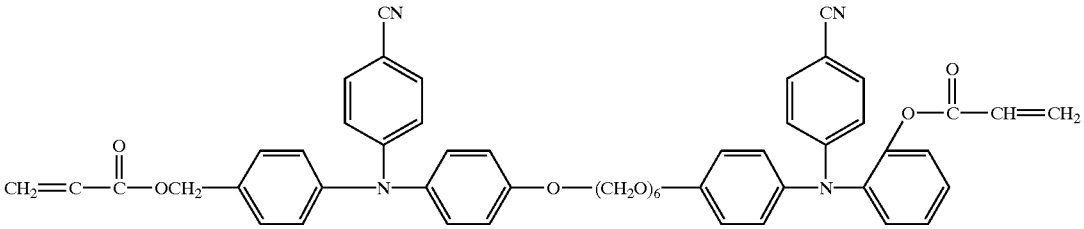

-continued
159
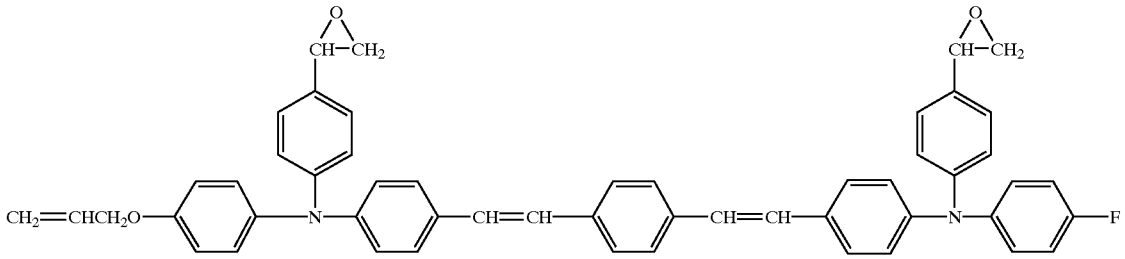
160
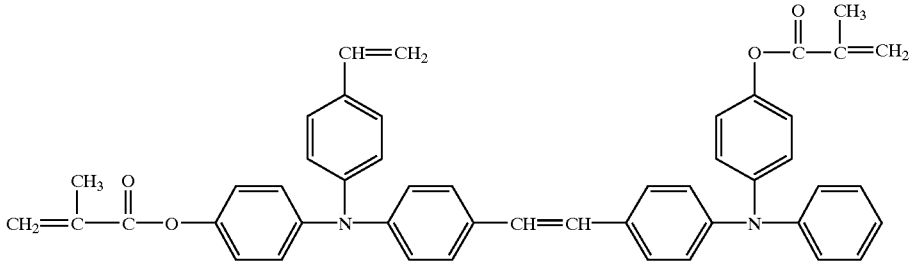
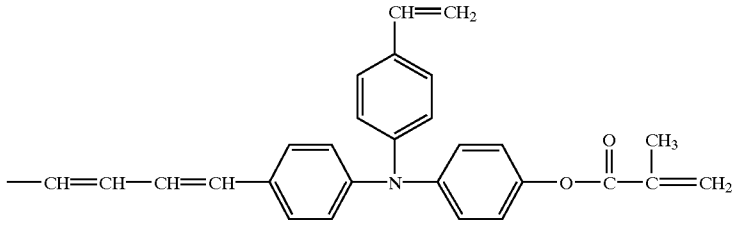
161
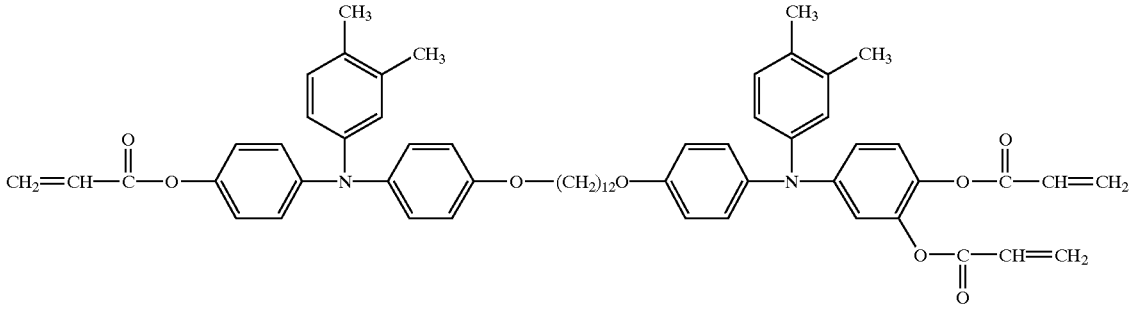
162
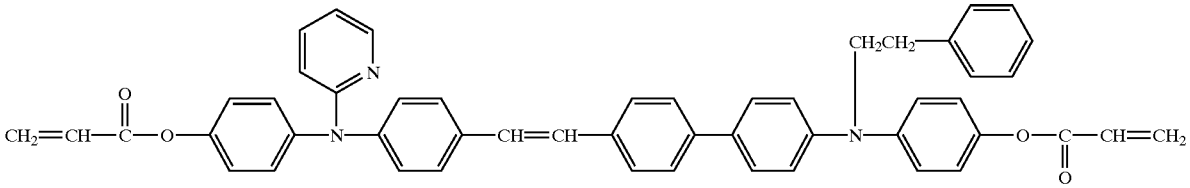
163
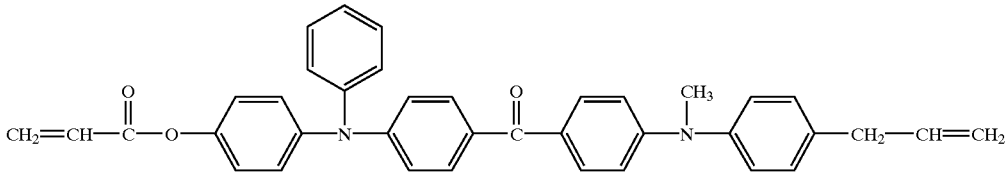

-continued
164
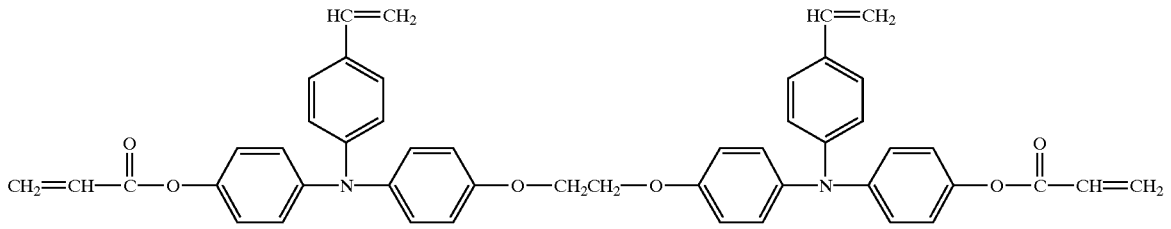
165
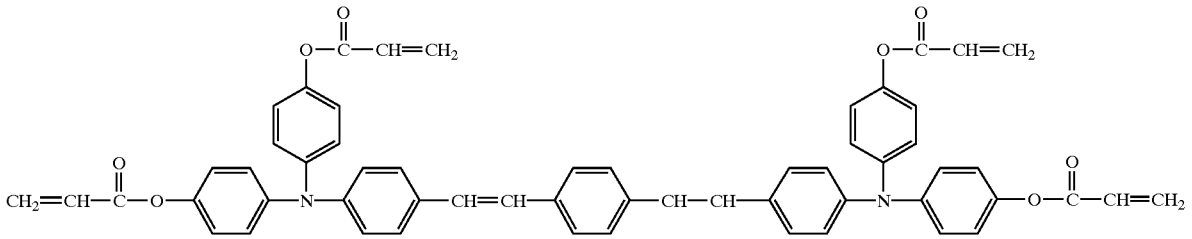
166
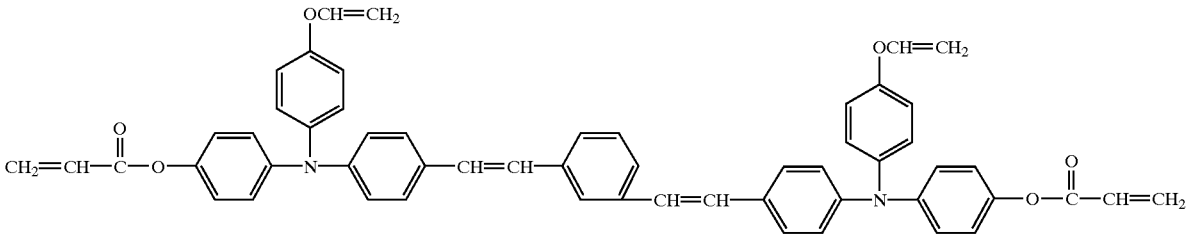
167
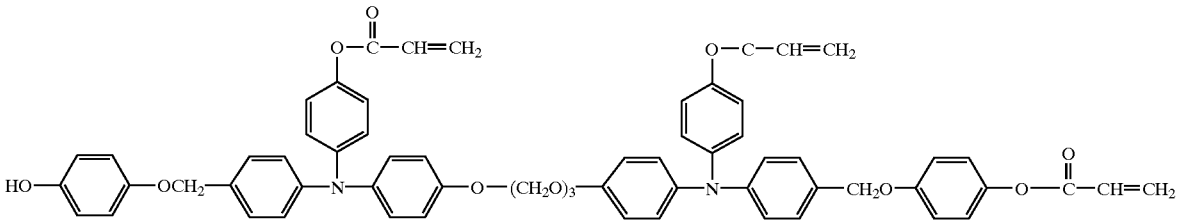
168
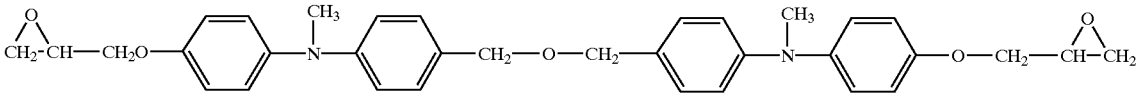
169
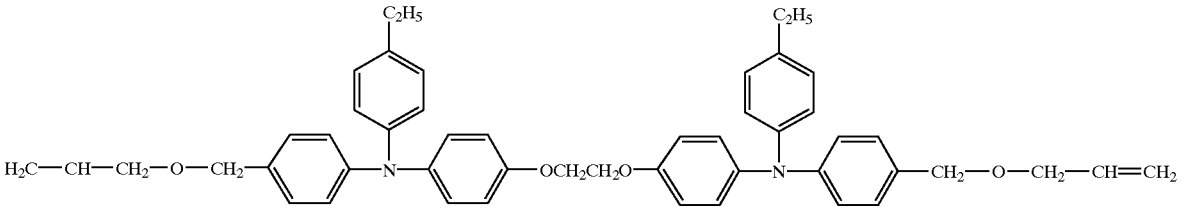

-continued
170
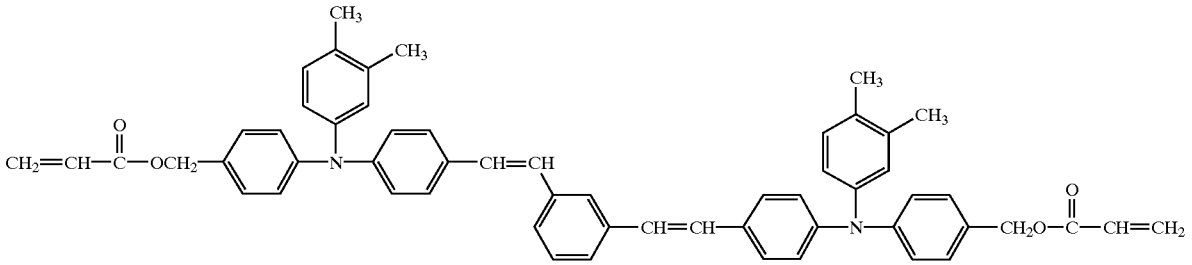
171
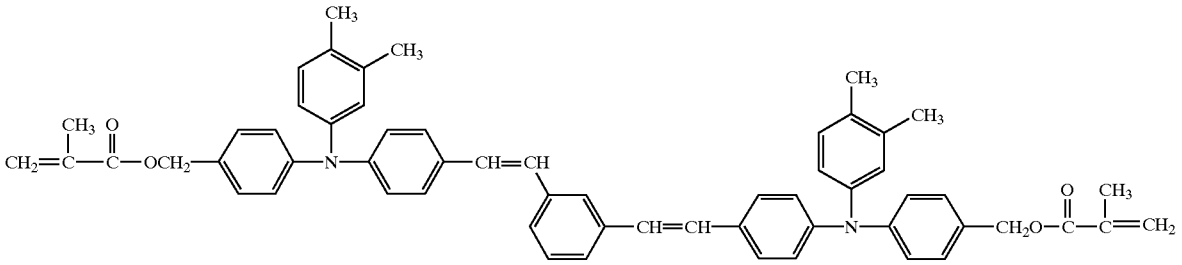
172
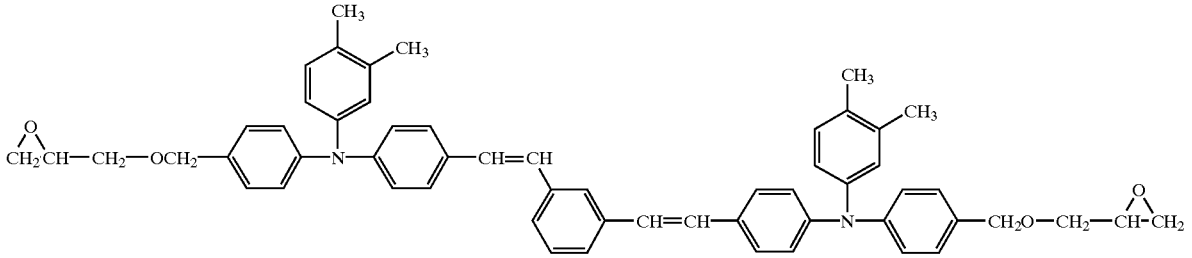
173
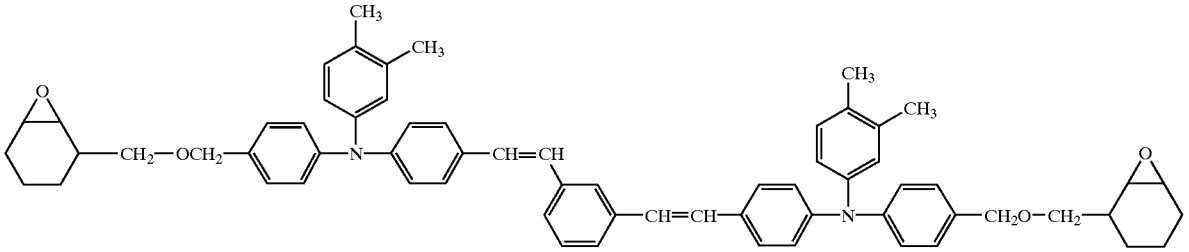
174
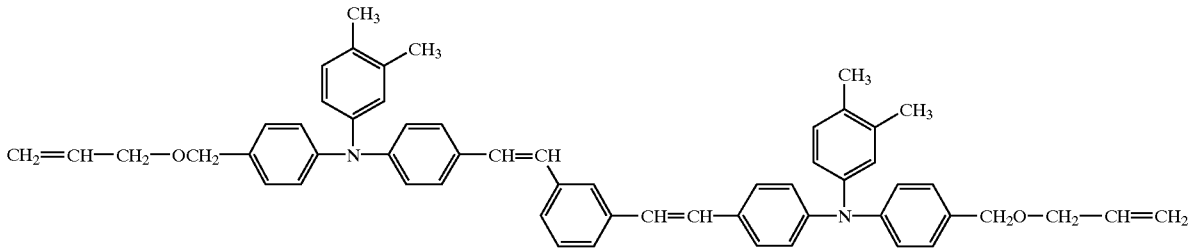

-continued
175
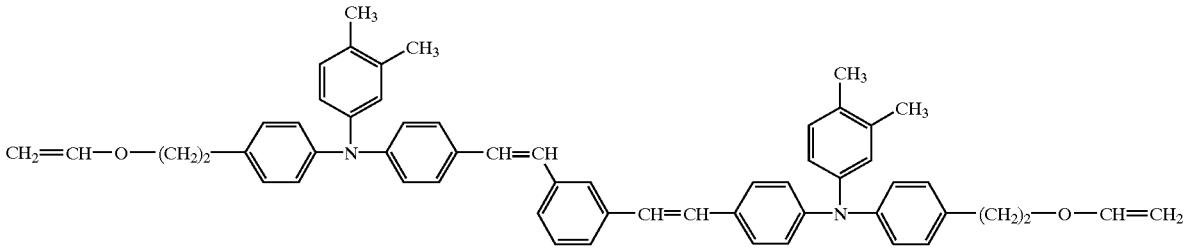
176
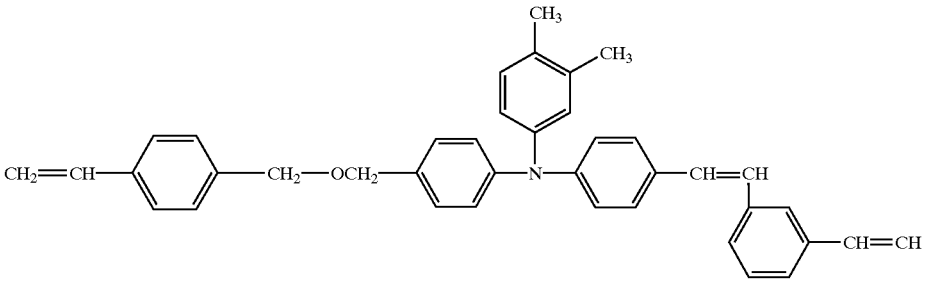
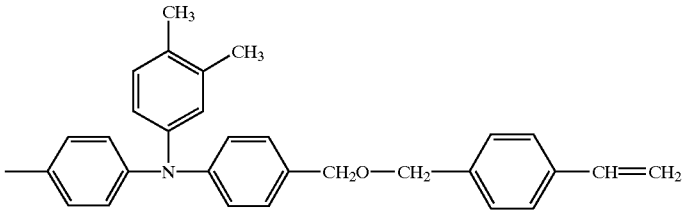
177
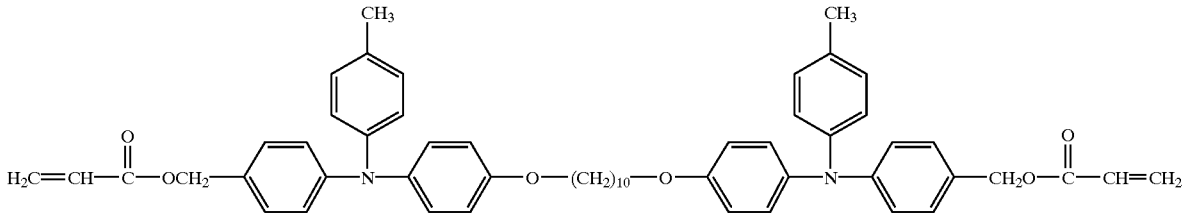
178
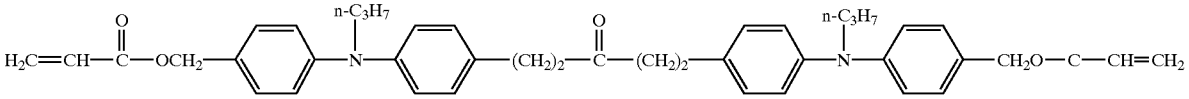
179
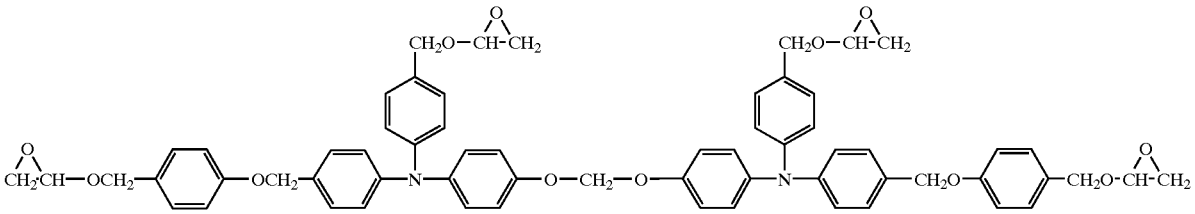
180
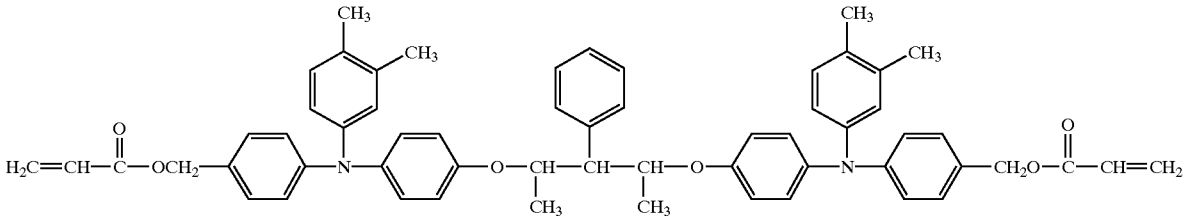

-continued
181
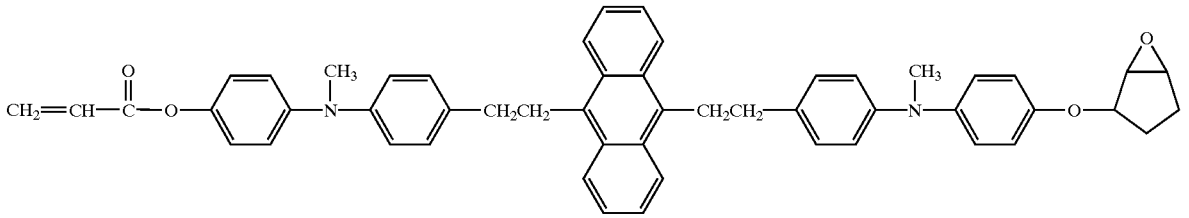
182
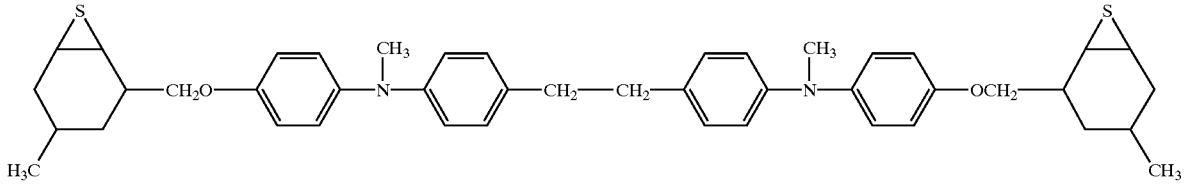
183
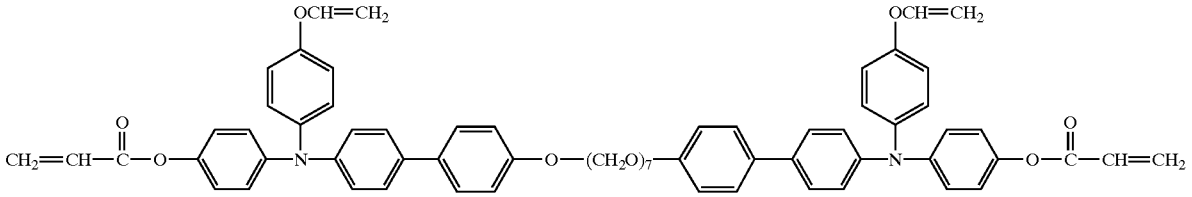
184
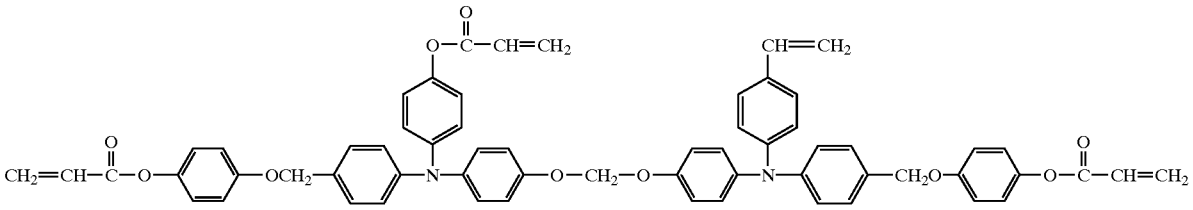
185
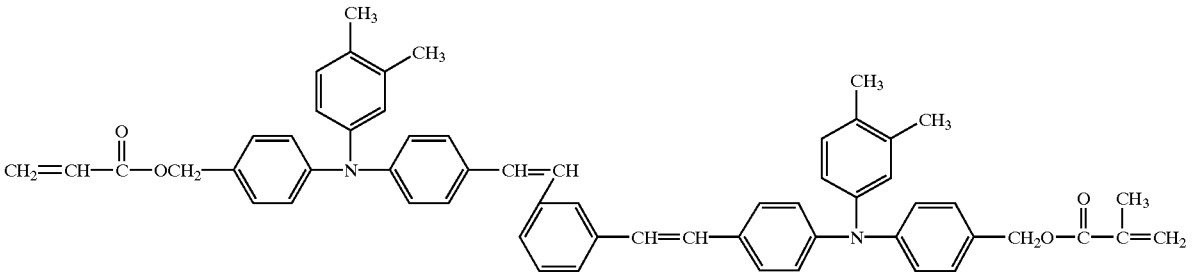
186
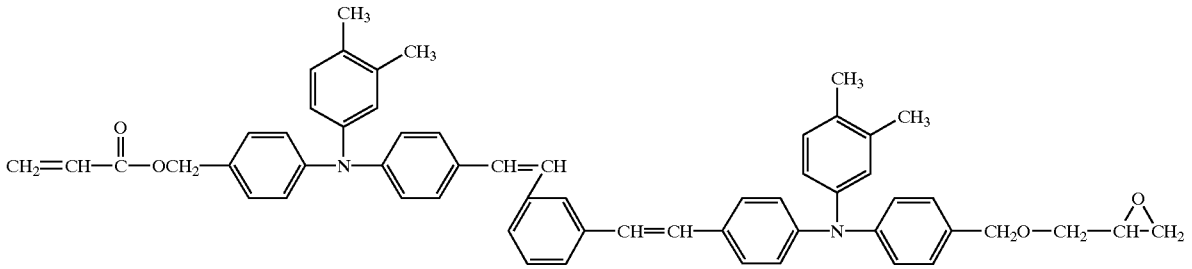

-continued
187
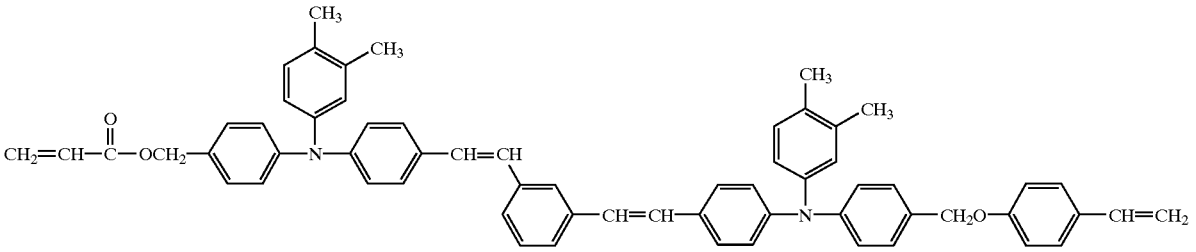
188
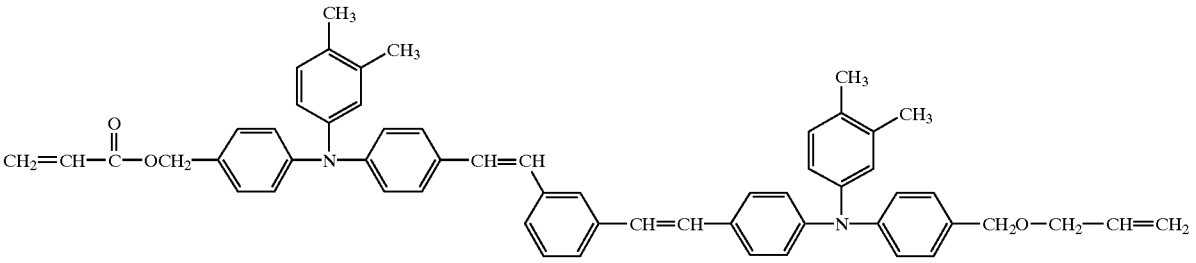
189
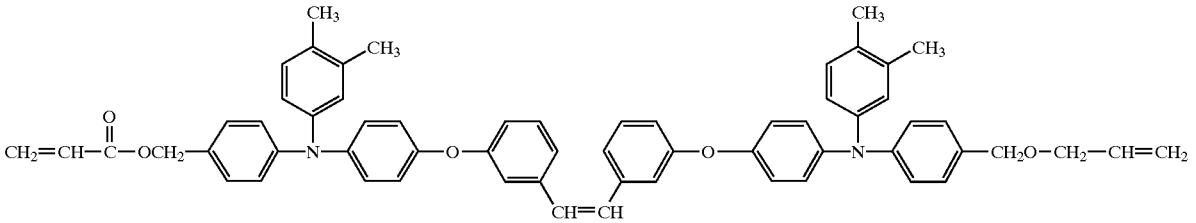
190
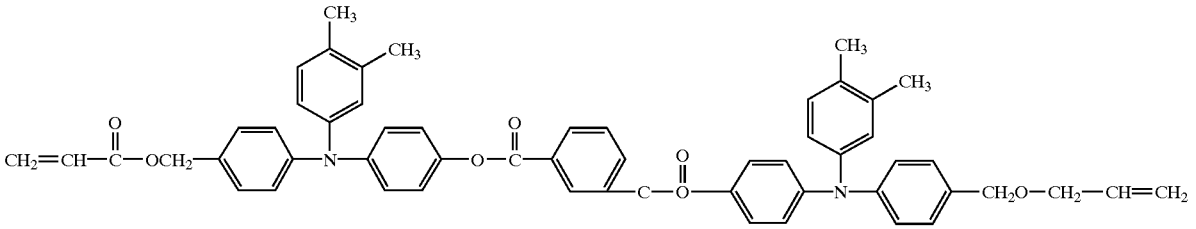
191
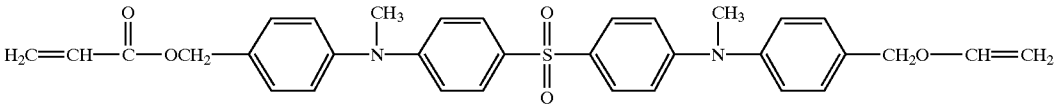
192
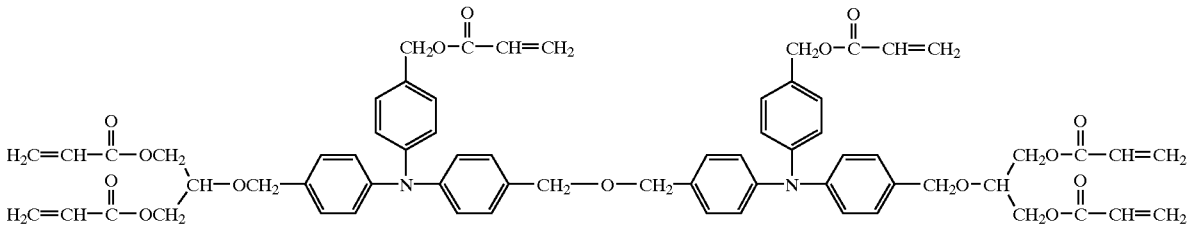
193
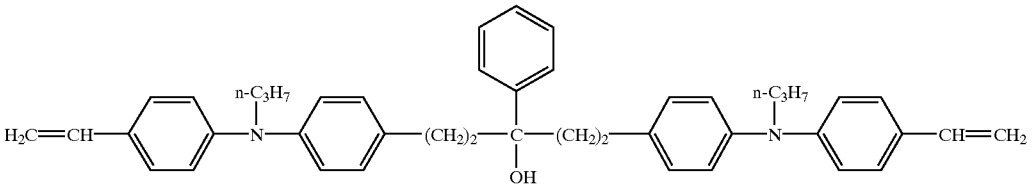

-continued
194
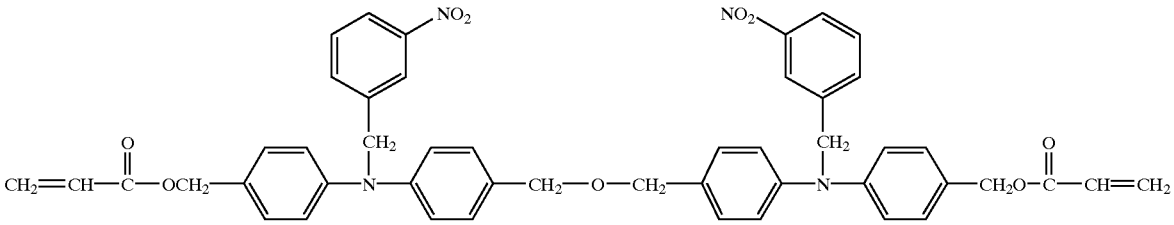
195
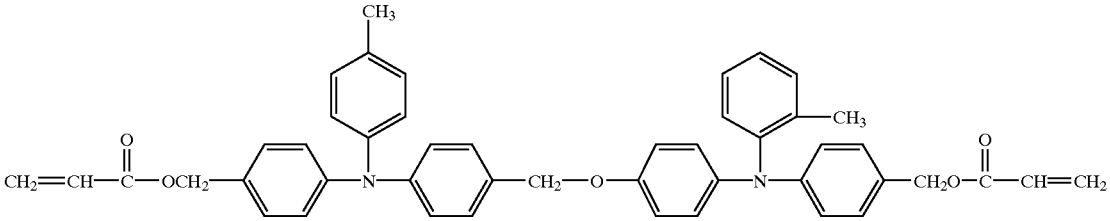
196
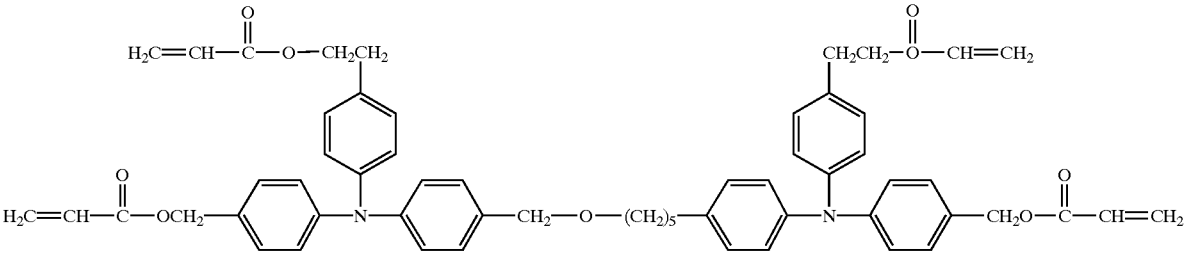
197
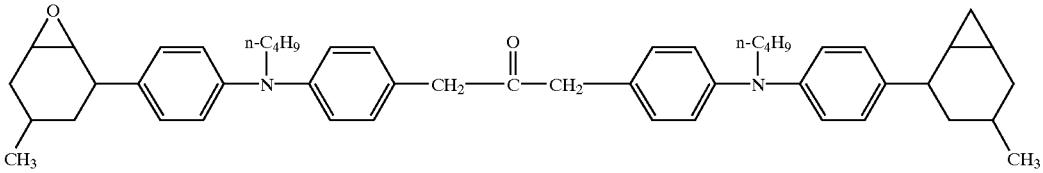
198
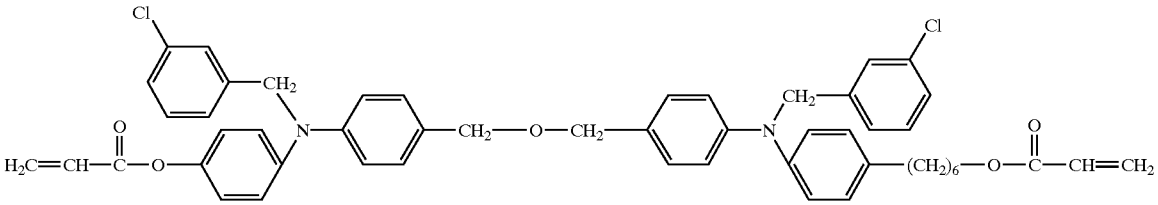
199
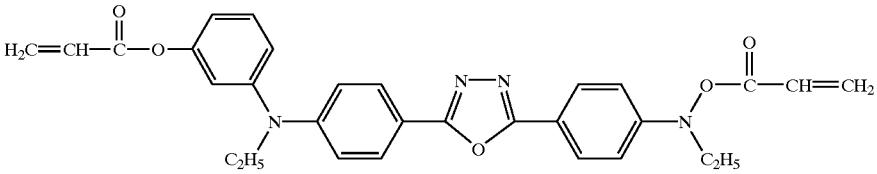
200
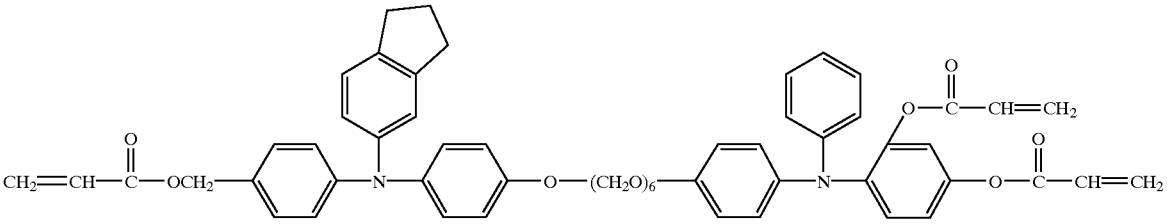

-continued
201
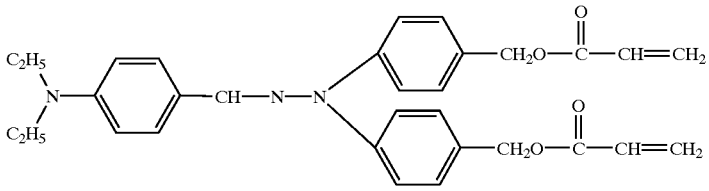
202
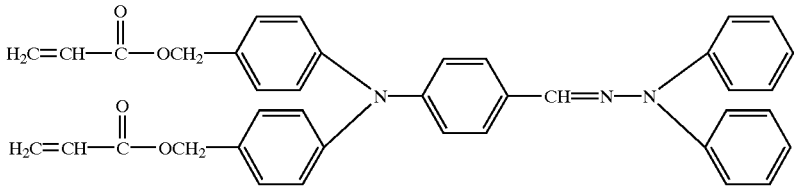
203
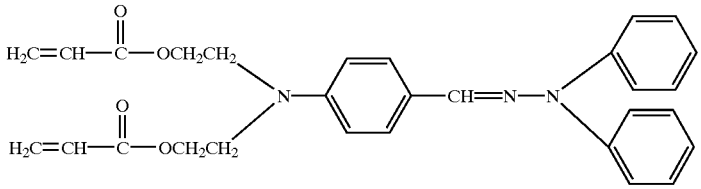
204
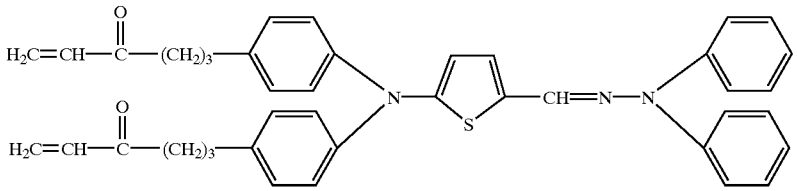
205
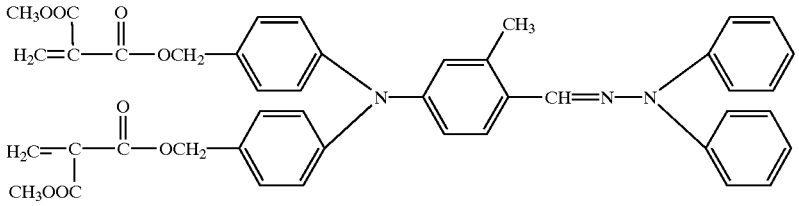
206
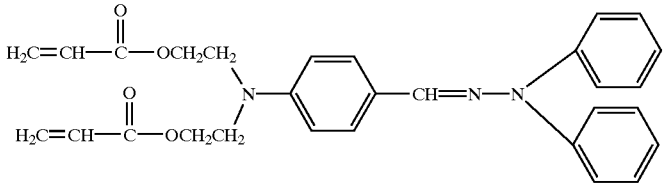
207
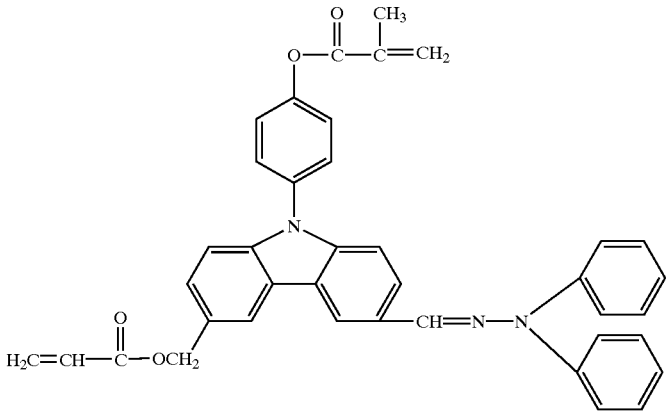

-continued
208
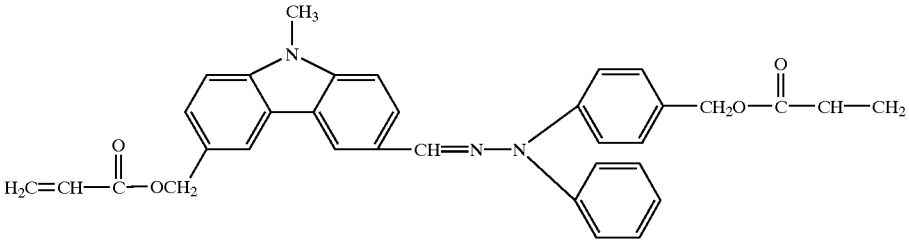
209
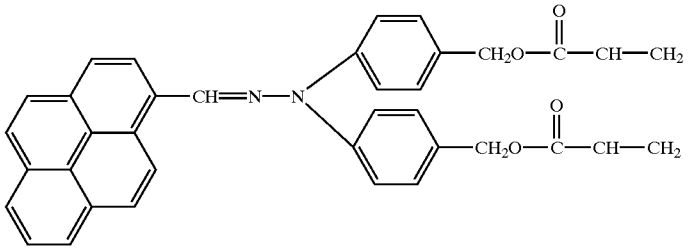
210
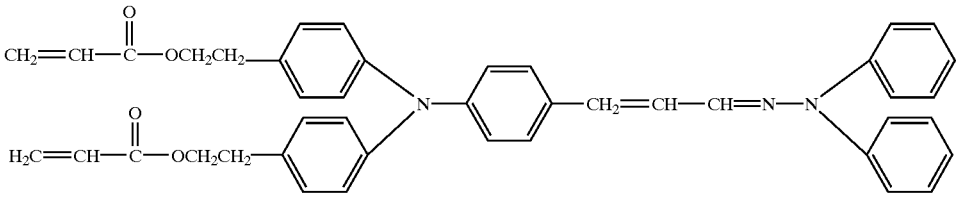
211
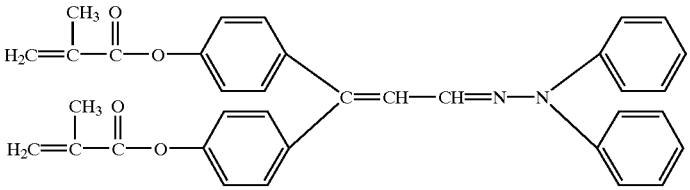
212
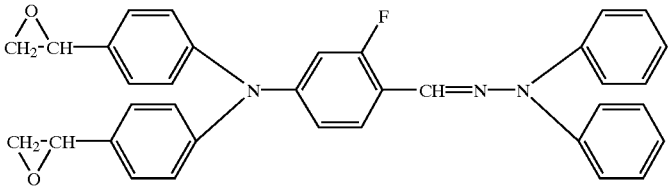
213
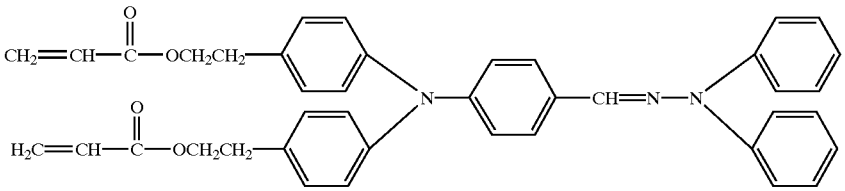
214
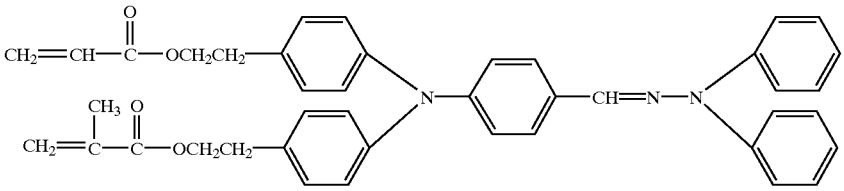

-continued
215
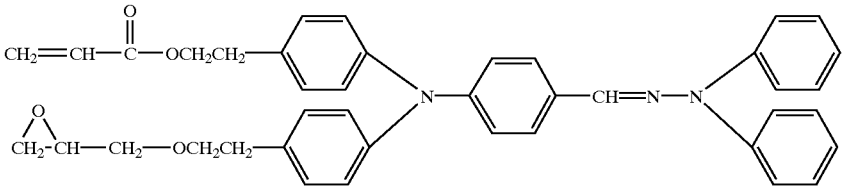
216
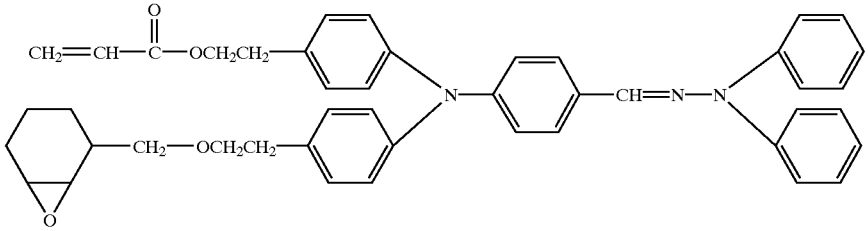
217
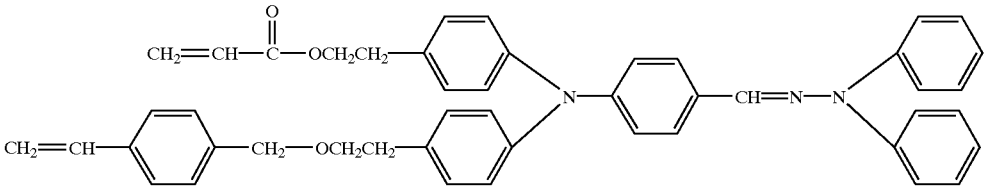
218
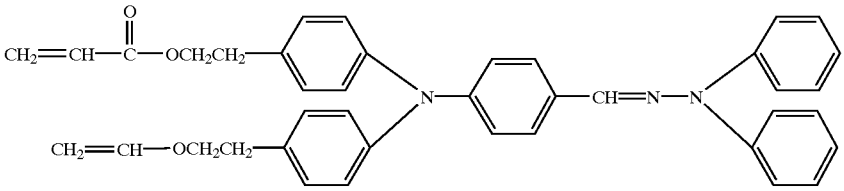
219
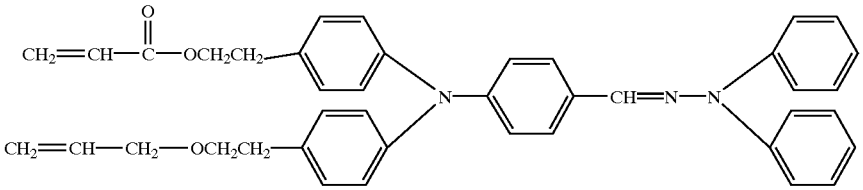
220
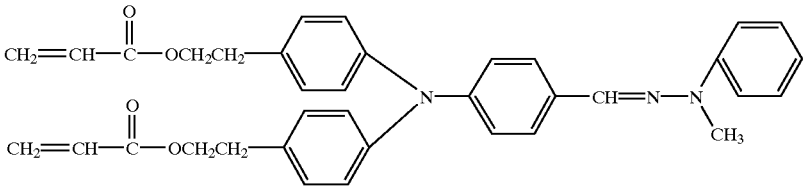
221
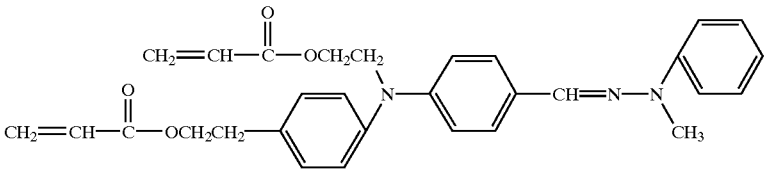
222
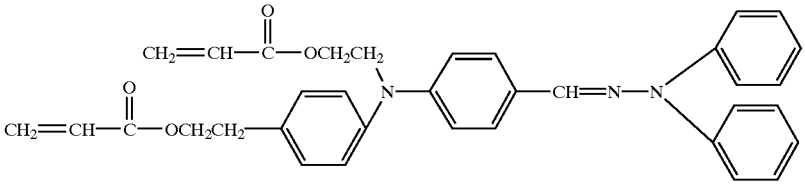

-continued
223
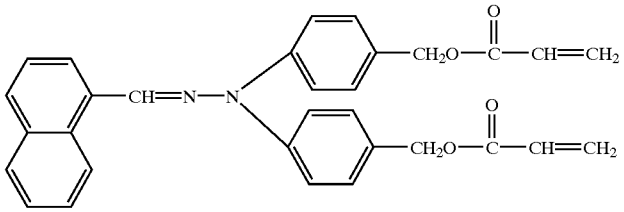
224
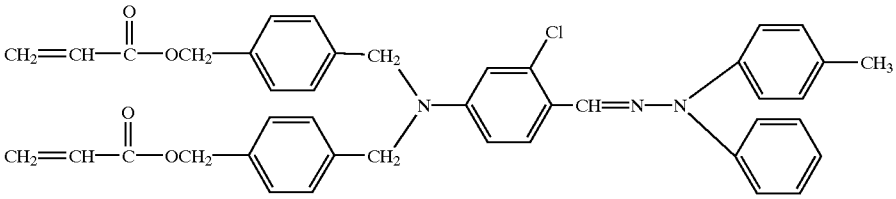
225
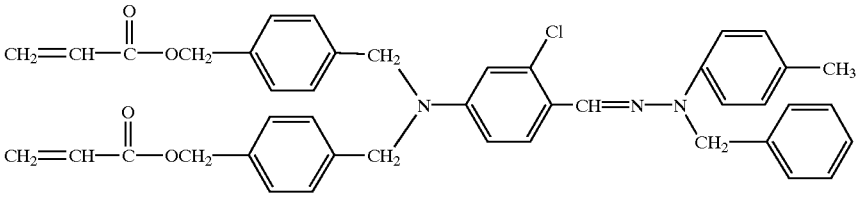
226
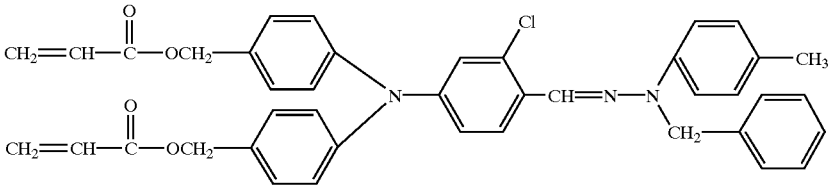
227
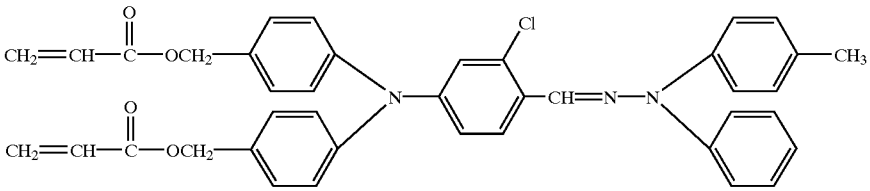
228
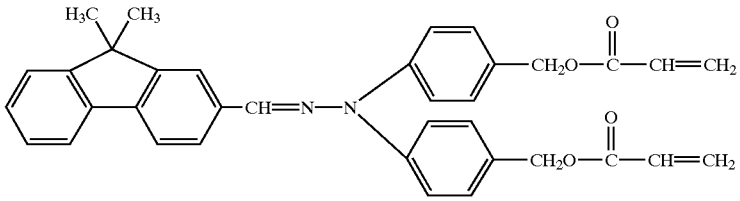
229
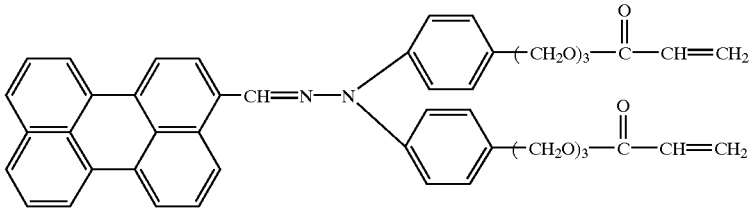

-continued
230
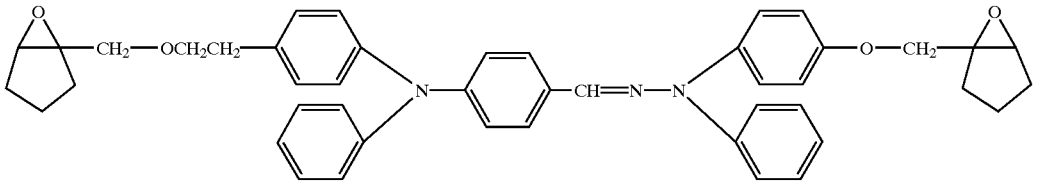
231
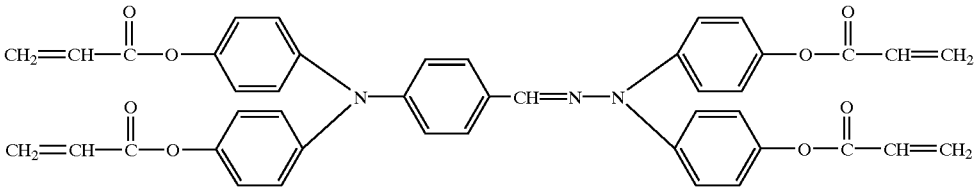
232
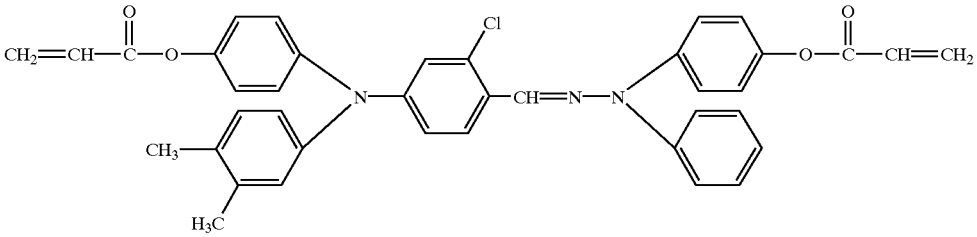
233
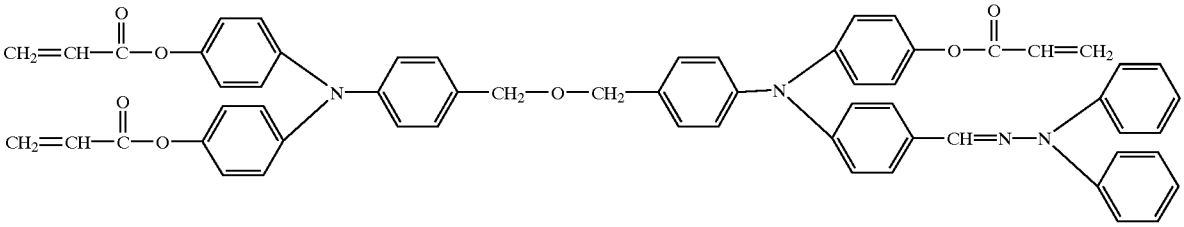
234
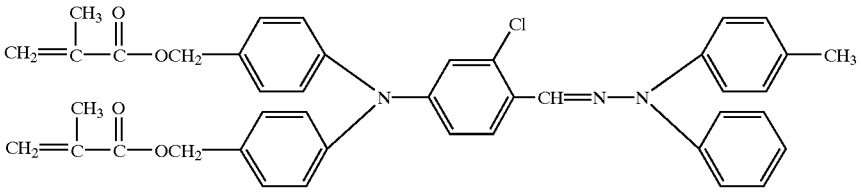
235
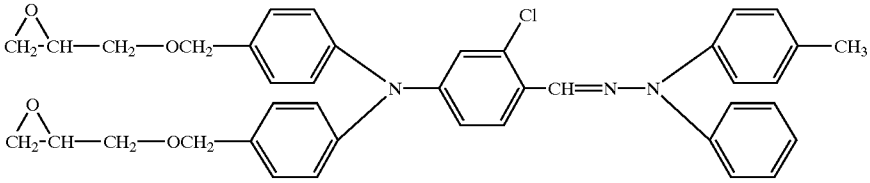
236
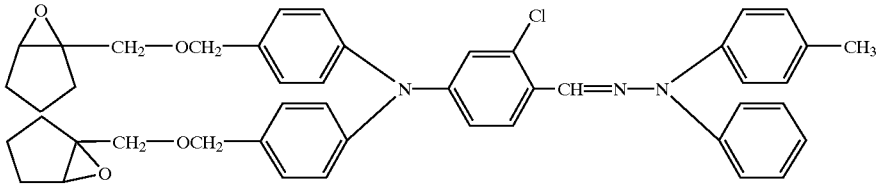

-continued
237
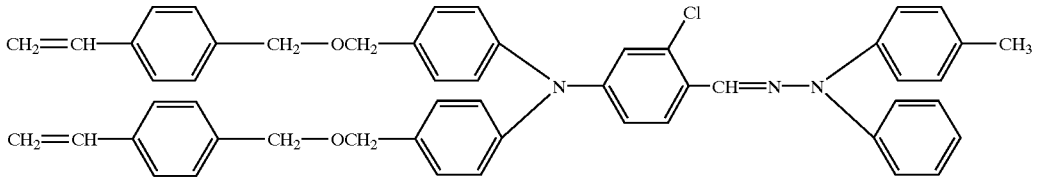
238
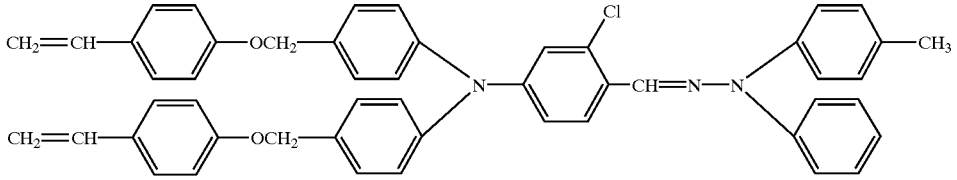
239
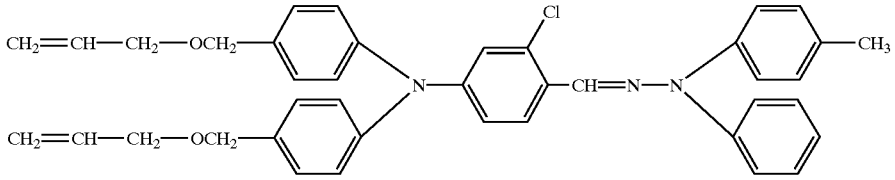
240
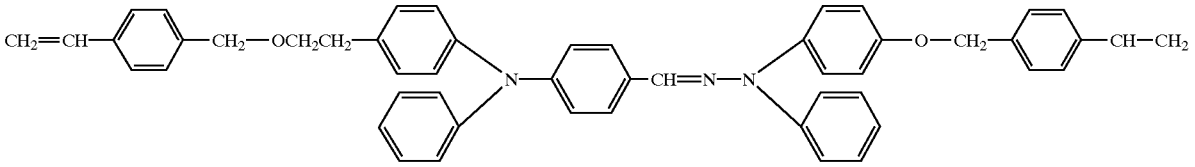
241
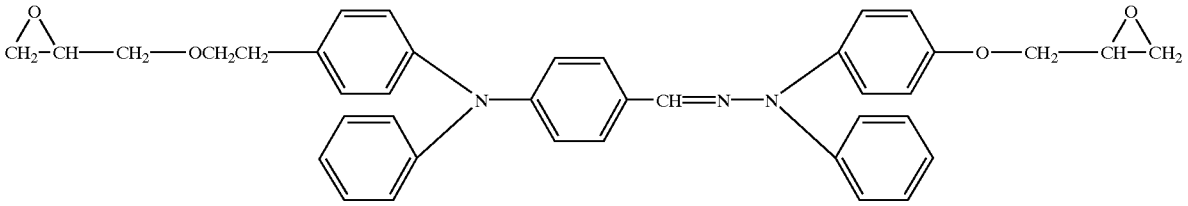
242
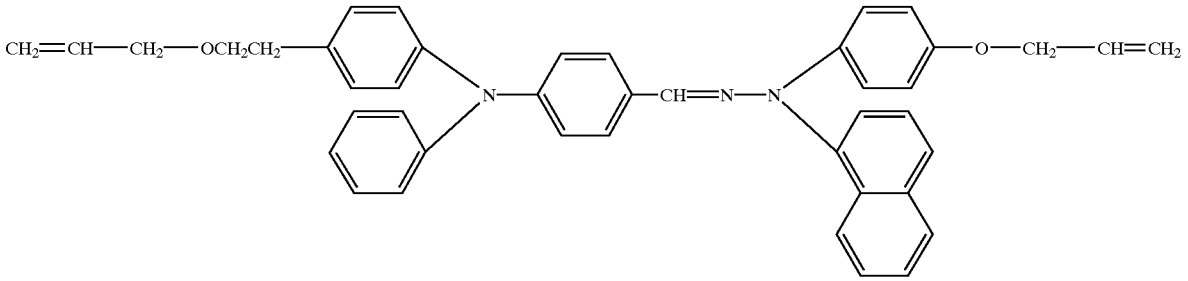
243
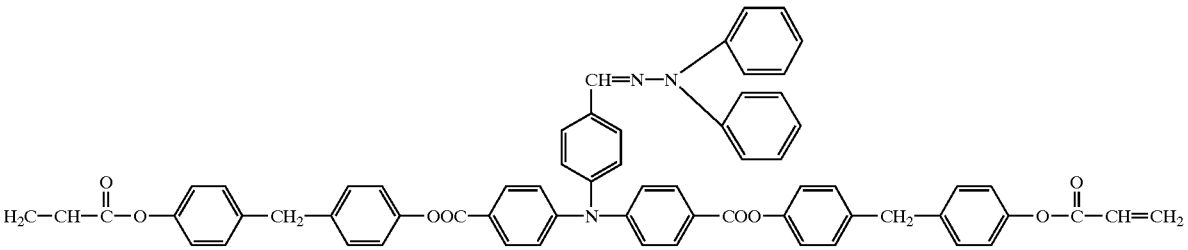

-continued
244
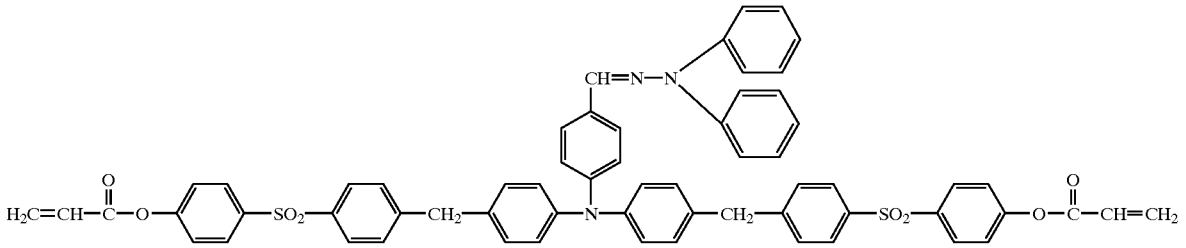
245
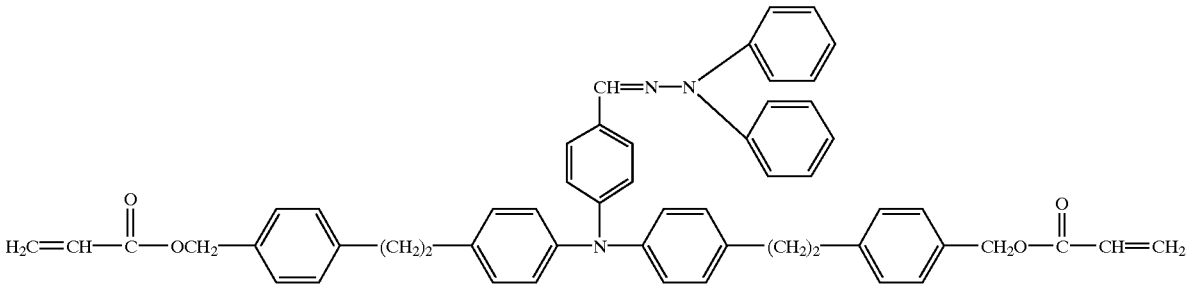
246
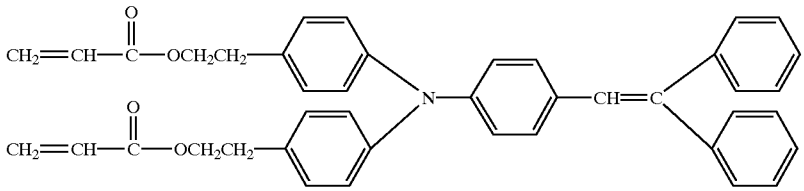
247
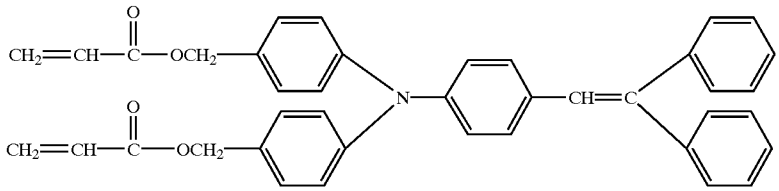
248
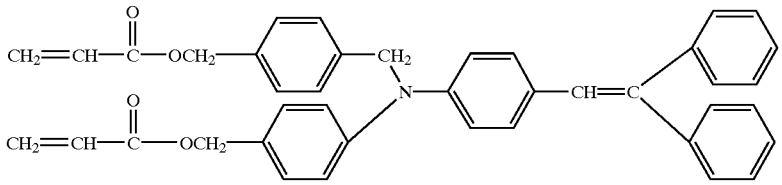
249
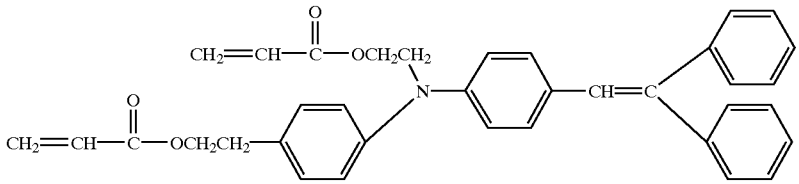
250
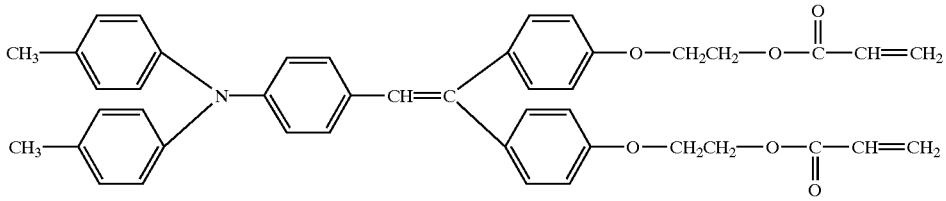

-continued
251
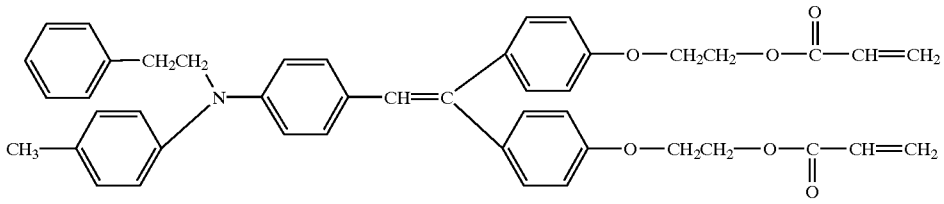
252
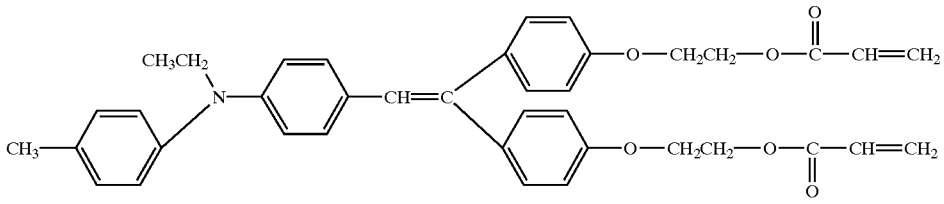
253
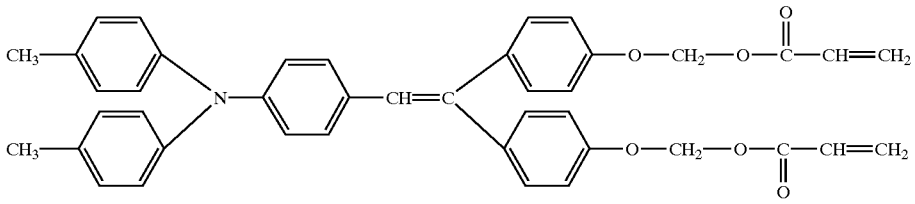
254
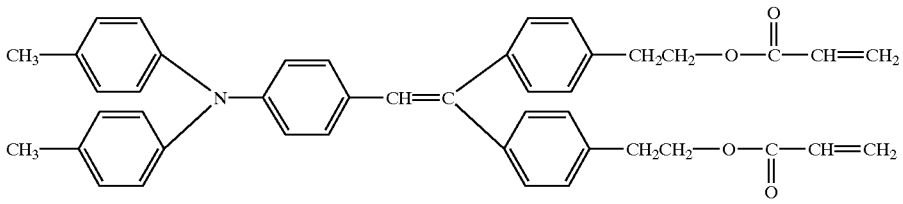
255
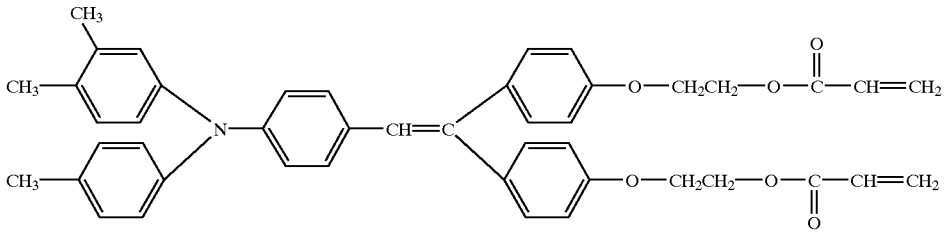
256
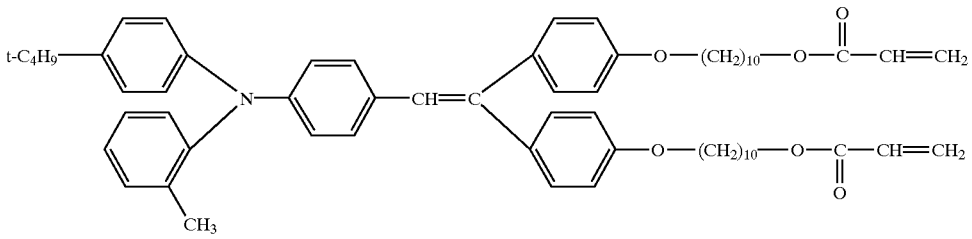

-continued
257
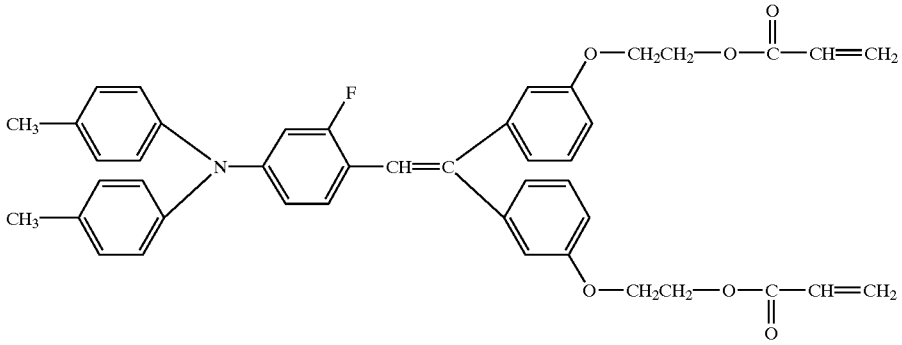
258
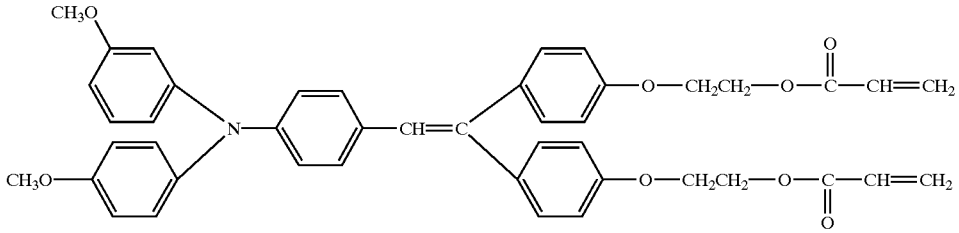
259
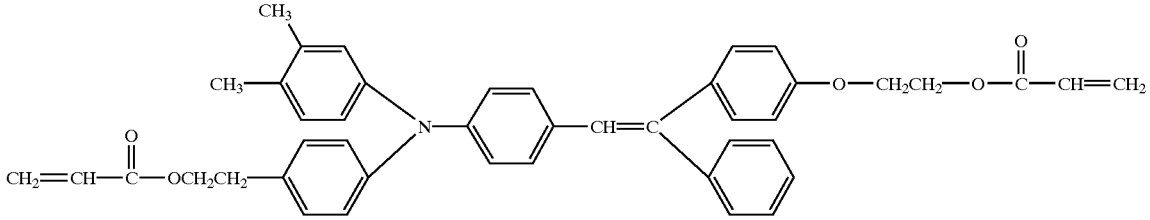
260
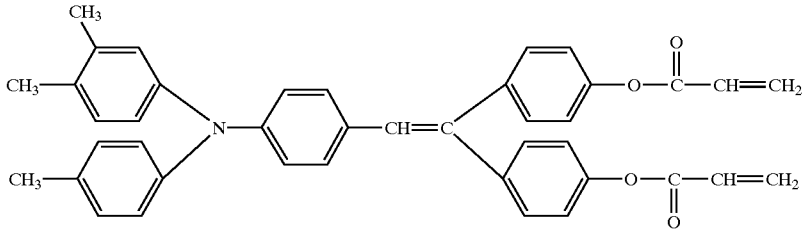
261
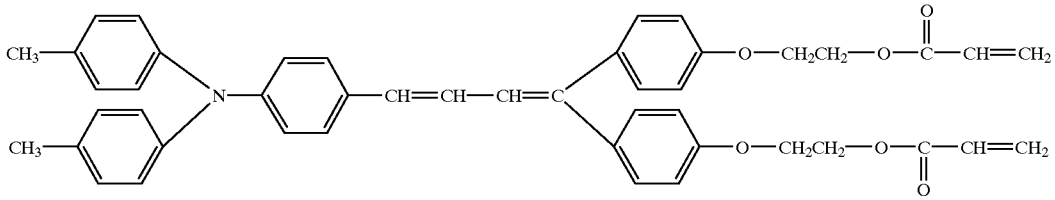
262
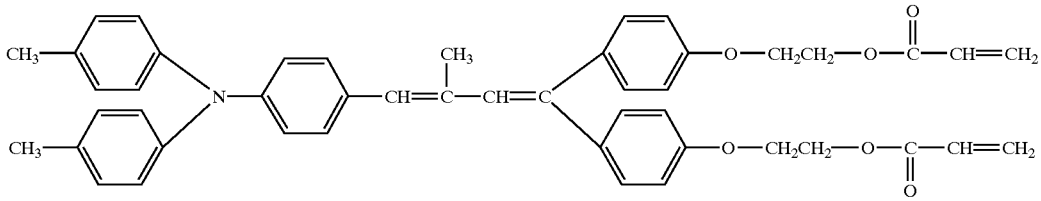

-continued
263
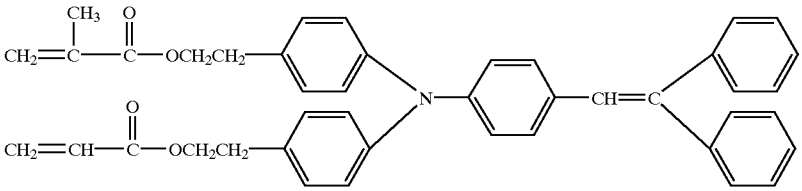
264
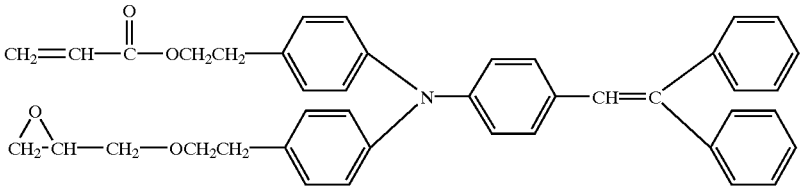
265
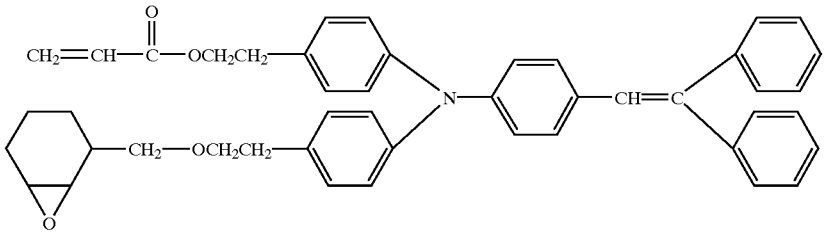
266
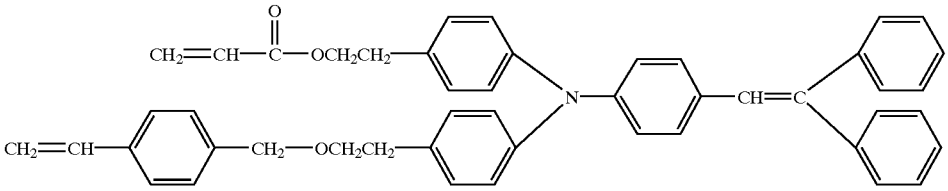
267
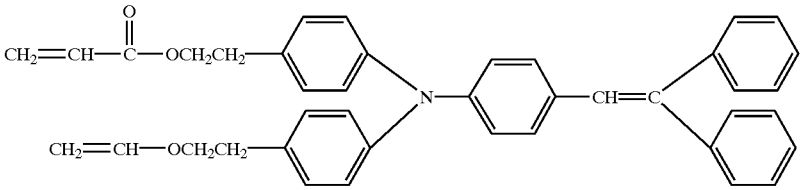
268
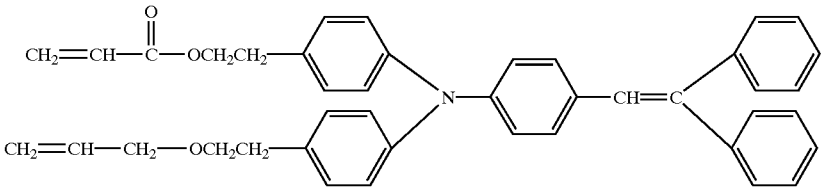
269
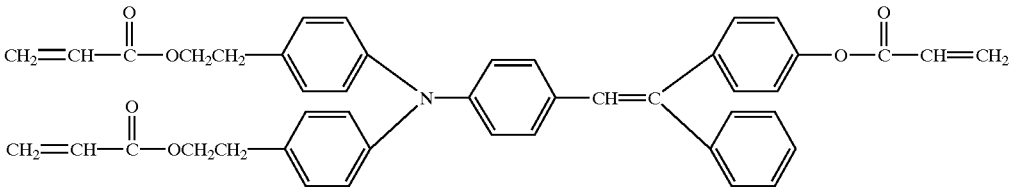

-continued
270
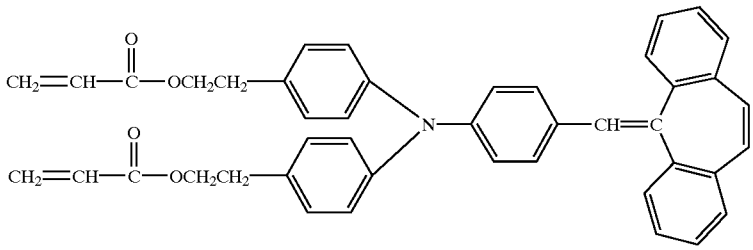
271
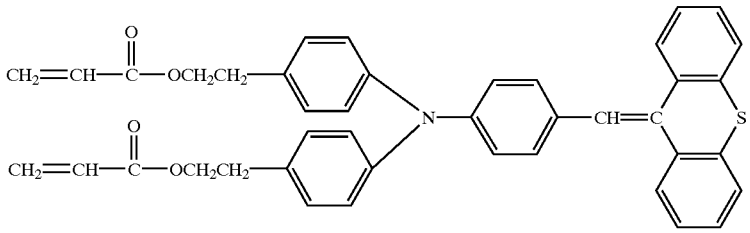
272
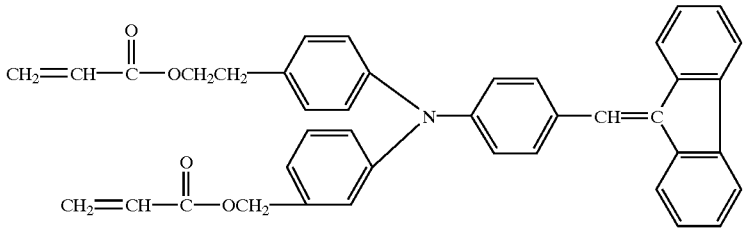
273
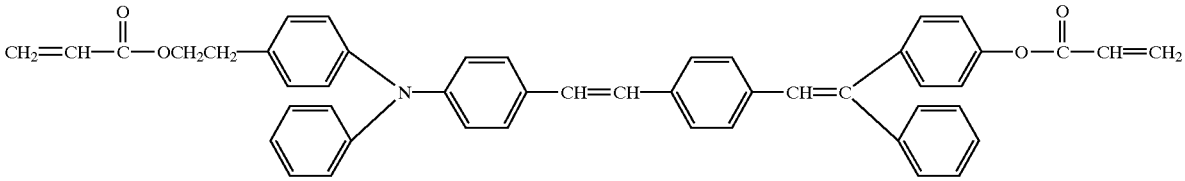
274
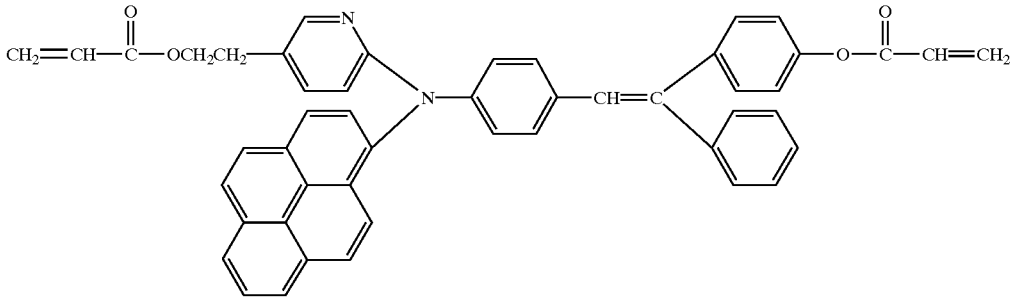
275
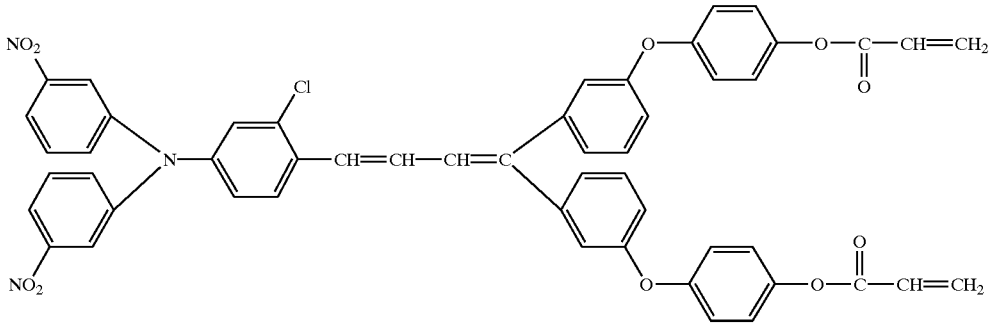

-continued
276
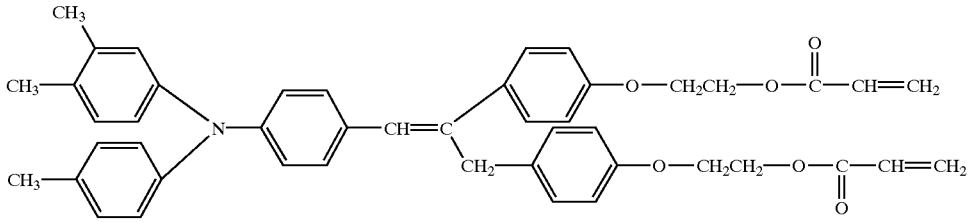
277
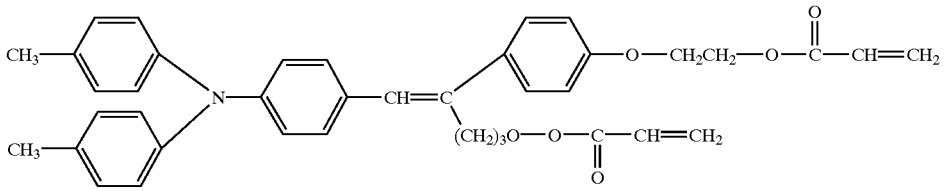
278
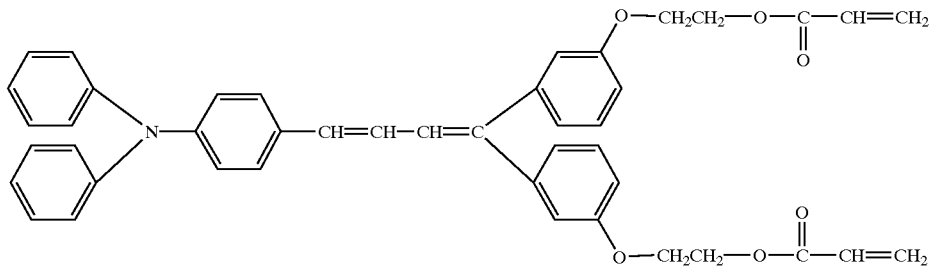
279
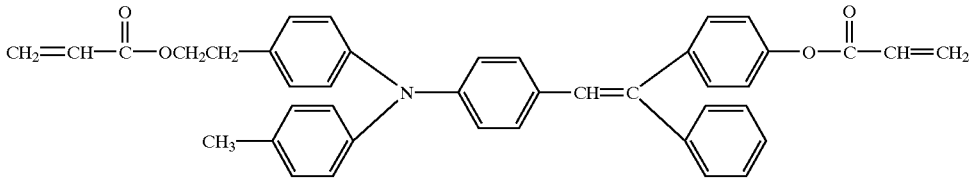
280
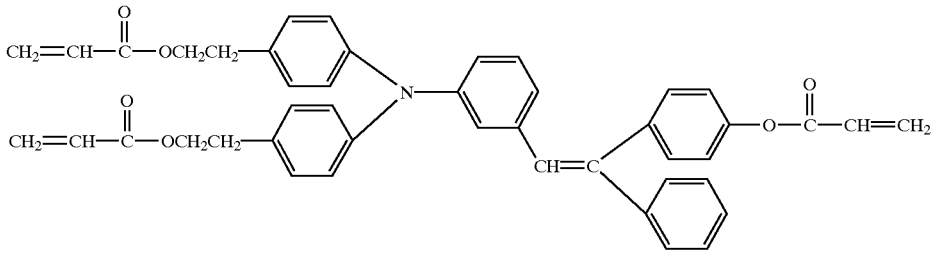
281
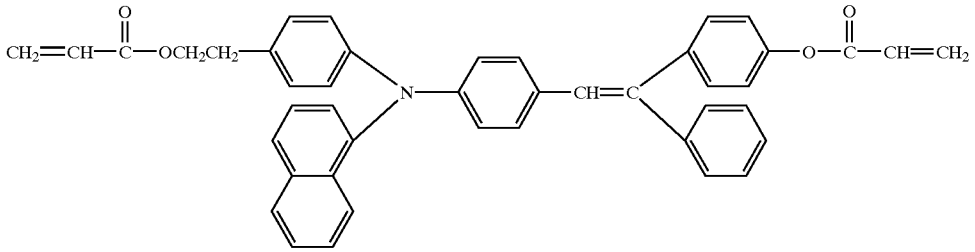

-continued
282
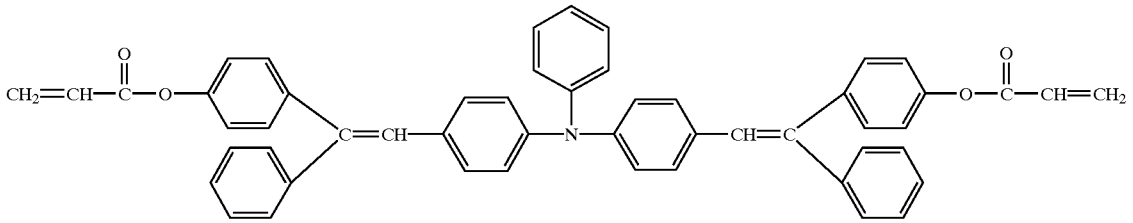
283
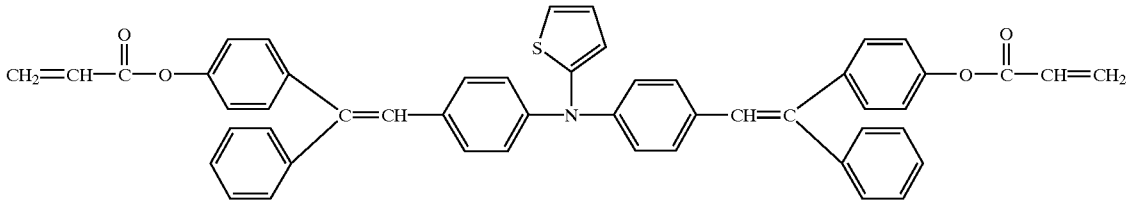
284
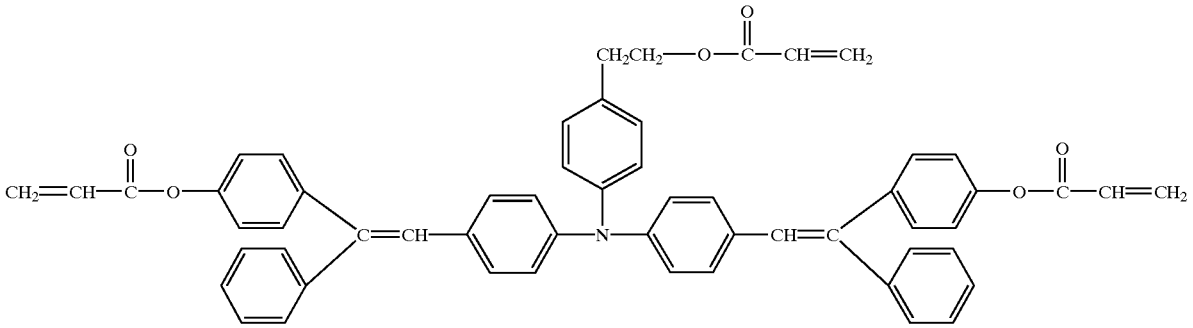
285
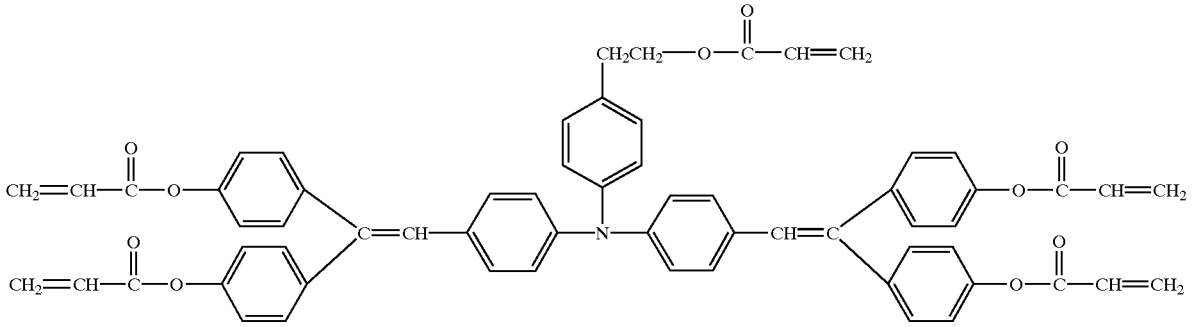
286
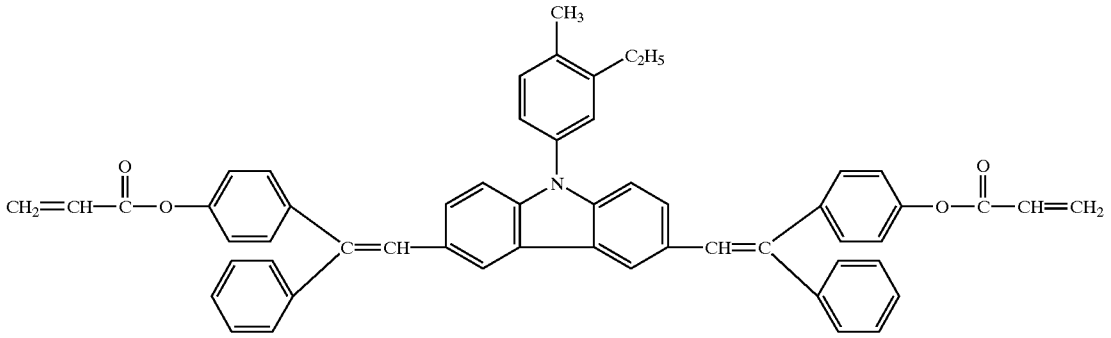

-continued
287
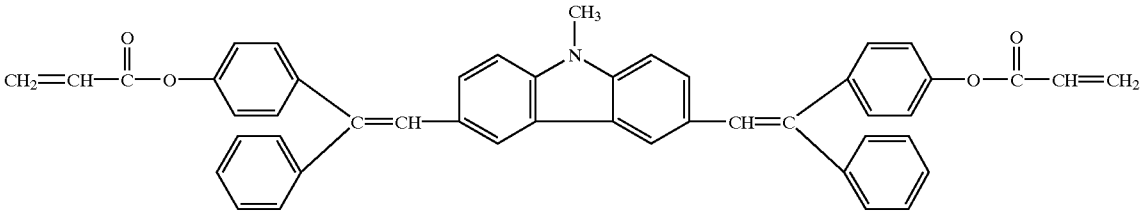
288
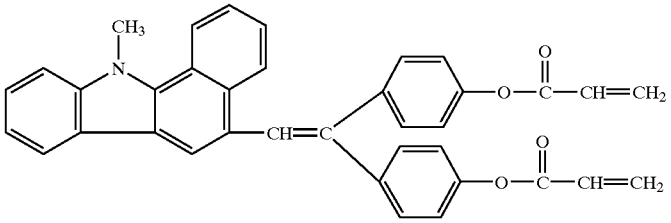
289
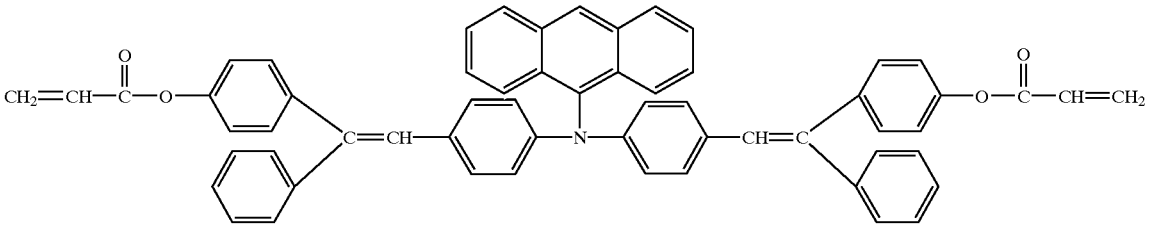
290
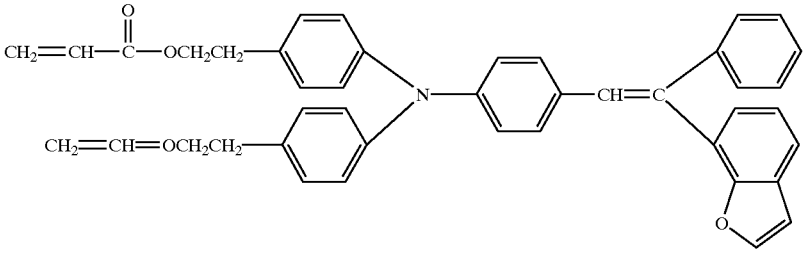
291
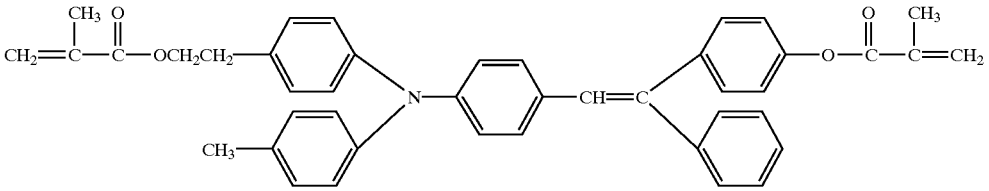
292
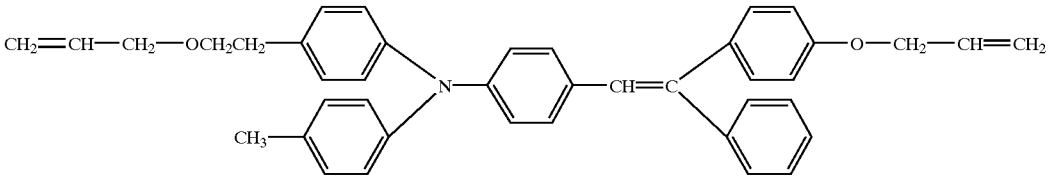
293
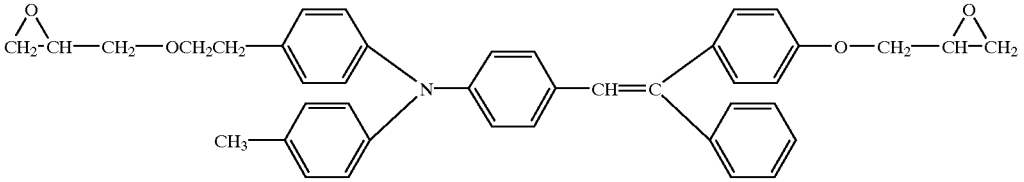

-continued
294
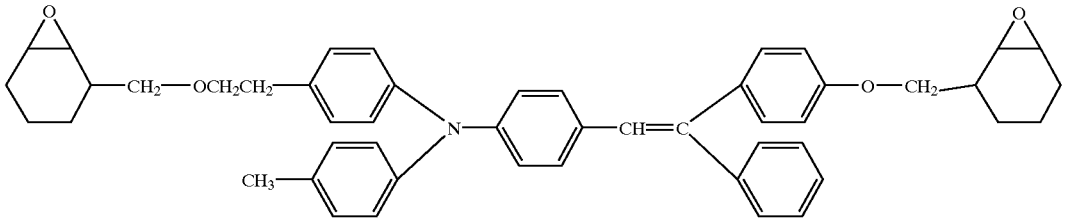
295
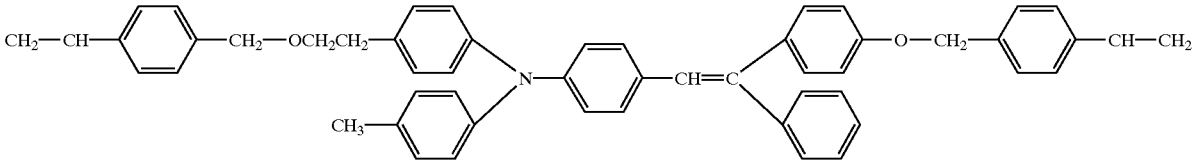
296
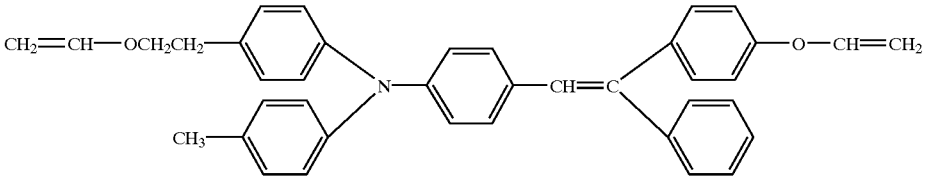
297
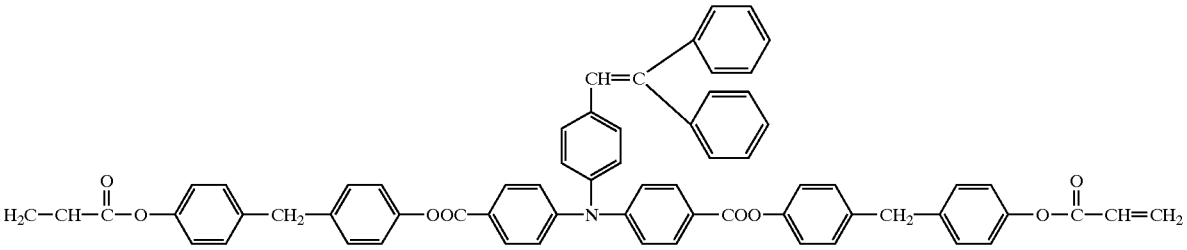
298
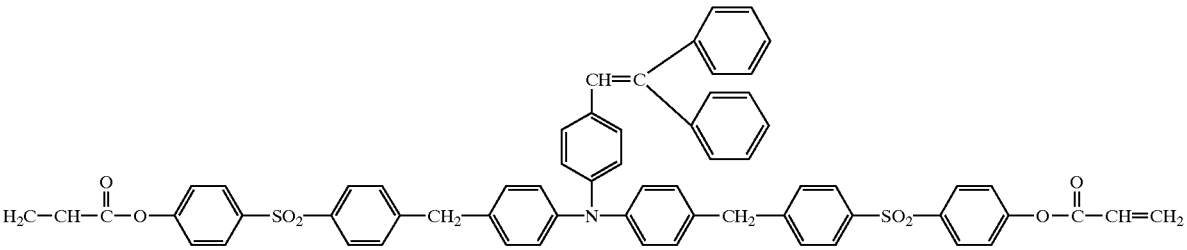
299
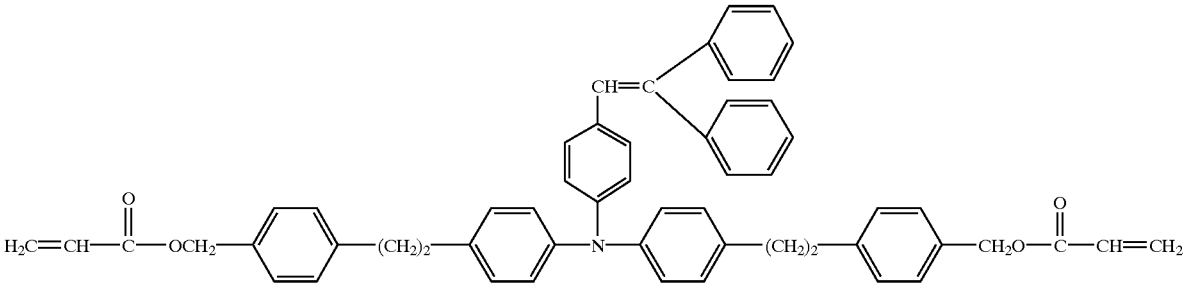

-continued
300
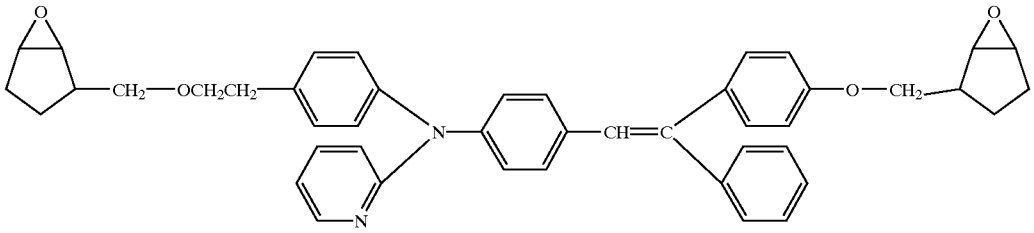
301
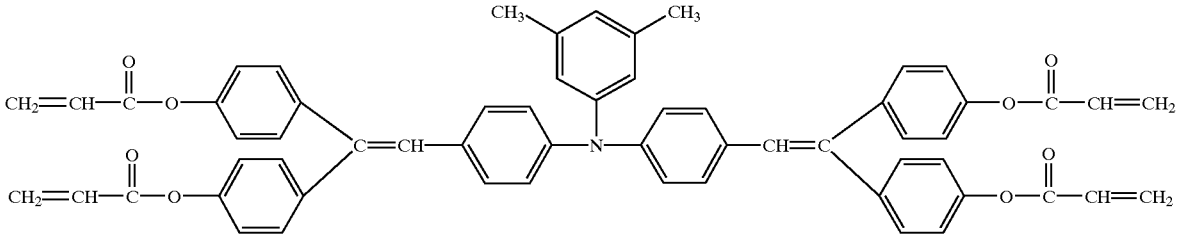
302
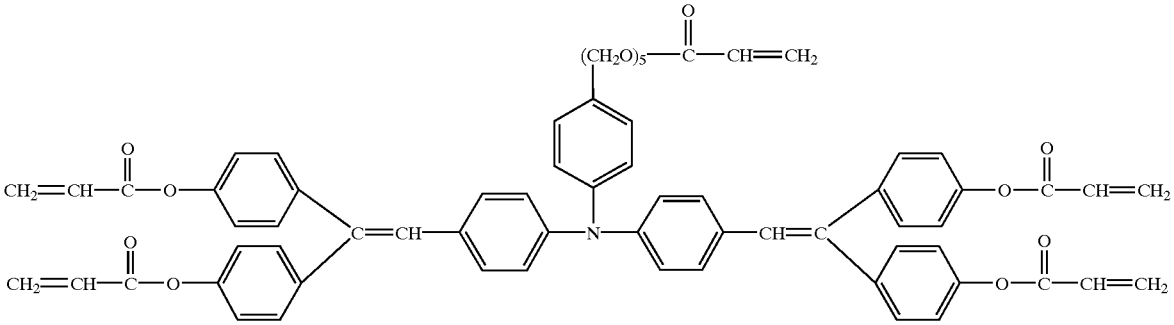
303
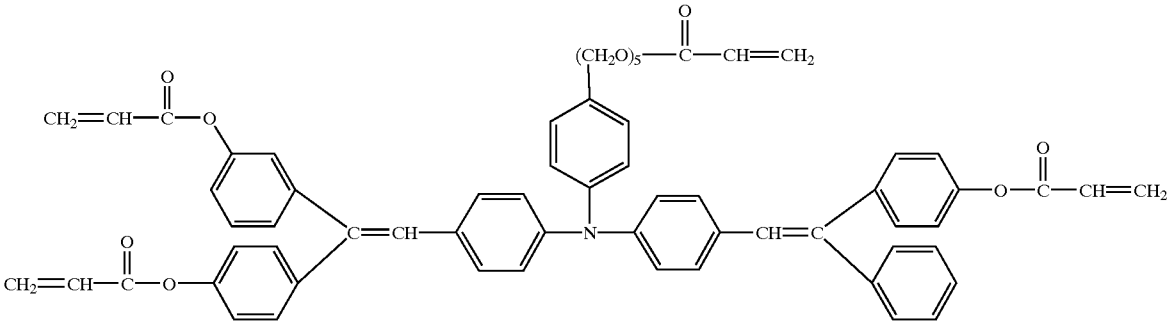
304
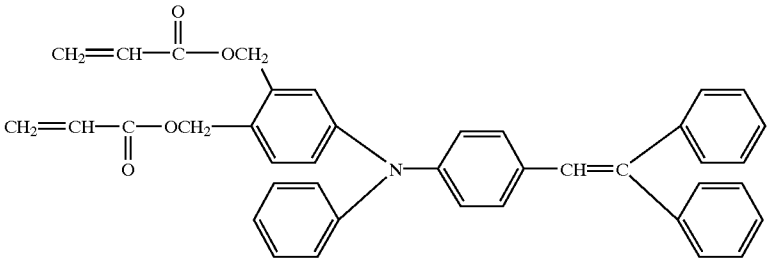

-continued
305
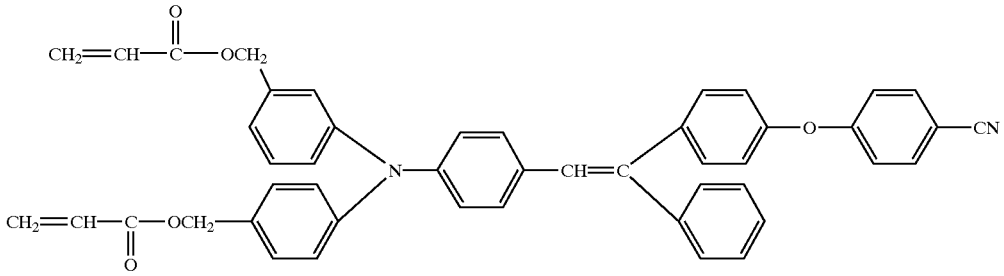
306
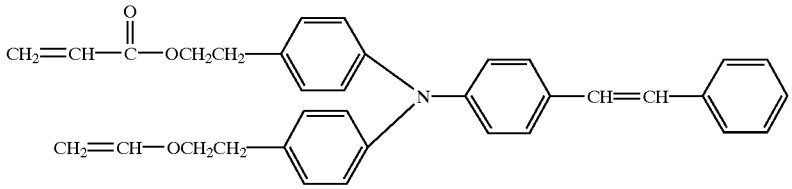
307
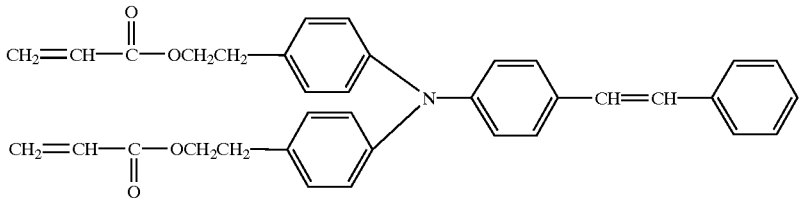
308
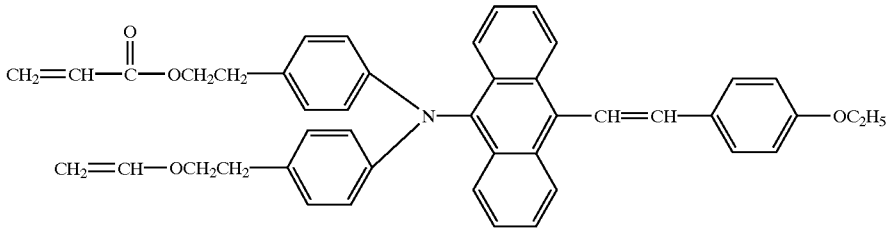
309
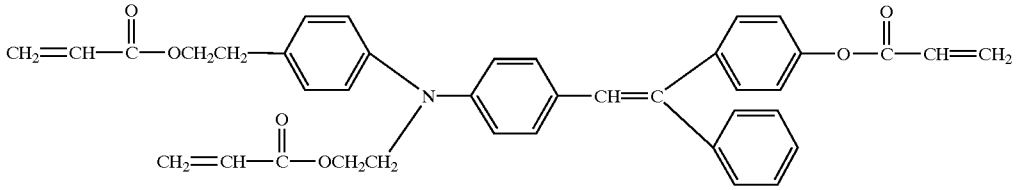
310
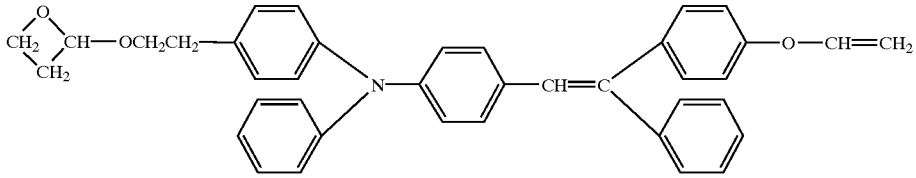

-continued
311
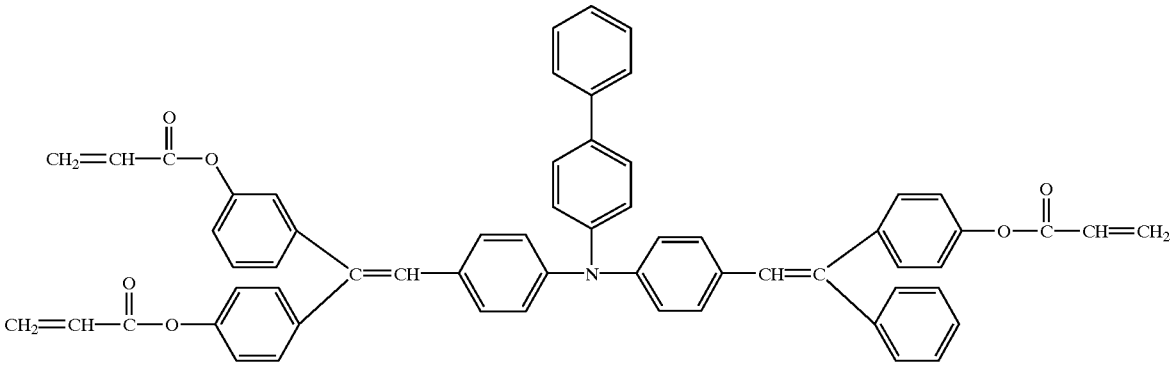
312
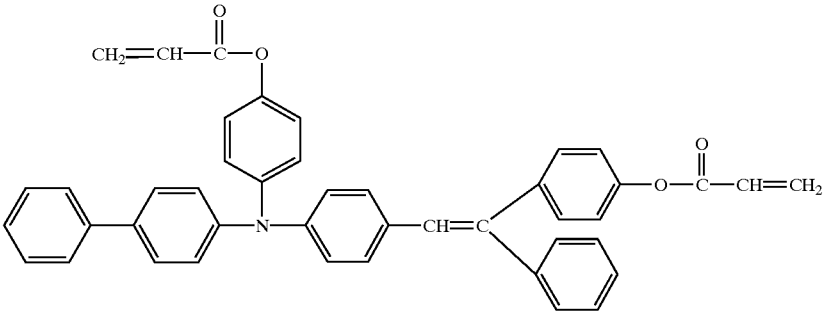
313
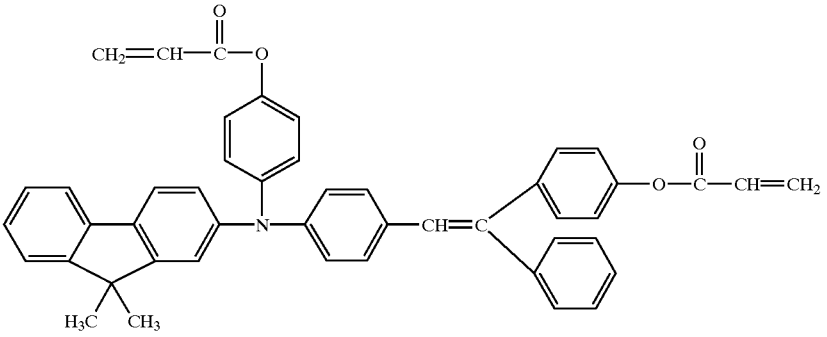
314
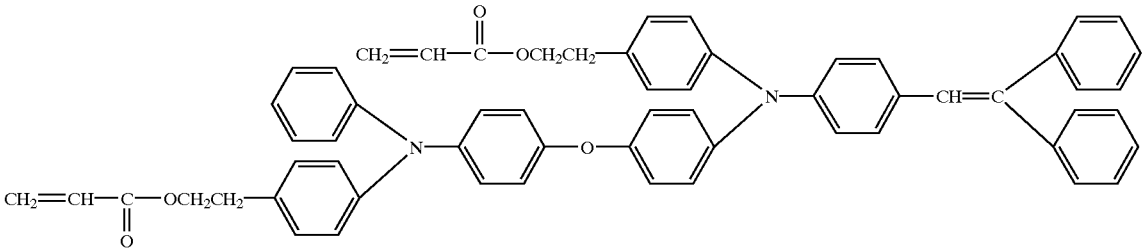
315
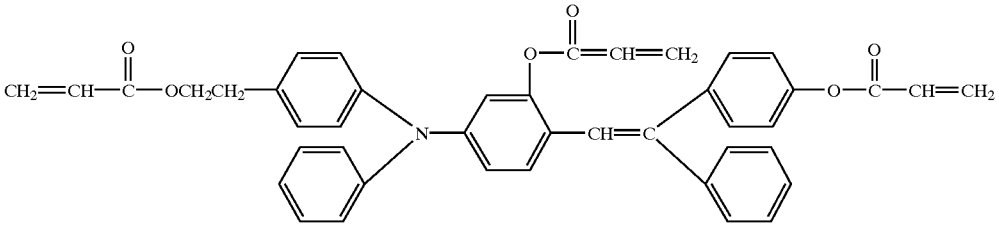

-continued
316
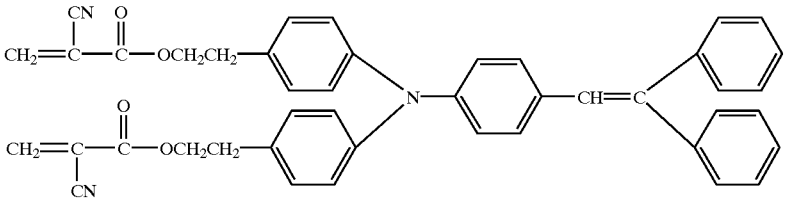
317
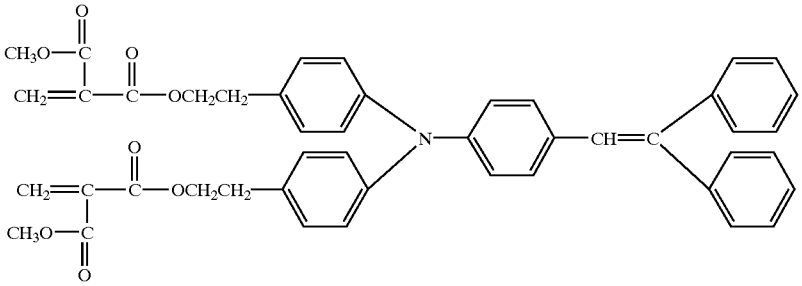
318
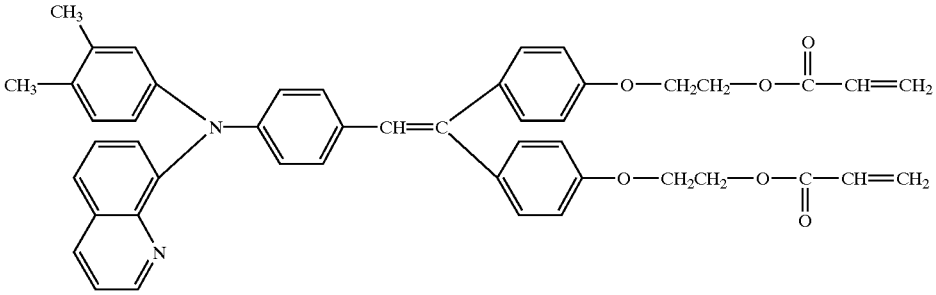
319
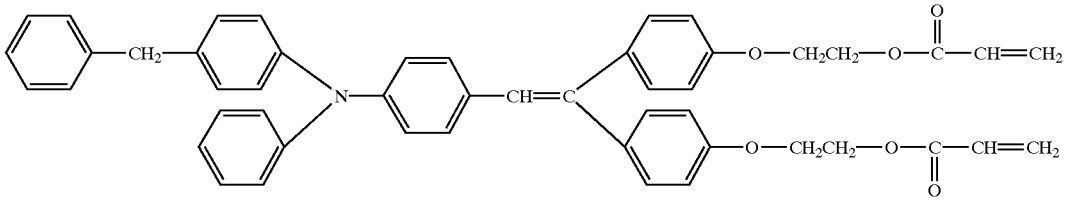
320
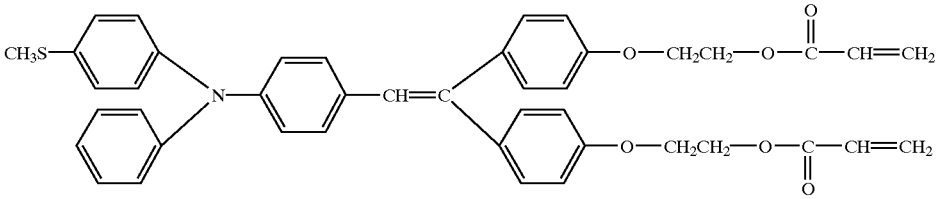
321
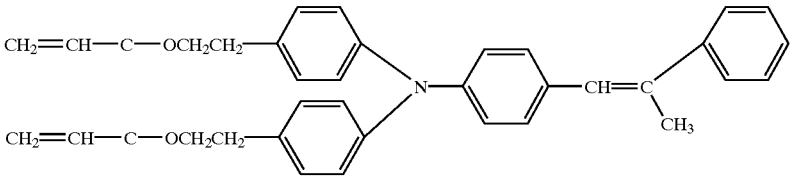
322
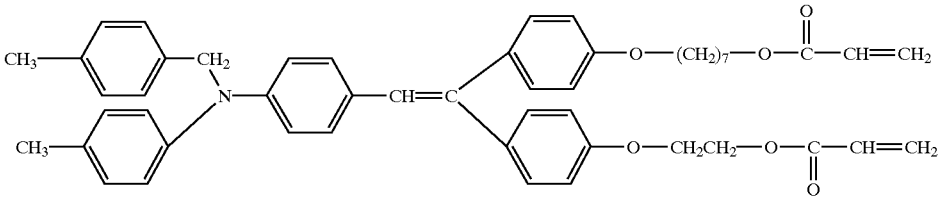

-continued

323

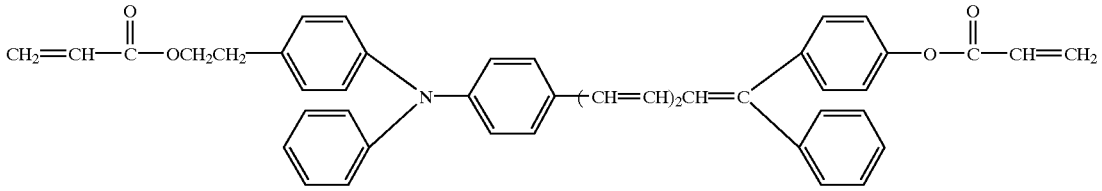

Some examples of synthesis of the curable hole-transporting compounds are described below.

SYNTHESIS EXAMPLE 1

Synthesis of Compound No. 24

The synthesis was performed along the following reaction scheme.

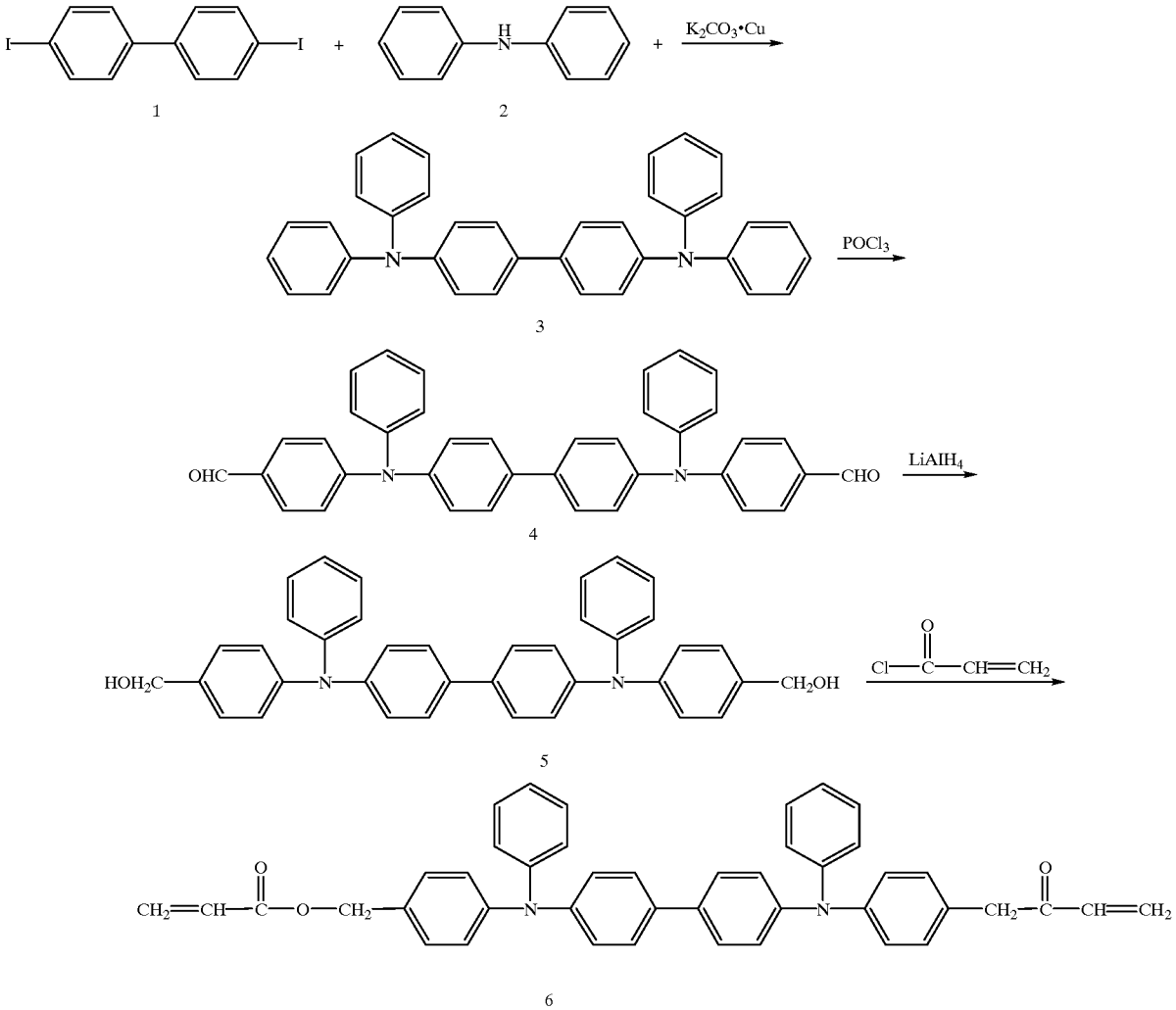

1 (50 g: 0.123 mol), 2 (62.4 g: 0.369 mol), anhydrous potassium carbonate (25.5 g) and copper powder (32 g) were stirred under hating together with 200 g of 1,2-dichlorobenzene at 180–190° C. for 18 hours. The reaction liquid was filtrated, the solvent was removed under a reduced pressure, and the remainder was recrystallized twice from . toluene/methanol mixture solvent to recover 60.2 g of 3.

242 g of N,N-dimethylformamide was cooled to 0–5° C., and phosphorus oxychloride (84.8 g: 553.2 mmol) was gradually added dropwise so that the temperature did not exceed 10° C. After the addition, the system was stirred for 15 min., a solution of the above obtained 3 (45.0 g: 92.2 mmol) in 135 g of DMF was gradually added dropwise thereto. After the addition, the system was further stirred for 15 min., restored to room temperature and stirred for 2 hours, and then heated to 80–85° C. and stirred for 8 hours. The reaction liquid was poured into 2.5 kg of 15%-sodium acetate aqueous solution, and the system was stirred for 12 hours. Then, the content was neutralized, extracted with toluene, and the resultant organic layer was dried with anhydrous sodium sulfate, followed by removal of the solvent and purified with a silica gel column to recover 40.5 g of 4.

Into a solution of 0.8 g of lithium aluminum hydride in 100 ml of dry tetrahydrofran (THF) under stirring at room temperature, a solution of 4 (37.8: 68 mmol) in 600 ml of dry THF was gradually added dropwise. After the addition. the system was further stirred for 4 hours at room temperature, and 500 ml of 5%-hydrochloric acid aqueous solution was gradually added dropwise. After the addition, the content was extracted with toluene and the organic layer was dried with anhydrous sodium sulfate, followed by removal of the solvent and purification of the remainder with silica gel column, to recover 26.3 g of 5.

Then, 5 (20 g: 36 mmol) and triethylamine (12.8 g: 126 mmol) were added to 130 ml of dry THF. After the system was cooled to 0–5° C., acryloyl chloride (9.8 g: 108 mmol) was gradually added dropwise. After the addition, the system was gradually restored to room temperature and further stirred for 6 hours at room temperature. The reaction liquid was poured into water, neutralized and extracted with ethyl acetate, followed by drying of the organic layer with anhydrous sodium sulfate, removal of the solvent and purification with a silica gel column to recover 11.2 g of 6 (Compound No. 24) (Oxidation potential (Eox)=0.80 volt).

SYNTHESIS EXAMPLE 2

Synthesis of Compound No. 78

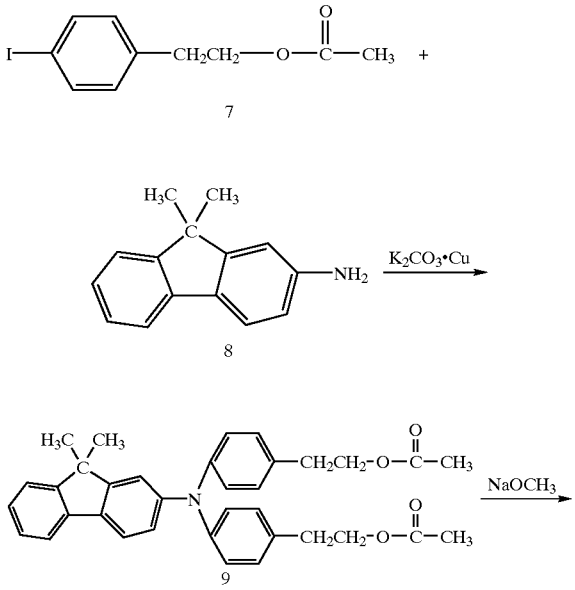

-continued

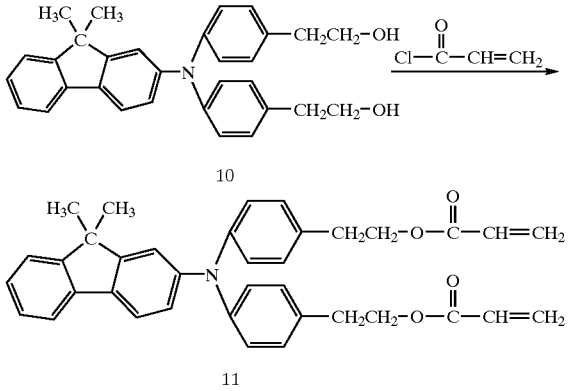

7 (50 g: 0.172 mol), 8 (14.4 g: 0.069 mol), anhydrous potassium carbonate (36 g) and copper powder (33 g) were stirred together with 120 g of 1,2-dichlorobenzene under heating at 180–190° C. for 15 hours. The reaction liquid was filtrated, the solvent was removed under a reduced pressure, and the remainder was purified by a silica gel column to recover 28.5 g of 9.

9 (25 g: 47 mmol) was added to 250 g of methyl cellosolve, and under stirring of the mixture at room temperature, sodium methylate (25 g) was gradually added. After the addition, the system was further stirred for 1 hour at room temperature, and further stirred under heating at 70–80° C. for 12 hours The reaction liquid was then poured into water, neutralized with dilute hydrochloric acid and extracted with ethyl acetate, followed by drying of the organic layer with anhydrous sodium sulfate, removal of the solvent under a reduced pressure, and purification of the remainder by a silica gel column to recover 17.8 g of 10.

10 (15 g: 40 mmol) and triethylamine (14 g:

139 mmol) were added to 100 ml of dry THF. After cooling to 0–5° C., acryloyl chloride (10.9 g: 120 mmol) was gradually dropped thereto. Thereafter, the system was restored to room temperature and further stirred for 4 hours at room temperature. The reaction liquid was poured into water, neutralized and extracted with ethyl acetate, followed by drying of the organic layer with anhydrous sodium sulfate, removal of the solvent and purification of the remainder by a silica gel column to obtain 11.9 g of 11 (Compound No. 78) (Eox=0.78 volt).

SYNTHESIS EXAMPLE 3

Synthesis of Compound No. 113

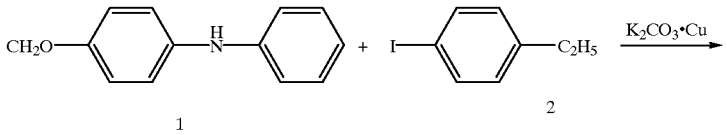

-continued

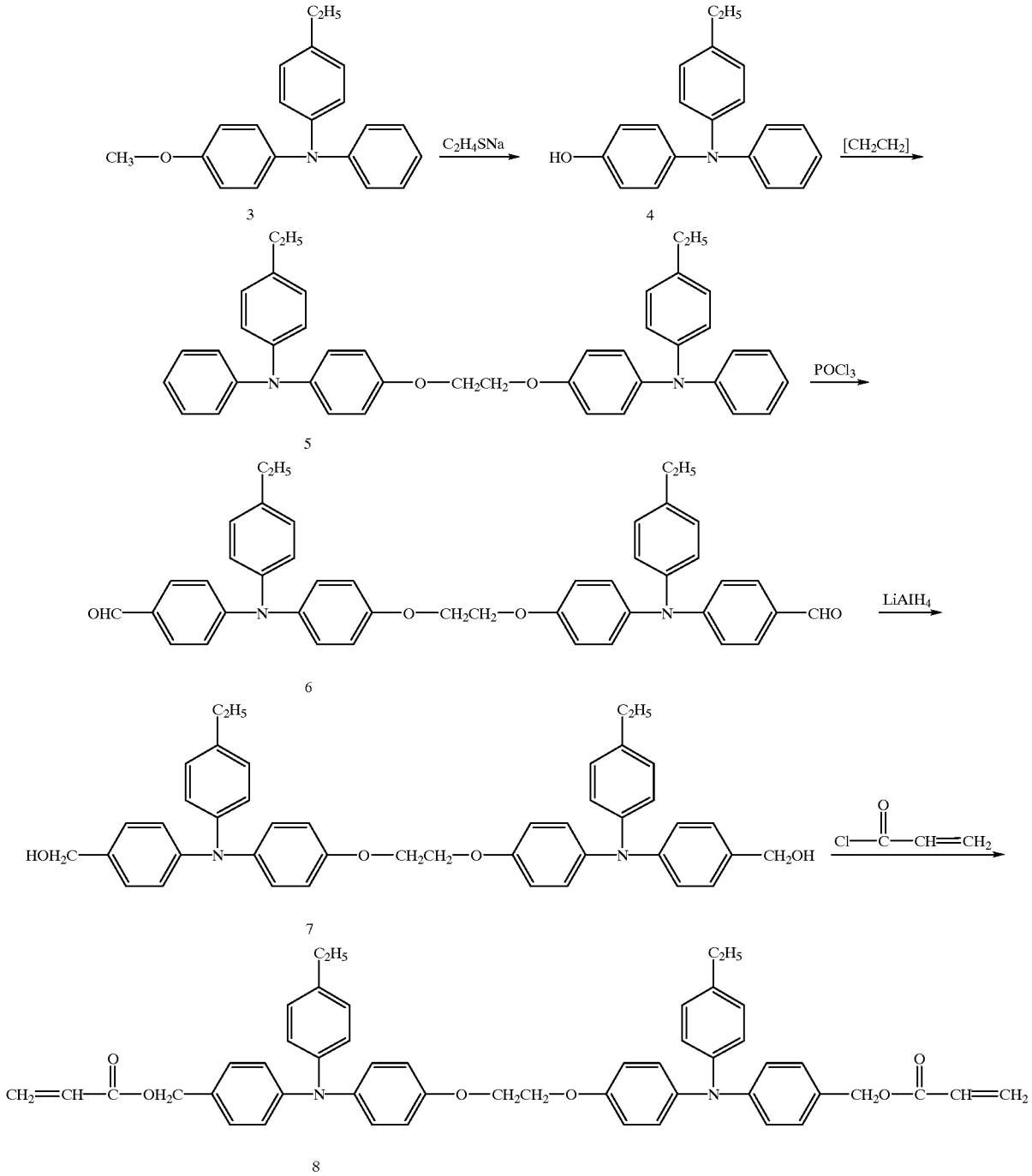

1 (70 g: 0.35 mol), 2 (98 g: 0.42 mol), anhydrous potassium carbonate (73 g) and copper powder (111 g) were stirred together with 600 g of 1,2-dichlorobenzene under heating at 180–190° C. for 10 hours. The reaction liquid was filtrated, the solvent was removed under a reduced pressure, and the remainder was purified by a silica gel column to recover 86.2 g of 3.

3 (80 g: 0.26 mol) was added to 300 g of DMF, and under stirring at room temperature, sodium ethanethiolate (ca. 90%: 62 g) was gradually added thereto. After the addition, the system was further stirred for 1 hour at room temperature and further stirred for 3 hours under reflux heating. After cooling, the reaction liquid was poured into water, and weakly acidified with dilute hydrochloric acid, followed by extraction with ethyl acetate, further extraction of the resultant organic layer with 1.2N-sodium hydroxide aqueous solution, acidification of the aqueous layer with dilute acid, extraction of the aqueous layer with ethyl acetate, drying with anhydrous sodium sulfate, removal of the solvent under a reduced pressure and purification of the remainder by a silica gel column to obtain 64 g of 1.

4 (60 g: 0.21 mol) was added to 300 g of DMF, and under stirring at room temperature, caustic soda (8.3 g) was gradually added thereto. After the addition, the system was further stirred for 30 min. at room temperature, and 1,2-diiodoethane (31.7 g: 0.1 mol) was gradually dropped thereto. After the dropping, the system was stirred for 30 min. and further stirred for 5 hours under heating at 70° C. The reaction liquid was poured into water and extracted with toluene. The organic layer was washed with water and dried with anhydrous sodium sulfate, followed by removal of the solvent under a reduced pressure and purification of the remainder by a silica gel column to obtain 49.1 g of 5.

DMF (182 g) was cooled to 0–5° C., and phosphorous oxychloride (63.6 g) was gradually dropped thereto so as not to exceed 10° C. After the dropping, the system was further stirred for 30 min., restored to room temperature, stirred for 2 hours, and further stirred under heating at 80–85° C. for 15 hours. The reaction liquid was poured into 1.5 kg of ca. 15%-sodium acetate aqueous solution, followed by stirring for 12 hours. The mixture was neutralized and extracted with toluene. The organic layer was dried with anhydrous sodium sulfate, followed by removal of the solvent and purification of the remainder by a silica gel to obtain 23 g of 6.

Into a solution of 0.89 g of lithium aluminum hydride in 100 ml of dry THF under stirring, a solution of 6 (15 g: 0.023 mol) in 100 ml of dry THF was gradually dropped. After the addition, the system was stirred for 4 hours at room temperature, and 200 ml of 5%-hydrochloric acid aqueous solution was gradually dropped thereto. After the dropping, the reaction liquid was extracted with toluene, and the organic layer was dried with anhydrous sodium sulfate, followed by removal of the solvent and purification of the remainder by a silica gel column to recover 13.6 g of 7.

7 (10 g: 0.015 mol) and triethylamine (6.1 g: 0.06 mol) were added to 120 ml of dry THF, and after cooling to 0–5° C., acryloyl chloride (4.1 g: 0.045 mol) was gradually dropped thereto. After the dropping, the system was gradually restored to room temperature and further stirred for 6 hours. The reaction liquid was poured into water, neutralized and extracted with ethyl acetate. The organic layer was dried with anhydrous sodium sulfate, followed by removal of the solvent and purification of the remainder by a silica gel column to obtain 6.4 g of 8 (Compound No. 113) (Eox=0.78 volt).

SYNTHESIS EXAMPLE 4

Synthesis Compound No. 124

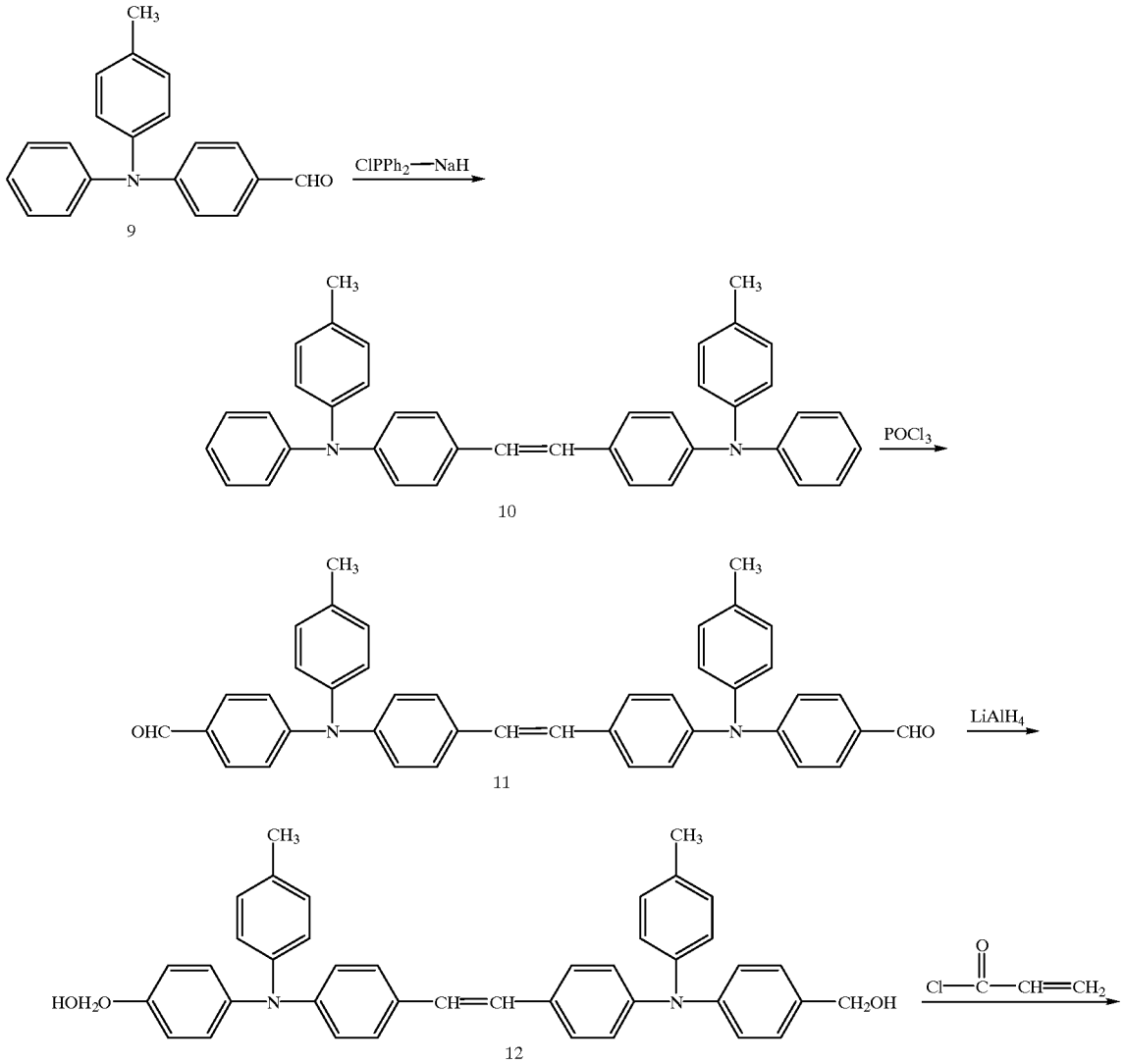

-continued

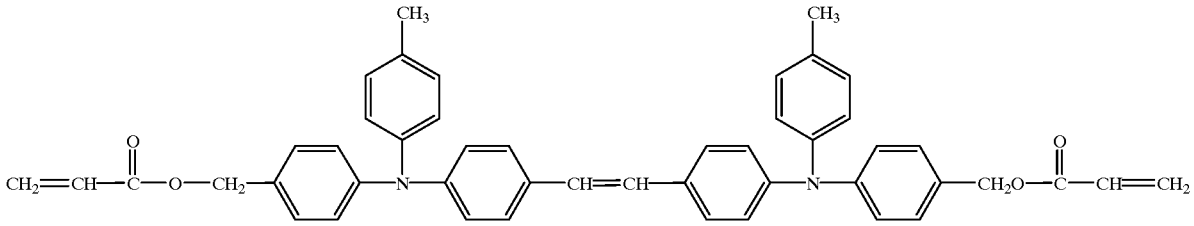

13

Diphenylchlorophosphine (80.0 g: 0.36 mmol) was added to 600 ml of diethylene glycol dimethyl ether, and after further addition of 8 ml of water, oily sodium hydride (60%, 23 g: 0.58 mmol) was gradually added thereto. After the addition, the system was further stirred for 1 hour at room temperature, a solution of 9 (80 g: 0.28 mol) in 100 ml of THF was gradually dropped thereto, followed by 15 hours of stirring under heating at 80° C. After cooling, the reaction liquid was poured into water and extracted with toluene, followed by drying of the organic layer with anhydrous sodium sulfate, removal of the solvent and purification of the remainder by a silica gel column to obtain 58.5 g of 10. Then, 10 was synthesized into 13 in a similar manner as synthesis of 8 from 5 in the above Synthesis Example 3 to obtain 13 (Compound No. 124) (Eox=0.78 volt) Synthesis Example 5 (Synthesis of Compound No. 169)

7 (10 g: 15 mmol) obtained in the same manner as in Synthesis Example 3 was added to 50 ml of dry THF, and after cooling to 0–5° C., 1.8 g of oily sodium hydride (ca. 60%) was gradually added thereto. After the addition, the system was restored to room temperature for 1 hour of stirring and then again cooled to 0–5° C., followed by gradual dropping of allyl bromide (7.5. g: 0.062 mmol). After the dropping, the system was further stirred for 1 hour, restored to room temperature for further 1 hour of stirring and then further stirred for 3 hours under heating at 60–70° C. The reaction liquid was poured into water, neutralized and then extracted with toluene. The organic layer was dried with anhydrous sodium sulfate, followed by removal of the solvent and purification of the remainder by a silica gel column to obtain 5.4 g of an objective compound (Compound No. 169) (Eox=0.76 volt).

SYNTHESIS EXAMPLE 6

Synthesis of Compound No. 213

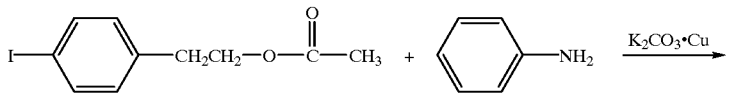

1 2

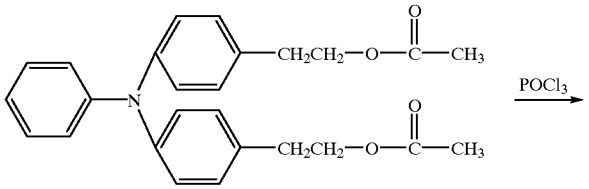

3

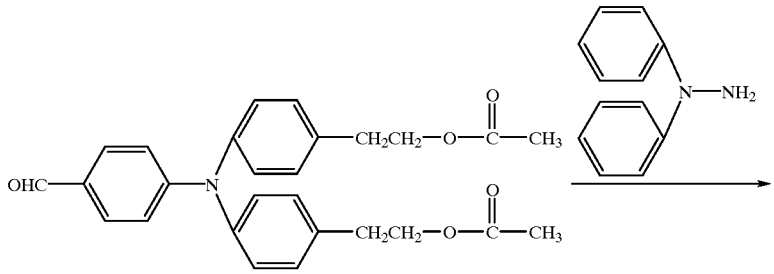

4

-continued

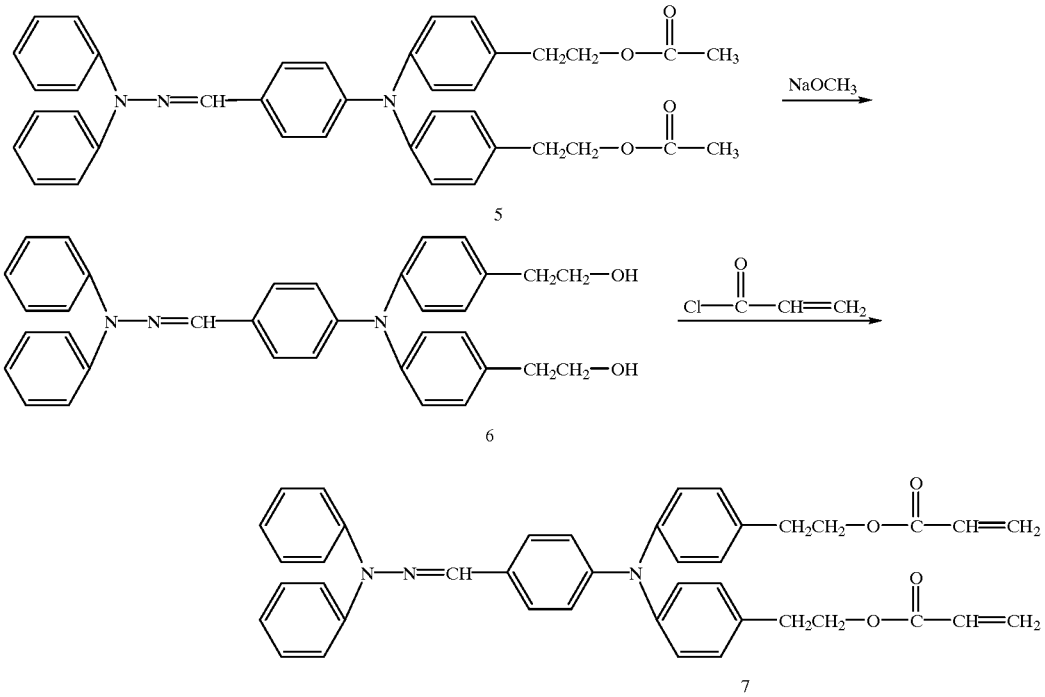

1 (50 g: 0.173 mol), 2 (7.5 g: 81 mmol), anhydrous potassium carbonate and copper powder (55 g) were stirred together with 200 g of 1,2-dichlorobenzene under heating at 180–190° C. for 10 hours. The reaction liquid was filtered, the solvent was removed under a reduced pressure and the remainder was purified by a silica gel column to obtain 58 g of 3.

35 g of DMF was cooled to 0–5° C., and phosphorus oxychloride (18.4 g; 0.12 mol) was dropped thereto so as not to exceed 10° C. After the dropping, the system was further stirred for 15 min., and a solution of 3 (50.0 g: 0.12 mol) in 50 g of DMF was gradually dropped thereto. After the addition, the system was further stirred for 30 min., restored to room temperature for further 1 hour of stirring and then heated to 80–85° C. for further 5 hours of stirring The reaction liquid was poured to 800 g of ca. 15%-sodium acetate aqueous solution, followed by 12 hours of stirring. The mixture was neutralized and extracted with toluene, followed by drying of the organic layer with anhydrous sodium sulfate, removal of the solvent and purification of the remainder by a silica gel column to obtain 37.8 g of 4.

4 (25 g: 56 mmol) was added to 200 ml of ethanol, and 1,1-diphenylhydrazine hydrochloride (35 g: 159 mmol) was added thereto. After the addition, the system was further stirred for 1 hour at room temperature and stirred for further 2 hours at 50° C. The reaction liquid was cooled and poured to water, followed by extraction with toluene. The organic layer was dried with anhydrous sodium sulfate, followed by removal of the solvent and purification of the remainder by a silica gel column, to recover 24.5 g of 5.

5 (20 g: 33 mmol) was added to 200 g of methyl cellosolve, and under stirring at room temperature, sodium methylate (12.0 g) was gradually added thereto. After the addition, the system was further stirred for 1 hour at room temperature and 8 hours under heating at 40–50° C. The reaction liquid was poured to water, neutralized with dilute hydrochloric acid and extracted with ethyl acetate. The organic layer was dried with anhydrous sodium sulfate, followed by removal of the solvent under a reduced pressure and purification of the remainder by a silica gel column, to recover 7.1 g of 6.

6 (7.0 g: 11 mmol) and triethylamine (3.5 g: 35 mmol) were added to 100 ml of dry THF, and after cooling to 0–5° C., acryloyl chloride (2.5 g: 28 mmol) was gradually dropped thereto. After the dropping, the system was gradually restored to room temperature and stirred for 4 hours at room temperature. The reaction liquid was poured to water and extracted with ethyl acetate. The organic layer was dried with anhydrous sodium sulfate, followed by removal of the solvent and purification of the remainder by a silica gel column, to obtain 2.8 g of 7 (Compound No. 213) (Eox=0.69 volt).

SYNTHESIS EXAMPLE 7

Synthesis of Compound No. 246

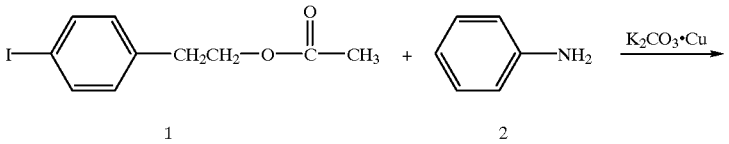

-continued

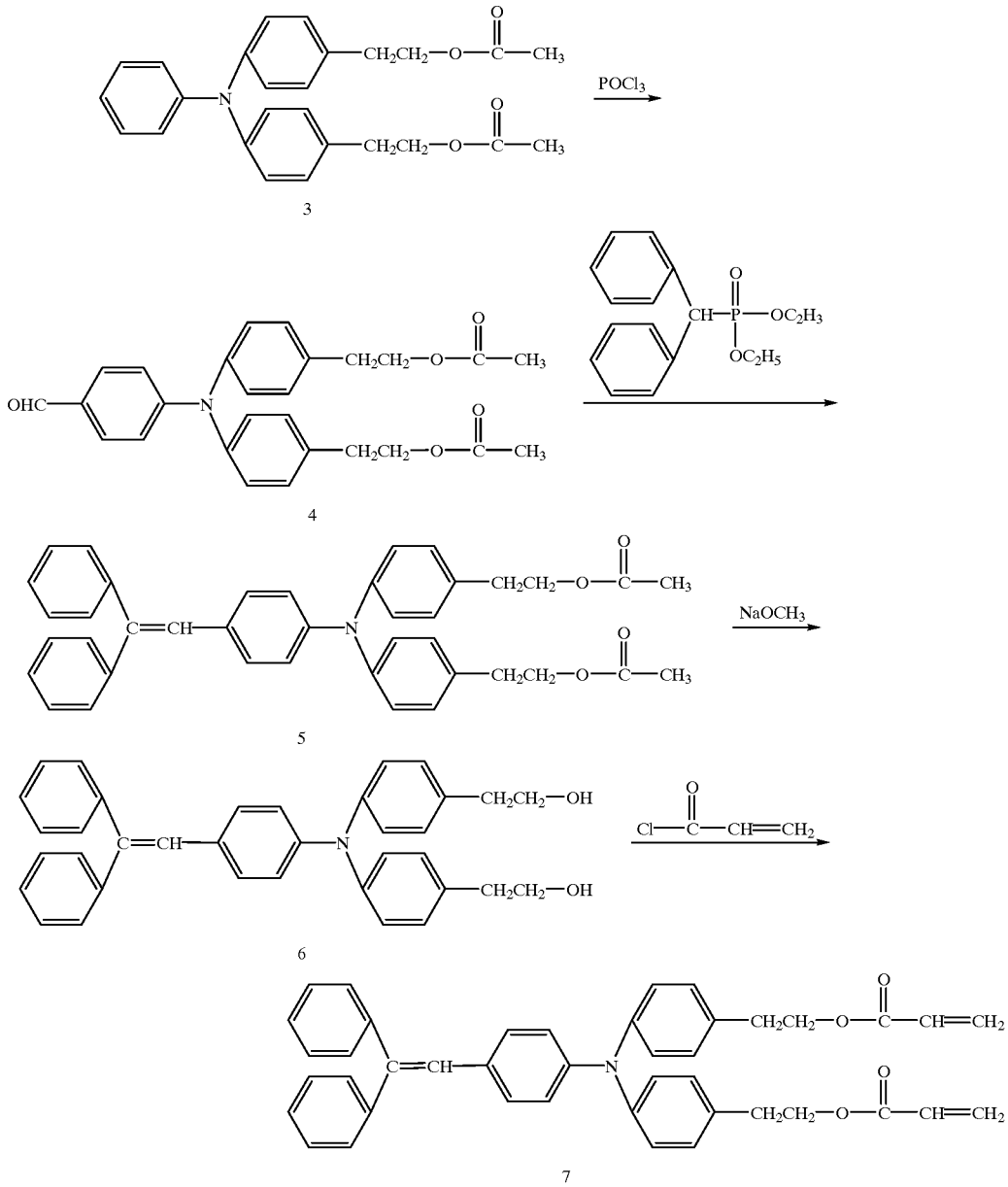

1 (50 g: 0.173 mol), 2 (8.0 g: 86 mmol), 47.8 g of anhydrous potassium carbonate (47.8 g) and copper powder (55 g) were stirred together with 200 g of 1,2-dichlorobenzene under heating at 180–190° C. for 13 hours. The reaction liquid was filtrated, and the solvent was removed under a reduced pressure. The remainder was re-crystallized twice from acetone/methanol mixture solvent to recover 51 g of 3.

35 g of DMF was cooled to 0–5° C., and phosphorus oxychloride (18.4 g: 0.12 mol) was gradually dropped thereto so as not to exceed 10° C. After the dropping, the system was further stirred for 15 min., and a solution of 3 (50.0 g: 0.12 mol) in 50 g of DMF was gradually dropped thereto. After the dropping, the system was further stirred for 30 min., restored to room temperature for further 1 hour of stirring and then heated to 80–85° C. for further 5 hours of stirring. The reaction liquid was poured to 800 g of ca. 15%-sodium acetate aqueous solution, followed by 12 hours of stirring, neutralization and extraction with toluene. The organic layer was dried with anhydrous sodium sulfate, followed by removal of the solvent and purification of the remainder by a silica gel column, to recover 37.8 g of 4.

4 (30 g: 67 mmol) and 1,1-diphenylmethyl diethylphosphate (20.5 g: 67 mmol) were dissolved in 200 ml of dry THF, and oily sodium hydride (Ca. 60%, 2.97 g: ca. 74 mmol) was gradually added thereto. After the addition, the system was stirred for 30 min. at room temperature, and further stirred for 3 hours under heating. After cooling, the reaction liquid was poured to water and extracted with toluene. The organic layer was dried with anhydrous sodium sulfate, followed by removal of the solvent and purification of the remainder by a silica gel column, to recover 21.1 g of 5.

5 (20 g: 33.6 mmol) was added to 200 g of methyl cellosolve, and under stirring at room temperature, sodium methylate (7.0 g) was gradually added thereto. After the addition, the system was further stirred for 1 hour at room temperature and then further stirred for 12 hours at 70–80° C. The reaction liquid was poured to water, neutralized with dilute hydrochloric acid, and extracted with ethyl acetate. The organic layer was dried with anhydrous sodium sulfate, followed by removal of the solvent and purification of the remainder by a silica gel column to recover 15.1 g of 6.

6 (15 g; 29.3 mmol) and triethylamine (8.88 g: 87.9 mmol) were added to 100 ml of dry THF, and after cooling to 0–5° C., acryloyl chloride (8.0 g: 88.4 mmol) was gradually dropped thereto. After the dropping, the system was gradually restored to room temperature and further stirred for 6 hours at room temperature. The reaction liquid was poured to water, neutralized and extracted with ethyl acetate. The organic layer was dried with anhydrous sodium sulfate, followed by removal of the solvent and purification of the remainder by a silica gel column to obtain 9.8 g of 7 (Compound No. 246) (Eox=0.76 volt).

SYNTHESIS EXAMPLE 8

(Synthesis of Compound No. 279

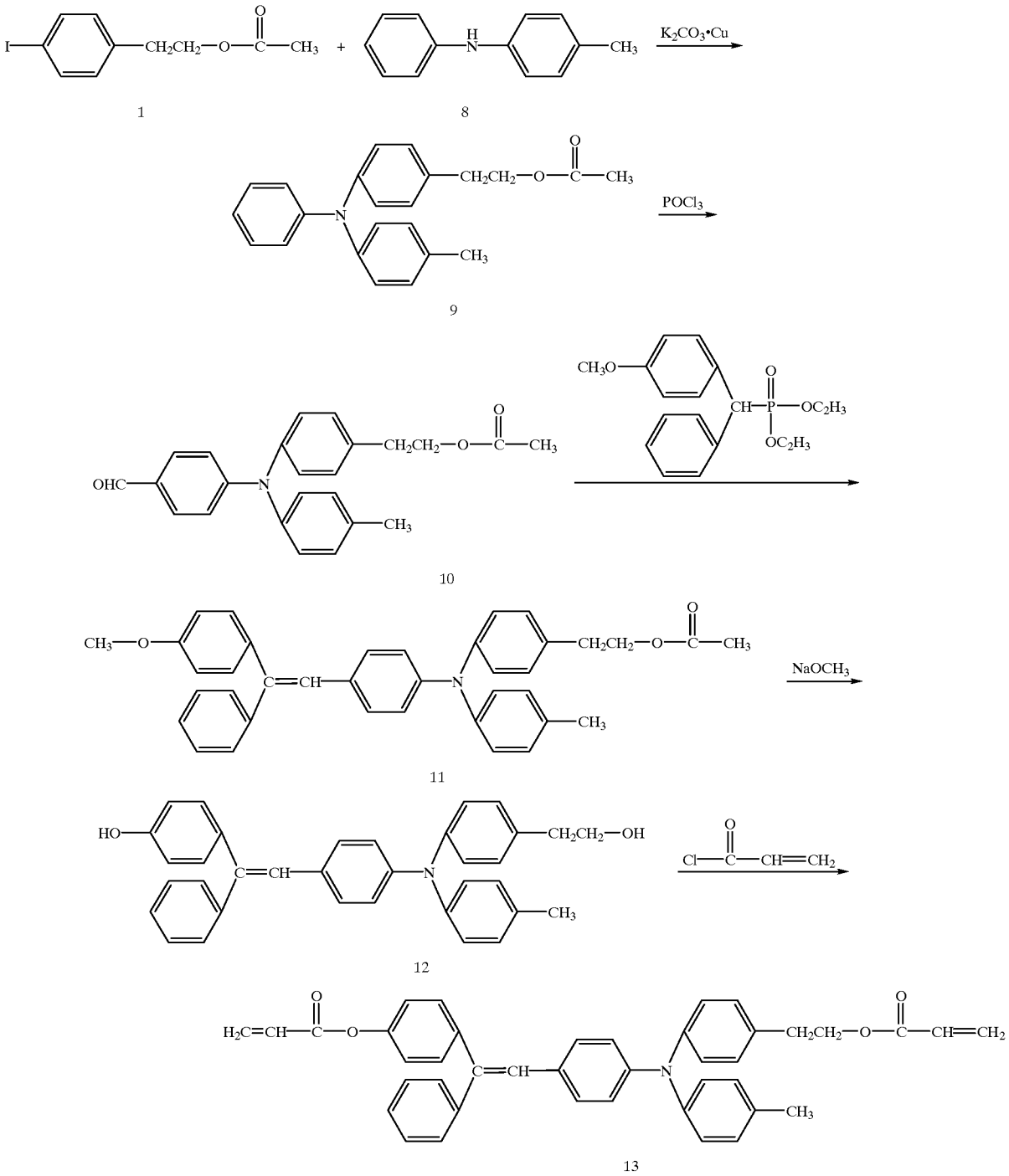

1 (50 g: 0.173 mol), 8 (31.87 g: 0.173 mol), anhydrous potassium carbonate (50 g) and copper powder (65 g) were stirred together with 250 g of 1,2-dichlorobenzene under heating at 180–190° C. for 10 hours. The reaction liquid was filtrated, followed by removal of the solvent under a reduced pressure and purification of the remainder by a silica gel column to recover 49 g of 9.

DMF (40 g) was cooled to 0–5° C., and phosphorus oxychloride (19.9 g: 0.13 mol) was gradually dropped thereto so as not to exceed 10° C. After the dropping, the system was further stirred for 15 min., and a solution of 9 (45 g: 0.013 mol) in 60 g of DMF was gradually dropped thereto. After the dropping, the system was further stirred for 30 min., restored to room temperature for further 1 hour of stirring and heated to 80–85° C. for further 5 hour of stirring. The reaction liquid was poured to 1 kg of ca. 15%-sodium acetate aqueous solution, followed by 12 hours of stirring. The mixture was neutralized and extracted with toluene. The organic layer was dried with anhydrous sodium sulfate, followed by removal of the solvent and purification of the remainder by a silica gel column, to obtain 33 g of 10.

10 (30 g: 80 mmol) and 1-phenyl-1-(p-methoxyphenyl) methyl diethyl phosphate (27 g: 80.7 mmol) were dissolved in 200 ml of dry THF, and at room temperature, oily sodium hydride (ca. 60%, 3.8 g: ca. 95 mmol) was gradually added thereto. After the addition, the system was further stirred for 30 min. at room temperature and further stirred for 3 hours under heating. After cooling, the reaction liquid was poured to water and extracted with ethyl acetate. The organic layer was dried with anhydrous sodium sulfate, followed by removal of the solvent and purification of the remainder by a silica gel column, to recover 28.1 g of 11.

11 (20 g: 36 mmol) was added to 150 g of methyl cellosolve, and under stirring at room temperature, sodium methylate (8.0 g) was gradually added thereto. After the addition, the system was further stirred for 1 hour and further stirred for 20 hours under heating at 90–100° C. The reaction liquid was poured to water, neutralized with dilute hydrochloric acid and extracted with ethyl acetate. The organic layer was dried with anhydrous sodium sulfate, followed by removal of the solvent under a reduced pressure and purification of the remainder by a silica gel column, to recover 15.8 g of 12.

12 (15 g: 23 mmol) and triethylamine (7.0 g: 69 mmol) were added to 100 ml of dry THF, and after cooling to 0–5° C., acryloyl chloride (6.3 g: 70 mmol) was gradually dropped thereto. After the dropping, the system was gradually restored to room temperature and further stirred for 6 hours. The reaction liquid was poured to water, neutralized and extracted with ethyl acetate. The organic layer was dried with anhydrous sodium sulfate, followed by removal of the solvent and purification of the remainder by a silica gel column, to obtain 5.85 g of 13 (Compound No. 279) (Eox.=0.78 volt).

In the photosensitive layer according to the present invention, the hole-transporting compound having at least two chain-polymerization function groups is polymerized with at least two crosslinking points to form a three-dimensional crosslinked structure. The hole-transporting compound may be polymerized and crosslinked alone or in mixture with another compound having a chain-polymerizable group. The species and proportion of the latter may be arbitrarily selected. Herein, such another compound having a chain-polymerizable group may include any of monomers, oligomers and polymers.

In case where the hole-transporting compound and such another chain-polymerizable compound have functional groups which are identical or mutually polymerizable with each other, these compounds may be combined via covalent bonds to form a copolymerized three-dimensional crosslinked structure. In case where the functional groups of these compounds are those not polymerizable with each other, the photosensitive layer is formed as a mixture of two or more three-dimensional cured products or a matrix of a principal three-dimensionally cured product in which another chain-polymerizable compound monomer or cured product thereof is contained therein, whereas an interpenetrating network structure may be formed by appropriately controlling the mixing operation/layer-forming process thereof Further, it is also possible to form a photosensitive layer with the above-mentioned hole-transporting compound together with a monomer, oligomer or polymer having no chain-polymerizable group, or a monomer, oligomer or polymer having a polymerizable group other than a chain-polymerizable group.

Further, if desired, it is also possible to include a hole-transporting compound not chemically combined within a three-dimensional crosslinked structure, i.e., a hole-transporting compound having no chain-polymerizable group. It is also possible to include other additives, inclusive of lubricants, such as fluorine-containing resin particles.

The photosensitive member according to the present invention may assume any structure comprising, on an electroconductive support, a photosensitive layer of a laminate structure including a charge generation layer comprising a charge-generating material and a charge transport layer comprising a charge-transporting material disposed in this order, a laminate structure including these layers in a reverse structure, or a single-layer structure containing the charge-generating material and the charge-transporting material in the same layer. In the former laminate structure-type, the charge transport layer can be formed in two or more layers, and in the latter single layer structure-type, the photosensitive layer containing both the charge-generating material and the charge-transporting material can be further coated with a charge transport layer. It is further possible to form a protective layer on the charge generation layer or the charge transport layer.

In any of the above-mentioned cases, it is sufficient for the present invention that the photosensitive layer contains a cured product formed by polymerization and crosslinking of the above-mentioned hole-transporting compound having chain-polymerization function groups. However, in view of performances of the resultant electrophotographic photosensitive member, particularly electrical performances, such as residual potential, and durability, the function-separation-type photosensitive member structure including the charge generation layer and the charge transport disposed in his order on the support is preferred, and an advantage of the present invention in this case is to provide a surface layer with a further improved durability without impairing the entire charge-transporting performance of the photosensitive member.

Next, other layer structures of the electrophotographic photosensitive member according to the present invention will be described.

The support may comprise any material showing electroconductivity. For example, the support may comprise a metal or alloy, such as aluminum, copper, chromium, nickel, zinc, aluminum or stainless steel shaped into a drum form or a sheet form, a plastic film laminated with a foil of a metal, such as aluminum or copper, a plastic film coated with a vapor deposition layer of aluminum, indium oxide or tin oxide, or a substrate of a metal, plastic film or paper coated with a mixture of a metal or alloy as described above with a binder resin.

In the electrophotographic photosensitive member according to the present invention, it is possible to dispose an undercoating layer having a barrier function and an adhesive function between the electroconductive support (or an electroconductive layer thereon) and the photosensitive layer. More specifically, the undercoating layer may be formed for various purposes, such as improved adhesion and applicability of the photosensitive layer, protection of the support, coating of defects of the support, improved charge injection from the support, and protection of the photosensitive layer form electrical breakdown.

The undercoating layer may for example comprise polyvinyl alcohol, poly-N-vinylimidazole, polyethylene oxide, ethylcellulose, ethylene-acrylic acid copolymer, casein, polyamide, N-methoxymethylated 6-nylon, copolymer nylon, glue and gelatin. These materials may be dissolved in a solvent adapted therefor and applied onto the support, followed by drying, to form an undercoating layer in a thickness of, preferably 0.1–2 $\mu$m.

As mentioned above, the laminate-type photosensitive layer structure includes a charge generation layer and a charge transport layer.

Examples of the charge-generating material used in the charge generation layer may include:

selenium-tellurium, pyrylium and thiapyrylium dyes; phthalocyanine compounds having various central atoms and crystal forms, such as $\alpha$, $\beta$, $\gamma$, $\epsilon$ and $\chi$-forms;

anthrathrone pigments, dibenzpyrenequinone pigments, pyranthrone pigments, trisazo pigments, disazo pigments, monoazo pigments, indigo pigments, quinacridone pigments, asymmetrical quinocyanine pigments, quinocyanines, and amorphous silicon disclosed in JP-A 54-143645.

Such a charge-generating material may be subjected to dispersion together with a binder resin in an amount of 0.3–4 times thereof and a solvent, by means of a homogenizer, an ultrasonic disperser, a ball mill, a vibrating ball mill, a sand mill, an attritor or a roll mill, and the resultant dispersion may be applied and dried to form a charge generation layer. Such a charge generation layer may also be formed of such a charge-generating material alone formed, e.g., by vapor deposition thereof. The charge generation layer may preferably be formed in a thickness of at most 5 $\mu$m, particularly 0.1–2 $\mu$m.

Examples of the binder resin may include:

homopolymers and copolymers of vinyl compounds, such as styrene, vinyl acetate, vinyl chloride, acrylic acid esters, methacrylic acid esters, vinylidene fluoride, and trifluoroethylene; polyvinyl alcohol, polyvinyl acetal, polycarbonate, polyester, polysulfone, polyphenylene oxide, polyurethane, cellulose resin, phenolic resin, melamine resin, silicone resin and epoxy resin.

In the present invention, the above-mentioned hole-transporting compound having chain-polymerization function groups may be used to form a charge transport layer on the charge generation layer, or a surface protective layer having a hole-transporting function on a charge transport layer comprising a charge-transporting compound and a binder resin formed on the charge generation layer. Such a protective layer is also a (portion of the) photosensitive layer because it exhibits a hole-transporting function.

In any case of the photosensitive layer production, it is preferred that a solution of the above-mentioned hole-transporting compound is applied to form a layer, which is then subjected to polymerization and crosslinking. It is however possible to react such a solution containing the hole-transporting compound to obtain a cured product and applying a dispersion of the cured product to form a surface layer.

In case of providing the charge transport layer, the hole-transporting compound having chain-polymerization function groups may preferably be used in such an amount as to provide the hypothetical hydrogen-adduct to the group A in the formula (1), e.g., those represented by the formula (2), (3), (4) or (6), in a proportion of at least 20 wt. %, more preferably at last 40 wt. %, of the total weight of the charge transport layer after the polymerization and crosslinking. Below 20 wt. %, the charge-transporting function is lowered, thus being liable to cause problems, such as a lowering of sensitivity and an increase of residual potential. The charge transport layer may preferably be formed in a thickness of 1–50 $\mu$m, particularly 3–30 $\mu$m, In the case of using the hole-transporting compound for forming a surface protective layer on the laminate of the charge generation layer and the charge transport layer, the charge transport layer below the surface protective layer may be formed by dissolving or dispersing an appropriate charge-transporting material together with an appropriate binder resin (which may be selected from the above-mentioned binder resins for the charge generation layer) in an appropriate solvent and applying and drying the resultant solution or dispersion liquid. The charge-transporting material may for example be selected from polymers having heterocyclic rings or condensed polycyclic aromatic rings, such as poly-N-vinylcarbazole and polystyrylanthracene; and low-molecular weight compounds including heterocyclic compounds, such as pyrazoline, imidazole, oxazole, triazole and carbazole; triarylalkane derivatives, such as triphenylmethane; triarylamine derivatives, such as triphenylamine; phenylenediamine derivatives, N-phenylcarbazole derivatives, stilbene derivatives and hydrazone derivatives.

In this case, the charge-transporting material may preferably be used in 30–100 wt. parts, more preferably be 50–100 wt. parts, per 100 wt. parts In total of the charge-transporting material and the binder resin. If the amount of the charge-transporting material is below 30 wt. parts, the charge-transporting ability is lowered, thus being liable to result in problems, such as lower sensitivity and increased residual potential. The charge transport layer may preferably be formed in such a thickness as to provide a total thickness of 1–50 $\mu$m, particularly 3–30 $\mu$m, in combination with the surface protective layer thereon.

In any of the above-mentioned cases according to the present invention, the photosensitive layer comprising the cured product of the hole-transporting compound can further contain a charge-transporting compound as mentioned above.

A single layer-type photosensitive layer may be formed by applying a solution or liquid containing the hole-transporting compound and a charge-generating material as mentioned above to form a layer, which may be then polymerized and crosslinked. Alternatively, a single layer-type photosensitive layer containing both a charge-generating material and a charge-transporting material as mentioned above is first formed and then coated with a liquid containing the hole-transporting compound, which is then polymerized and crosslinked.

The photosensitive layer according to the present invention can further contain various additives, inclusive of deterioration-preventing agents, such as an anti-oxidant and an ultraviolet absorber, and lubricants, such as fluorine-containing resin particles.

Each layer constituting the photosensitive member may be formed, e.g., by dip coating, spray coating, curtain coating or spin coating, but the dip coating is preferred in view of the efficiency and productivity. However, it is also possible to another known layer or film forming method, such as vacuum evaporation, vapor deposition or plasma forming.

In the present invention, the above-mentioned hole-transporting compound having chain-polymerization function groups can be polymerized and crosslinked by exposure to any of radiation, heat and light energies, but may preferably be reacted by exposure to radiation. A major advantage of radiation polymerization is that it does not require a polymerization initiator. As a result, it is possible to provide a very high-purity three-dimensionally cured photosensitive layer matrix, thus ensuring good electrophotographic performances. Further, it allows a quick and effective polymerization reaction, thus providing a high productivity. Further, as various additives capable of acting as masking materials in photopolymerization can exhibit a high transmittance to radiation, so that even a thick layer can be cured without significant retardation thereby. However, depending on the species of chain-polymerizable group and a central structure, some retardation of polymerization can be encountered. In such a case, it is also possible to add a minor amount of polymerization initiator within an extent free from substantially adverse effect.

The radiation for the above purpose may include electron beam or rays and γ-rays, but electron beam or rays (hereinafter represented by "electron beam") may be preferred in view of efficiency.

The electron beam is generally accelerated by using an accelerator which may be any of scanning type, electro-curtain type, broad beam type, pulse type and laminar type. In performing electron-beam radiation polymerization, it is important to select appropriate irradiation conditions, which may include an acceleration voltage of preferably 300 kV or below, more preferably 150 kV or below, and a dose in a range of 1–100 Mrad, more preferably 3–50 Mrad. If the acceleration voltage exceeds 300 kV, the photosensitive member performances can be damaged by electron beam irradiation. If the dose in below 1 Mrad, the crosslinking is liable to be insufficient, and in excess of 100 Mrad, the photosensitive member performances are liable to be deteriorated.

It is also possible to effect a thermal polymerization of the hole-transporting compound. The thermal polymerization can proceed under application of heat energy alone or in the presence of a polymerization initiator in addition to application of heat energy. It is however preferred to add a polymerization initiator in order to promote the reaction effectively at a lower temperature.

Any polymerization initiator having a reasonable length of half-life at a temperature above room temperature may be used. Examples thereof may include: peroxides, such as ammonium persulfate, dicumyl peroxide, benzyl peroxide, and di-t-butyl peroxide: and azo compounds, such as azo-bisbutyronitrile. The initiator may preferably be added in a proportion of 0.01–10 wt. parts per 100 wt. parts of the hole-transporting compound having chain-polymerization function groups. Depending on the initiator used, the polymerization temperature may be appropriately be selected within the range of room temperature to 200° C.

The hole-transporting compound may also be polymerized and crosslinked by photo-irradiation. However, it is rare to use photo-energy alone but ordinary a photopolymerization initiator is used in combination The photopolymerization initiator in this instance generally refers to one absorbing ultraviolet rays principally having wavelengths of 400 nm or shorter to generate active species, such as radicals or ions, for polymerization initiation. Examples thereof may include: radical polymerization initiators, such as acetophenone, benzoin, benzophenone and thioxanthone; and ion polymerization initiators, such as diazonium compounds, sulfonium compounds, iodonium compounds, and metal complex compounds. It is also possible to use recently developed polymerization initiators absorbing light of infrared/visible regions having wavelengths of 500 nm or longer to generate such active species. The initiator may preferably be used in 0.01–50 wt. parts per 100 wt. parts of the hole-transporting compound having chain-polymerization function groups.

Incidentally, it is also possible to use thermal and photo-polymerization initiators, as described above, in combination.

Next, some description will be made on the process cartridge and the electrophotographic apparatus according to the present invention The sole figure in the drawing shows a schematic structural view of an electrophotographic apparatus including a process cartridge using an electrophotographic photosensitive member of the invention. Referring to the figure, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is image-wise exposed to light 4 (as by slit exposure or laser beam-scanning exposure) by using an image exposure means (not shown), whereby an electrostatic latent image is successively formed on the surface of the photosensitive member 1.

The thus formed electrostatic latent image is developed by using a developing means 5 to form a toner image. The toner image is successively transferred to a transfer (–receiving) material 7 which is supplied from a supply part (not shown) to a position between the photosensitive member 1 and a transfer charger 5 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means issuing pre-exposure light 10 to prepare for the next cycle. When a contact charging means 3 as shown in the figure is used as the primary charger for charging the photosensitive member 1 uniformly, the pre-exposure means may be omitted, as desired.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, into a process cartridge 11 detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as rails 12 of the apparatus body.

In case where the electrophotographic is a copying machine or a printer, the imagewise exposure light 4 is reflected light or transmitted light from an original, or illumination light given by scanning of laser beam, drive of an LED array or drive of a liquid crystal shutter array based signals formed by reading an original.

The electrophotographic photosensitive member according to the present invention can be applicable to electrophotographic apparatus in general, inclusive of copying machines, laser beam printers, LED printers, and liquid crystal shutter-type printers, and further to apparatus for display, recording, light-weight printing, plate forming and facsimile apparatus to which electrophotography is applied.

Hereinbelow, the present invention will be described more specifically with reference to Examples and Comparative Examples wherein "parts" used for describing a relative amount of a component or a material is by weight unless specifically noted otherwise.

EXAMPLE 1

First, a paint for an electroconductive layer was prepared by dispersing 50 parts of electroconductive titanium oxide fine powder coated with tin oxide contacting 10 wt. % of antimony oxide, 25 parts of phenolic resin, 20 parts of methyl cellosolve, 5 parts of methanol and 0.002 part of silicone oil (polydimethylsiloxane-polyoxyalkylene copolymer, number-average molecular weight (Mn)=3000) for 2 hours in a sand mill containing 1 mm-dia. glass beads. The paint was applied by dipping onto a 30 mm-dia. aluminum cylinder and dried at 140° C. for 30 min. to form a 20 μm-thick electroconductive layer.

Then, 5 parts of N-methoxymethylated nylon was dissolved in 5 parts of methanol to prepare a paint for an intermediate layer, which was then applied by dipping onto the above-formed electro-conductive layer and dried at 100° C. for 20 min. to form a 0.6 μm-thick intermediate layer.

Then, 5 parts of bisazo pigment of formula (A) below, 2 parts of polyvinyl butyral resin and 3.5 parts of cyclohexanone were dispersed for 24 hours in a sand mill containing 1 mm-dia glass beads, and further diluted with tetrahydrofuran to prepare a paint for a charge generation layer, which was applied by dipping onto the above-formed intermediate layer and dried at 100° C. for 15 min. to form a 0.2 μm-thick charge generation layer.

(A)

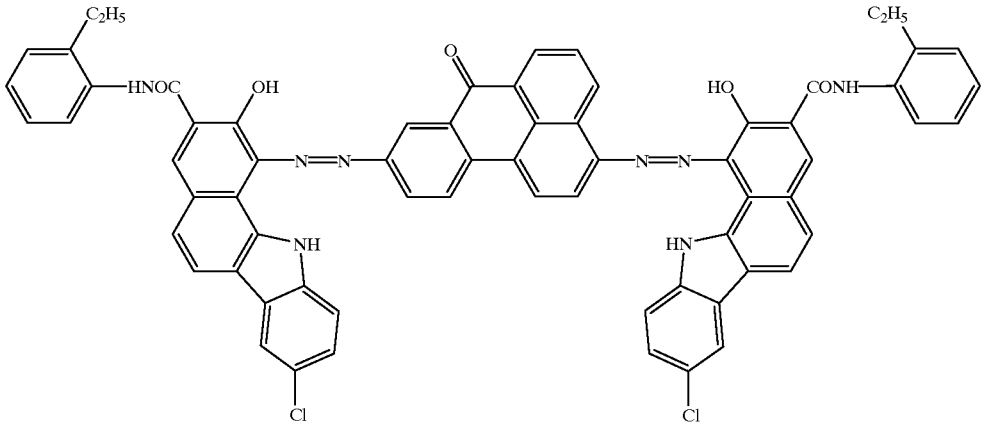

Then, 60 parts of Compound No. 24 (a hole-transporting compound among the list set forth hereinbefore) was dissolved in a mixture solvent of monochlorobenzene 30 parts/dichloromethane 30 parts to prepare a paint for a charge transport layer, which was then applied onto the above formed charge generation layer and cured by irradiation with electron beam at an acceleration voltage of 150 kV and a dose of 25 Mrad to form a 15 μm-thick charge transport layer, thus obtaining an electrophotographic photosensitive member.

The thus-prepared electrophotographic photosensitive member was evaluated with respect to precipitation with time, electrophotographic performances and durability. The precipitation with time was evaluated by pressing an urethane rubber-made cleaning blade for a copying machine against the photosensitive member surface and the photosensitive member was stored at 75° C. (as an acceleration test) for 14 days and 30 days (when precipitation was not observed after the storage for 14 days) to observe the photosensitive member surface after the storage as to the presence or absence of precipitation through a microscope.

The electrophotographic performances and durability were evaluated by incorporating the photosensitive member into a commercially available laser beam printer ("LBP-SX", mfd. by Canon K.K.) to effect a continuous image forming test. As initial photosensitive member performances, a dark potential Vd was set to −700 volts, and a photo-attenuation sensitivity ($E_{150}$: light quantity required for attenuating the dark potential (Vd) of −700 volts to a light potential V1=−150 volts) and residual potential ($V_{s1}$: potential after exposure to a light quantity of three times the photo-attenuation sensitivity (=3×$E_{150}$)) were measured. Then, the photosensitive member was subjected to a durability test (continuous image forming test) on 10,000 sheets, and then subjected to observation of image defects with eyes, abrasion amount and measurement of the photosensitive member performances after the continuous image forming test to measure changes of respective performances, i.e., ΔVd (change in dark potential under an identical primary charging condition), ΔV1 (change in V1 when exposed to the light quantity ($E_{150}$) giving V1=150 volts at the initial stage) and ΔVs1 (change in Vs1 when exposed to $3\times E_{150}$).

As a result, the photosensitive member did not cause precipitation but exhibited good photosensitive member performances. After the durability test, the abrasion was little and very little changes in photosensitive member performances were observed, thus exhibiting very stable and good performances. The results are inclusively shown in Table 1 appearing hereinafter together with those of the following Examples.

EXAMPLES 2–18

Electrophotographic photosensitive members were prepared and evaluated in the same manner as in Example 1 except for using hole-transporting compounds shown in Table 2 instead of Compound No. 24. The results are also shown in Table 1.

EXAMPLE 19

An electrophotographic photosensitive member was prepared and evaluated in the same manner as in Example 1 except for using a paint for the charge transport layer prepared by reducing the amount of Compound No. 24 to 48 parts and adding 12 parts of an acrylate monomer of formula (B) below:

(B)

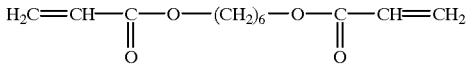

EXAMPLE 20

An electrophotographic photosensitive member was prepared and evaluated in the same manner as in Example 1 except for using a paint for the charge transport layer prepared by reducing the amount of Compound No. 24 to 48 parts and adding 12 parts of an acrylate monomer of formula (C) below:

(C)

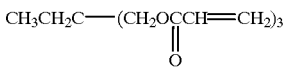

EXAMPLE 21

An electrophotographic photosensitive member was prepared and evaluated in the same manner as in Example 1 except for using a paint for the charge transport layer prepared by reducing the amount of. Compound No. 24 to 48 parts and adding 12 parts of an acrylate oligomer of formula (D) below:

(D)

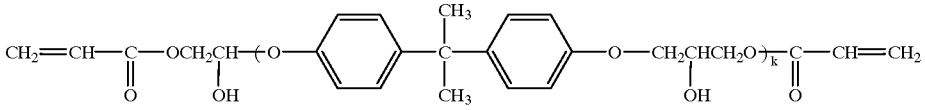

(wherein k denotes a polymerization degree giving Mn=ca. 2000)

EXAMPLES 22–26

Electrophotographic photosensitive members were prepared and evaluated in the same manner as in Example 1 except for changing the electron beam irradiation conditions for curing the charge transport layer as shown in Table 3. As a result, all the photosensitive members exhibited good abrasion resistance and good photosensitive member performances after the durability test, but the photosensitive members obtained at increased doses (Examples 25–26) exhibited slight lowering in sensitivity and increase in residual potential as initial electrophotographic performances.

EXAMPLE 27

Preparation steps were repeated in the same manner as in Example 1 up to the formation of the charge generation layer. Then, a paint for a charge transport layer was prepared by dissolving 20 parts of a styryl compound of formula (E) below and 10 parts of a polycarbonate resin (Mn=ca. 20,000) having a recurring unit of formula (F) below in a mixture solvent of monochlorobenzene 50 parts/dichloromethane 20 parts, and applied on the charge-generation layer to form a 10 μm-thick charge transport layer.

(E)

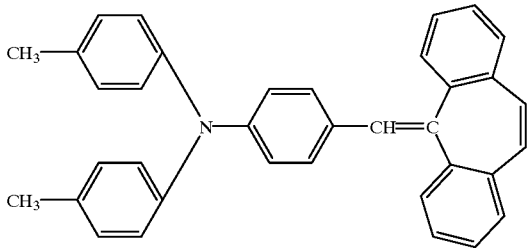

(F)

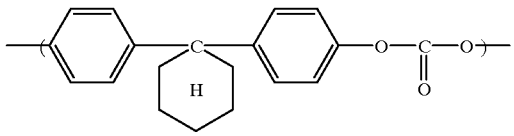

Then, 60 parts of Compound No. 24 was dissolved in a mixture solvent of monochlorobenzene 50 parts/dichloromethane 30 parts to form a paint for a surface protective layer, which was then applied by spraying onto the above-formed charge transport layer and cured by irradiation with electron beam at an acceleration voltage of 150 kV and a dose of 25 Mrad to form a 5 μm-thick surface layer, thus obtaining an electrophotographic photosensitive member. The photosensitive member was evaluated in the same manner as in Example 1.

EXAMPLE 28

An electrophotographic photosensitive member was prepared and evaluated in the same manner as in Example 27 except for using Compound No. 27 instead of Compound No. 24.

EXAMPLE 29

An electrophotographic photosensitive member was prepared and evaluated in the same manner as in Example 27 except for using a paint for the surface protective layer prepared by reducing the amount of Compound No. 24 to 30 parts and adding 30 parts of the acrylate monomer of formula (B) used in Example 19.

EXAMPLE 30

An electrophotographic photosensitive member was prepared and evaluated in the same manner as in Example 27 except for using a paint for the surface protective layer prepared by reducing the amount of Compound No. 24 to 30 parts and adding 30 parts of the acrylate oligomer of formula (D) used in Example 21.

TABLE 2

Hole-transporting compound used in Examples

| Ex. | Compound No. |
|---|---|
| 1 | 24 |
| 2 | 25 |
| 3 | 10 |
| 4 | 78 |
| 5 | 77 |
| 6 | 28 |
| 7 | 20 |
| 8 | 4 |
| 9 | 76 |
| 10 | 29 |
| 11 | 30 |
| 12 | 55 |
| 13 | 56 |
| 14 | 57 |
| 15 | 16 |
| 16 | 17 |
| 17 | 18 |
| 18 | 19 |

TABLE 1

Performance evaluation results

| | | Performance | | | | | | | |
|---|---|---|---|---|---|---|---|---|---|
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 1 | N.O. | −700 | 0.78 | 10 | good | 0.35 | 5 | 10 | 0 |
| 2 | N.O. | −700 | 0.79 | 10 | good | 0.18 | 5 | 10 | 0 |
| 3 | N.O. | −700 | 0.82 | 20 | good | 0.33 | 5 | 10 | 5 |
| 4 | N.O. | −700 | 0.80 | 10 | good | 0.35 | 5 | 10 | 5 |
| 5 | N.O. | −700 | 0.83 | 15 | good | 0.40 | 5 | 10 | 10 |
| 6 | N.O. | −700 | 0.79 | 10 | good | 0.39 | 5 | 10 | 5 |
| 7 | N.O. | −700 | 0.95 | 20 | good | 0.32 | 10 | 20 | 10 |
| 8 | N.O. | −700 | 1.09 | 40 | good | 0.33 | 25 | 30 | 20 |
| 9 | N.O. | −100 | 1.12 | 40 | good | 0.34 | 25 | 30 | 20 |
| 10 | N.O. | −700 | 0.81 | 15 | good | 0.62 | 10 | 15 | 5 |
| 11 | N.O. | −700 | 0.79 | 15 | good | 0.65 | 10 | 15 | 5 |
| 12 | N.O. | −700 | 0.77 | 10 | good | 0.41 | 10 | 15 | 9 |
| 13 | N.O. | −700 | 0.79 | 15 | good | 0.62 | 10 | 15 | 10 |
| 14 | N.O. | −700 | 0.78 | 10 | good | 0.40 | 5 | 10 | 5 |
| 15 | N.O. | −700 | 0.79 | 10 | good | 0.35 | 5 | 10 | 5 |
| 16 | N.O. | −700 | 0.80 | 10 | good | 0.44 | 10 | 15 | 5 |
| 17 | N.O. | −700 | 0.80 | 10 | good | 0.39 | 10 | 15 | 5 |
| 18 | N.0. | −700 | 0.79 | 10 | good | 0.36 | 15 | 15 | 5 |
| 19 | N.0. | −700 | 0.90 | 20 | good | 0.36 | 15 | 10 | 10 |
| 20 | N.0. | −700 | 0.90 | 20 | good | 0.20 | 15 | 10 | 10 |
| 21 | N.0. | −700 | 0.92 | 20 | good | 0.37 | 15 | 10 | 15 |
| 22 | N.0. | −700 | 0.79 | 10 | good | 0.34 | 10 | 10 | 5 |
| 23 | N.0. | −700 | 0.82 | 10 | good | 0.35 | 10 | 15 | 10 |
| 24 | N.0. | −700 | 0.86 | 20 | good | 0.32 | 10 | 15 | 10 |
| 25 | N.0. | −700 | 0.92 | 30 | good | 0.30 | 15 | 20 | 10 |
| 26 | N.0. | −700 | 0.99 | 40 | good | 0.30 | 29 | 30 | 25 |
| 27 | N.0. | −700 | 0.81 | 15 | good | 0.35 | 10 | 10 | 10 |
| 28 | N.0. | −700 | 0.83 | 15 | good | 0.41 | 10 | 10 | 10 |
| 29 | N.0. | −700 | 0.99 | 25 | good | 0.36 | 15 | 15 | 15 |
| 30 | N.0. | −700 | 1.01 | 25 | good | 0.36 | 15 | 15 | 15 |

*N.O.: Not observed.

TABLE 3

| Electron beam irradiation conditions | | |
|---|---|---|
| Ex. | Acceleration voltage (kV) | Dose (Mrad) |
| 22 | 200 | 25 |
| 23 | 300 | 25 |
| 24 | 150 | 80 |
| 25 | 150 | 120 |
| 26 | 150 | 160 |

EXAMPLE 31

An electrophotographic photosensitive member was prepared and evaluated in the same manner as in Example 1 except for using Compound NO. 170 instead of Compound No. 24. The results are shown in Table 4 together with those of the following Examples.

EXAMPLES 32–53

Electrophotographic photosensitive members were prepared and evaluated in the same manner as in Example 31 except for using hole-transporting compounds identified by Compound Nos. shown in Table 5 instead of Compound No. 170.

EXAMPLE 54

An electrophotographic photosensitive member was prepared and evaluated in the same manner as in Example 31 except for using a paint for the charge transport layer prepared by reducing the amount of Compound No. 170 to 48 parts and adding 12 parts of the acrylate monomer of formula (B) used in Example 19.

EXAMPLE 55

An electrophotographic photosensitive member was prepared and evaluated in the same manner as in Example 35 except for using a paint for the charge transport layer prepared by reducing the amount of Compound No. 170 to 48 parts and adding 12 parts of the acrylate oligomer of formula (C) used in Example 20.

EXAMPLE 56

An electrophotographic photosensitive member was prepared and evaluated in the same manner as in Example 31 except for using a paint for the surface protective layer prepared by reducing the amount of Compound No. 170 to 48 parts and adding 12 parts of the acrylate oligomer of formula (D) used in Example 21.

EXAMPLES 57–61

Electrophotographic photosensitive members were prepared and evaluated in the same manner as in Example 31 except for changing the electron beam irradiation conditions for curing the charge transport layer as shown in Table 6. As a result, all the photosensitive members exhibited good abrasion resistance and good photosensitive member performances after the durability test, but the photosensitive members obtained at increased doses (Examples 60–61) exhibited slight lowering in sensitivity and increase in residual potential as initial elactrophotographic performances.

EXAMPLE 62

Preparation steps were repeated in the same manner as in Example 31 up to the formation of the charge generation layer. Then, a paint for a charge transport layer was prepared by dissolving 20 parts of the styryl compound of formula (E) and 10 parts of the polycarbonate resin (Mn=ca. 20,000) having a recurring unit of formula (F) respectively used in Example 27 in a mixture solvent of monochlorobenzene 50 parts/dichloromethane 20 parts, and applied on the charge-generation layer to form a 10 $\mu$m-thick charge transport layer.

Then, 60 parts of Compound No. 170 was dissolved in a mixture solvent of monochlorobenzene 50 parts/dichloromethane 30 parts to form a paint for a surface protective layer, which was then applied by spraying onto the above-formed charge transport layer and cured by irradiation with electron beam at an acceleration voltage of 150 kV and a dose of 25 Mrad to form a 5 $\mu$m-thick surface layer, thus obtaining an electrophotographic photosensitive member. The photosensitive member was evaluated in the same member as in Example 31.

EXAMPLE 63

An electrophotographic photosensitive member was prepared and evaluated in the same manner as in Example 62 except for using Compound No. 171 instead of Compound No. 170.

EXAMPLE 64

An electrophotographic photosensitive member was prepared and evaluated in the same manner as in Example 62 except for using a paint for the surface protective layer prepared by reducing the amount of Compound No. 170 to 30 parts and adding 30 parts of the acrylate monomer of formula (B) used in Example 19.

EXAMPLE 65

An electrophotographic photosensitive member was prepared and evaluated in the same manner as in Example 62 except for using a paint for the surface protective layer prepared by reducing the amount of Compound No 170 to 30 parts and adding 30 parts of the acrylate oligomer of formula (D) used in Example 21.

TABLE 4

| Performance evaluation results | | | | | | | | | |
|---|---|---|---|---|---|---|---|---|---|
| Performance | | | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 31 | N.O. | −700 | 0.51 | 15 | good | 0.33 | 5 | 10 | 5 |
| 32 | N.O. | −700 | 0.88 | 15 | good | 0.35 | 5 | 10 | 5 |
| 33 | N.O. | −700 | 0.83 | 15 | good | 0.32 | 5 | 10 | 5 |
| 34 | N.O. | −700 | 0.67 | 20 | good | 0.33 | 5 | 10 | 5 |
| 35 | N.O. | −700 | 0.90 | 25 | good | 0.15 | 5 | 10 | 5 |
| 36 | N.O. | −700 | 0.84 | 20 | good | 0.42 | 5 | 10 | 5 |
| 37 | N.O. | −700 | 1.12 | 3C | good | 0.31 | 15 | 15 | 10 |
| 38 | N.O. | −700 | 1.10 | 35 | good | 0.32 | 15 | 10 | 10 |
| 39 | N.O. | −700 | 1.05 | 30 | good | 0.32 | 15 | 20 | 10 |
| 40 | N.O. | −700 | 1.03 | 30 | good | 0.35 | 15 | 20 | 10 |
| 41 | N.O. | −700 | 1.58 | 40 | good | 0.33 | 25 | 30 | 10 |
| 42 | N.O. | −700 | 1.52 | 40 | good | 0.33 | 25 | 30 | 10 |
| 43 | N.O. | −700 | 1.11 | 30 | good | 0.34 | 15 | 25 | 10 |
| 44 | N.O. | −700 | 1.13 | 30 | good | 0.32 | 15 | 30 | 10 |
| 45 | N.O. | −700 | 0.90 | 20 | good | 0.62 | 25 | 35 | 10 |
| 46 | N.O. | −700 | 0.88 | 20 | good | 0.66 | 25 | 35 | 10 |
| 47 | N.O. | −700 | 0.82 | 15 | good | 0.48 | 15 | 10 | 10 |
| 48 | N.O. | −700 | 0.88 | 20 | good | 0.69 | 25 | 25 | 10 |
| 49 | N.O. | −700 | 0.84 | 15 | good | 0.40 | 10 | 10 | 5 |
| 50 | N.O. | −700 | o.83 | 15 | good | 0.35 | 5 | 10 | 5 |
| 51 | N.O. | −700 | 0.85 | 20 | good | 0.45 | 10 | 15 | 10 |
| 52 | N.O. | −700 | 0.82 | 15 | good | 0.41 | 5 | 10 | 5 |
| 53 | N.O. | −700 | 0.82 | 15 | gaod | 0.41 | 5 | 10 | 5 |
| 54 | N.O. | −700 | 1.08 | 30 | good | 0.30 | 5 | 10 | 10 |
| 55 | N.O. | −700 | 1.09 | 30 | good | 0.22 | 5 | 10 | 15 |
| 56 | N.O. | −700 | 1.12 | 35 | good | 0.30 | 5 | 10 | 20 |
| 57 | N.O. | −700 | 0.81 | 15 | good | 0.32 | 5 | 10 | 5 |
| 58 | N.O. | −700 | 0.83 | 15 | good | 0.32 | 5 | 10 | 5 |
| 59 | N.O. | −700 | 0.85 | 15 | good | 0.33 | 5 | 10 | 5 |
| 60 | N.O. | −700 | 0.89 | 20 | good | 0.33 | 15 | 25 | 5 |
| 61 | N.O. | −700 | 0.92 | 25 | good | 0.32 | 25 | 35 | 15 |
| 62 | N.O. | −700 | 0.82 | 20 | good | 0.35 | 5 | 15 | 10 |
| 63 | N.O. | −700 | 0.86 | 25 | good | 0.39 | 5 | 10 | 10 |
| 64 | N.O. | −700 | 1.09 | 30 | good | 0.31 | 5 | 15 | 15 |
| 65 | N.O. | −700 | 1.11 | 35 | good | 0.32 | 5 | 15 | 15 |

* N.O.: Not observed.

TABLE 5

| Hole-transporting compound used in Examples | |
|---|---|
| Ex. | Compound No. |
| 32 | 144 |
| 33 | 124 |
| 34 | 113 |
| 35 | 112 |
| 36 | 171 |
| 37 | 142 |
| 38 | 143 |
| 39 | 122 |
| 40 | 123 |
| 41 | 141 |
| 42 | 121 |
| 43 | 189 |
| 44 | 190 |
| 45 | 172 |
| 46 | 173 |
| 47 | 176 |
| 48 | 175 |
| 49 | 174 |
| 50 | 185 |
| 51 | 186 |

TABLE 5-continued

| Hole-transporting compound used in Examples | |
|---|---|
| Ex. | Compound No. |
| 52 | 187 |
| 53 | 188 |

TABLE 6

| Electron beam irradiation conditions | | |
|---|---|---|
| Ex. | Acceleration voltage (kV) | Dose (Mrad) |
| 57 | 200 | 20 |
| 58 | 300 | 20 |
| 59 | 150 | 60 |
| 60 | 150 | 120 |
| 61 | 150 | 180 |

COMPARATIVE EXAMPLE 1

Preparation steps were repeated in the same manner as in Example 1 up to the formation of the charge generation layer. Then, a paint for a charge transport layer was prepared by dissolving 15 parts of the styryl compound of formula (E) used in Example 27 and 15 parts of a polymethyl methacrylate resin (Mn=ca. 40,000) having a recurring unit of formula (G) below in a mixture solvent of monochlorobenzene 50 parts/dichloromethane 20 parts, and applied on the charge-generation layer to form a 15 μm-thick charge transport layer, thus obtaining an electrophotographic photosensitive member.

(G)

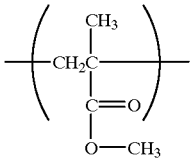

The thus-obtained photosensitive member was evaluated in the same manner as in Example 1. As a result, crystalline precipitation of the styryl compound was observed at the part contacting the cleaning blade of the photosensitive member after storage for 14 hours at 75° C. The electrophotographic performances were good at the initial stage. However, during the durability test, the surface layer abrasion significantly occurred to result in images with noticeable image defects, such as fog and scars. Particularly, after 8000 sheets, the charge-transport layer become thin due to the abrasion, so that the image formation became impossible due to charging failure. The results are summarized in Table 7 together with those of the following Comparative Examples.

COMPARATIVE EXAMPLE 2

An electrophotographic photosensitive member was prepared and evaluated in the same manner as in Comparative Example 1 except for using a paint for the charge transport layer prepared by using the polycarbonate resin (Mn=ca. 20,00) having a recurring unit of the formula (F) used in Example 27 instead of the polymethyl methacrylate resin having a recurring unit of the formula (G). As a result, precipitation was not observed after storage of 14 days but observed after storage of 30 days. The photosensitive member exhibited somewhat better durability than in Comparative Example 1, but still resulted in images accompanied with image defects after the durability test.

COMPARATIVE EXAMPLE 3

An electrophotographic photosensitive member was prepared and evaluated in the same manner as in Comparative Example 2 except for using a paint for the charge transport layer prepared by using 10 parts instead of 15 parts of the styryl compound of the formula (E) together with the 15 parts of the carbonate resin having a recurring unit of the formula (F). The thus-obtained photosensitive member exhibited a somewhat better durability but also exhibited slight decrease in sensitivity and increase in residual potential due to a lower concentration of the charge-transporting material leading to a lower charge-transporting function. As a result, the resultant images were accompanied with ghost.

COMPARATIVE EXAMPLE 4

Preparation steps were repeated in the same manner as in Example 27 up to the formation of the charge transport layer. Then, a paint for a surface protective layer was prepared by dissolving 10 parts of the styryl compound of the formula (E) and 15 parts of the polycarbonate resin having a recurring unit of the formula (F) respectively used in Example 27 in a mixture solvent of monochlorobenzene 50 parts/dichloromethane 30 parts, and applied by spraying onto the above-formed charge transport layer, followed by drying at 120° C. for 1 hour, to form a 5 μm-thick surface protective layer. Compared with Comparative Example 3, the photosensitive member included the charge-transport layer exhibiting a higher charge-transporting performance below the surface layer so that it exhibited only slight sensitivity lowering and residual potential increase and an improved abrasion resistance. However, the images resultant after the durability test were still accompanied with scars/fog, whereby the photosensitive member failed to ensure a sufficient durability.

COMPARATIVE EXAMPLE 5

An electrophotographic photosensitive member was prepared and evaluated in the same manner as in Example 1 except for using a hole-transporting compound of formula (H) below disclosed in JP-A 5-216249 instead of Compound No. 24 to form a charge transport layer. As a result, the photosensitive member exhibited good initial electrophotographic performances, but the durability thereof was substantially inferior to that of Example 1.

(H)

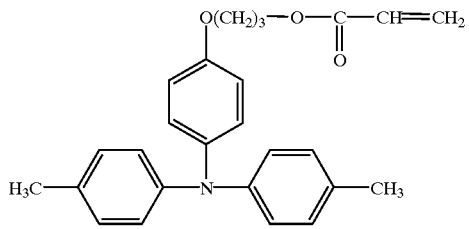

COMPARATIVE EXAMPLE 6

An electrophotographic photosensitive member was prepared and evaluated in the same manner as in Example 19 except for using the hole-transporting compound of the formula (h) used in Comparative Example 5 instead of Compound No. 24 in the paint mixture including 48 parts of Compound No. 24 and 12 parts of the acrylate monomer of the formula (B) used in Example 19. As a result, the photosensitive member exhibited good initial electrophotographic performances, but the durability thereof was substantially inferior to that of Example 19.

COMPARATIVE EXAMPLE 7

Preparation steps were repeated in the same manner as in Example 1 up to the formation of the charge generation layer. Then, a paint for a charge transport layer was prepared by dissolving 20 parts of a polycarbonate resin (Mn=ca. 20,000) represented by formula (I) below and prepared according to a process described in JP-A 8-248649 (at pages 10–11) in 80 parts of tetrahydrofuran and applied onto the charge generation layer, followed by drying, to form a 15 μm-thick charge transport layer, thus obtaining an electrophotographic photosensitive member. The photosensitive member was evaluated in the same manner as in Example 1. As a result, the photosensitive member exhibited improved mechanical strength compared with Comparative Examples 1 and 2 but still failed to ensure a sufficient durability.

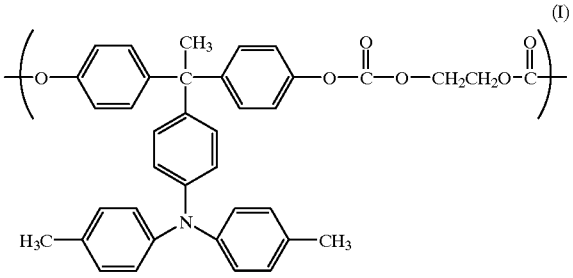

(I)

The results of the above Comparative Examples are inclusively shown in Table 7 below. The following remarks are added for evaluation of the results shown in Table 7.

[Precipitation]

P1: Observed after storage for 14 days at 75° C.

P2: Not observed after 14 days but observed after 30 days at 75° C.

N.O.: Not observed.

[Image (after or during durability test)]

R1: Scars occurred from 1500 sheets, fog occurred from 3000 sheets, and image failure due to charging failure occurred from 8000 sheets.

R2: Scars/fog occurred from 5000 sheets.

R3: Image ghost occurred from the initial stage, and scars/fog occurred from 8000 sheets.

R4, R6 and R7: Scars/fog occurred from 8000 sheets.

R5: Scars/fog occurred from 6000 sheets.

[Abrasion]

Ab1: 15 mm was a value corresponding to after 10,000 sheets based on a value of (12 mm) after 8000 sheets when the durability test was actually terminated.

TABLE 7

| | | Performance evaluation results | | | | | | | |
|---|---|---|---|---|---|---|---|---|---|
| | | Performance | | | | | | | |
| | | | | | After 10000 sheets | | | | |
| | | Initial | | | | | Potential change | | |
| Comp. Ex. | Precipitation * | Vd (V) | Sensitivity ($\mu J/cm^2$) | Vsl (V) | Image | Abrasion ($\mu m$) | ΔVd (V) | ΔVl (V) | ΔVsl (V) |
| 1 | P1 | −700 | 1.50 | −80 | R1 | 15 (Ab1) | — | — | — |
| 2 | P2 | −700 | 1.53 | −90 | R2 | 8 | 30 | 40 | 40 |
| 3 | N.O. | −700 | 2.21 | −120 | R3 | 5 | 20 | 30 | 60 |
| 4 | N.O. | −700 | 1.50 | −70 | R4 | 5 | 20 | 30 | 30 |
| 5 | N.O. | −700 | 1.12 | −35 | R5 | 7 | 30 | 40 | 50 |
| 6 | N.O. | −700 | 1.20 | −50 | R6 | 5 | 30 | 30 | 30 |
| 7 | N.O. | −700 | 1.72 | −70 | R7 | 5 | 20 | 30 | 20 |

Notes to this table are found before this table.

EXAMPLE 66

An electrophotographic photosensitive member was prepared and evaluated in the same manner as in Example 1 except for using Compound No. 213 instead of Compound No. 24 and increasing the electron beam dose to 30 Mrad. The results are shown in Table 8 together with those of the following Examples.

EXAMPLES 67–86

Electrophotographic photosensitive members were prepared and evaluated in the same manner as in Example 66 except for using hole-transporting compounds identified by Compound Nos. shown in Table 9 instead of Compound No. 213.

EXAMPLE 87

An electrophotographic photosensitive member was prepared and evaluated in the same manner as in Example 66 except for using a paint for the charge transport layer prepared by reducing the amount of Compound No. 213 to 48 parts and adding 12 parts of the acrylate monomer of the formula (B) used in Example 19.

EXAMPLE 88

An electrophotographic photosensitive member was prepared and evaluated in the same manner as in Example 66 except for using a paint for the charge transport layer prepared by reducing the amount of Compound No. 213 to 48 parts and adding 12 parts of the acrylate oligomer of the formula (D) used in Example 21.

EXAMPLES 89–93

Electrophotographic photosensitive members were prepared and evaluated in the same manner as in Example 66 except for changing the electron beam irradiation conditions for curing the charge transport layer as shown in Table 10. As a result, all the photosensitive members exhibited good abrasion resistance and good photosensitive member performances after the durability test, but the photosensitive members obtained at increased doses (Examples 92–93) exhibited slight lowering in sensitivity and increase in residual potential as initial electrophotographic performances.

EXAMPLE 94

An electrophotographic photosensitive member was prepared and evaluated in the same manner as in Example 27 except for using Compound No. 213 instead of Compound No. 24 and increasing the dose from 25 Mrad to 30 Mrad for producing the surface protective layer.

EXAMPLE 95

An electrophotographic photosensitive member was prepared and evaluated in the same manner as in Example 94 except for using a paint for the surface protective layer prepared by reducing the amount of Compound No. 213 to 30 parts and adding 30 parts of the acrylate monomer of formula (B) used in Example 19.

EXAMPLE 96

An electrophotographic photosensitive member was prepared and evaluated in the same manner as in Example 94 except for using a paint for the surface protective layer prepared by reducing the amount of Compound No. 213 to 30 parts and adding 30 parts of the acrylate oligomer of formula (D) used in Example 21.

TABLE 8

| Performance evaluation results | | | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 66 | N.O. | −700 | 1.41 | 50 | good | 0.42 | 25 | 25 | 20 |
| 67 | N.O. | −700 | 1.43 | 50 | good | 0.46 | 25 | 25 | 20 |
| 68 | N.O. | −700 | 1.51 | 50 | good | 0.44 | 25 | 25 | 20 |
| 69 | N.O. | −700 | 1.53 | 50 | good | 0.45 | 25 | 30 | 20 |
| 70 | N.O. | −700 | 1.44 | 50 | good | 0.49 | 25 | 25 | 20 |
| 71 | N.O. | −700 | 1.60 | 55 | good | 0.46 | 35 | 35 | 25 |
| 72 | N.O. | −700 | 1.61 | 55 | good | 0.45 | 35 | 35 | 25 |
| 73 | N.O. | −700 | 1.75 | 65 | good | 0.50 | 35 | 40 | 30 |
| 74 | N.O. | −700 | 1.73 | 65 | good | 0.52 | 35 | 40 | 30 |
| 75 | N.O. | −700 | 1.39 | 50 | good | 0.42 | 25 | 25 | 20 |
| 76 | N.O. | −700 | 1.42 | 50 | good | 0.43 | 25 | 25 | 20 |
| 77 | N.O. | −700 | 1.43 | SO | good | 0.41 | 25 | 25 | 25 |
| 78 | N.O. | −700 | 1.42 | 50 | good | 0.61 | 30 | 20 | 35 |
| 79 | N.O. | −700 | 1.44 | 50 | good | 0.65 | 30 | 20 | 35 |
| 80 | N.O. | −700 | 1.45 | 50 | good | 0.54 | 30 | 25 | 20 |
| 81 | N.O. | −700 | 1.43 | 50 | good | 0.68 | 30 | 25 | 35 |
| 82 | N.O. | −700 | 1.41 | 50 | good | 0.41 | 25 | 25 | 20 |
| 83 | N.O. | −700 | 1.39 | 50 | good | 0.46 | 25 | 25 | 20 |
| 84 | N.O. | −700 | 1.42 | 55 | good | 0.50 | 25 | 25 | 20 |
| 85 | N.O. | −700 | 1.45 | 55 | good | 0.52 | 30 | 25 | 20 |
| 86 | N.O. | −700 | 1.43 | 50 | good | 0.53 | 30 | 25 | 20 |
| 87 | N.O. | −700 | 1.52 | 60 | good | 0.44 | 25 | 25 | 30 |
| 88 | N.O. | −700 | 1.52 | 60 | good | 0.43 | 25 | 30 | 30 |
| 89 | N.O. | −700 | 1.41 | 50 | good | 0.40 | 25 | 30 | 20 |
| 90 | N.O. | −700 | 1.42 | 55 | good | 0.42 | 25 | 25 | 20 |
| 91 | N.O. | −700 | 1.45 | 60 | good | 0.41 | 25 | 25 | 25 |
| 92 | N.O. | −700 | 1.52 | 65 | good | 0.42 | 30 | 30 | 25 |
| 93 | N.O. | −700 | 1.56 | 65 | good | 0.45 | 30 | 30 | 30 |
| 94 | N.O. | −700 | 1.39 | 55 | good | 0.42 | 25 | 40 | 30 |
| 95 | N.O. | −700 | 1.42 | 50 | good | 0.49 | 25 | 35 | 30 |
| 96 | N.O. | −700 | 1.51 | 65 | good | 0.40 | 30 | 35 | 20 |
| 97 | N.O. | −700 | 1.53 | 65 | good | 0.42 | 30 | 30 | 20 |

*N.O.: Not observed.

TABLE 9

| Hole-transporting compound used in Examples | |
|---|---|
| Ex. | Compound No. |
| 67 | 227 |
| 68 | 222 |
| 69 | 226 |
| 70 | 234 |
| 71 | 220 |
| 72 | 224 |
| 73 | 221 |
| 74 | 225 |
| 75 | 245 |
| 76 | 244 |
| 77 | 243 |
| 78 | 235 |
| 79 | 236 |
| 80 | 237 |
| 81 | 238 |
| 82 | 239 |
| 83 | 214 |
| 84 | 215 |
| 85 | 216 |
| 86 | 219 |

TABLE 10

| Electron beam irradiation conditions | | |
|---|---|---|
| Ex. | Acceleration voltage (kV) | Dose (Mrad) |
| 89 | 200 | 30 |
| 90 | 300 | 30 |
| 91 | 150 | 80 |
| 92 | 150 | 150 |
| 93 | 150 | 200 |

EXAMPLE 98

An electrophotographic photosensitive member was prepared and evaluated in the same manner as in Example 66 except for using Compound No. 246 instead of Compound No. 213, and changing the electron beam irradiation conditions to an acceleration voltage of 150 kV and a dose of 20 Mrad. The results are shown in Table 11 together with those of the following Examples.

EXAMPLES 99–120

Electrophotographic photosensitive members were prepared and evaluated in the same manner as in Example 98 except for using hole-transporting compounds identified by Compound Nos. shown in Table 12, respectively, instead of Compound No. 246.

EXAMPLE 121

An electrophotographic photosensitive member was prepared and evaluated in the same manner as in Example 98 except for using a paint for the charge transport layer prepared by reducing the amount of Compound No. 246 to 48 parts and adding 12 parts of the acrylate monomer of formula (B) used in Example 19.

EXAMPLE 122

An electrophotographic photosensitive member was prepared and evaluated in the same manner as in Example 101 except for using a paint for the charge transport layer prepared by reducing the amount of Compound No. 269 to 48 parts and adding 12 parts of the acrylate oligomer of formula (C) used in Example 20.

EXAMPLE 123

An electrophotographic photosensitive member was prepared and evaluated in the same manner as in Example 98 except for using a paint for the surface protective layer prepared by reducing the amount of Compound No. 246 to 48 parts and adding 12 parts of the acrylate oligomer of formula (D) used in Example 21.

EXAMPLES 124–128

Electrophotographic photosensitive members were prepared and evaluated in the same manner as in Example 98 except for changing the electron beam irradiation conditions for curing the charge transport layer as shown in Table 13. As a result, all the photosensitive members exhibited good abrasion resistance and good photosensitive member performances after the durability test, but the photosensitive members obtained at increased doses (Examples 127–128) exhibited slight lowering in sensitivity and increase in residual potential as initial electrophotographic performances.

EXAMPLE 129

An electrophotographic photosensitive member was prepared and evaluated in the same manner as in Example 27 except for using Compound No. 246 instead of Compound No. 24 and decreasing the dose of electron beam irradiation from 25 Mrad to 20 Mrad for producing the surface protective layer.

EXAMPLE 130

An electrophotographic photosensitive member was prepared and evaluated in the same manner as in Example 129 except for using Compound No. 291 instead of Compound No. 246.

EXAMPLE 131

An electrophotographic photosensitive member was prepared and evaluated in the same manner as in Example 129 except for using a paint for the surface protective layer prepared by reducing the amount of Compound No. 246 to 30 parts and adding 30 parts of the acrylate monomer of formula (B) used in Example 19.

EXAMPLE 132

An electrophotographic photosensitive member was prepared and evaluated in the same manner as in Example 129 except for using a paint for the surface protective layer prepared by reducing the amount of Compound No. 246 to 30 parts and adding 30 parts of the acrylate oligomer of formula (D) used in Example 21.

TABLE 11

| | | Performance evaluation results | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu J/cm^2$) | Vsl (V) | Image | Abrasion ($\mu m$) | ΔVd (V) | ΔVl (V) | Vsl (V) |
| 98 | N.O. | −700 | 1.18 | 40 | good | 0.36 | 15 | 15 | 15 |
| 99 | N.O. | −700 | 1.20 | 40 | good | 0.37 | 15 | 15 | 15 |
| 100 | N.O. | −700 | 1.17 | 35 | good | 0.36 | 15 | 15 | 10 |
| 101 | N.O. | −700 | 1.12 | 40 | good | 0.21 | 15 | 15 | 15 |
| 102 | N.O. | −700 | 1.19 | 35 | good | 0.39 | 15 | 15 | 15 |
| 103 | N.O. | −700 | 1.26 | 40 | good | 0.38 | 15 | 20 | 15 |
| 104 | N.O. | −700 | 1.25 | 45 | good | 0.38 | 15 | 20 | 15 |
| 105 | N.O. | −700 | 1.34 | 45 | good | 0.39 | 20 | 25 | 20 |
| 106 | N.O. | −700 | 1.35 | 45 | good | 0.39 | 20 | 25 | 20 |
| 107 | N.O. | −700 | 1.34 | 45 | good | 0.40 | 20 | 25 | 20 |
| 108 | N.O. | −700 | 1.36 | 45 | good | 0.40 | 25 | 25 | 20 |
| 109 | N.O. | −700 | 1.19 | 40 | good | 0.35 | 15 | 20 | 15 |
| 110 | N.O. | −700 | 1.17 | 40 | good | 0.36 | 15 | 20 | 15 |
| 111 | N.O. | −700 | 1.22 | 40 | good | 0.36 | 20 | 20 | 20 |
| 112 | N.O. | −700 | 1.17 | 40 | good | 0.65 | 15 | 30 | 25 |
| 113 | N.O. | −700 | 1.19 | 40 | good | 0.64 | 15 | 30 | 25 |
| 114 | N.O. | −700 | 1.19 | 40 | good | 0.40 | 15 | 20 | 15 |
| 115 | N.O. | −700 | 1.18 | 40 | good | 0.59 | 15 | 30 | 25 |
| 116 | N.O. | −700 | 1.18 | 40 | good | 0.36 | 20 | 20 | 15 |
| 117 | N.O. | −700 | 1.17 | 35 | good | 0.38 | 15 | 20 | 20 |
| 118 | N.O. | −700 | 1.18 | 40 | good | 0.40 | 20 | 25 | 25 |

TABLE 11-continued

| Performance evaluation results | | | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 119 | N.O. | −700 | 1.18 | 40 | good | 0.40 | 15 | 20 | 20 |
| 120 | N.O. | −700 | 1.17 | 40 | good | 0.39 | 15 | 20 | 20 |
| 121 | N.O. | −700 | 1.29 | 40 | good | 0.37 | 15 | 20 | 15 |
| 122 | N.O. | −700 | 1.28 | 40 | good | 0.29 | 15 | 20 | 15 |
| 123 | N.O. | −700 | 1.28 | 40 | good | 0.34 | 15 | 15 | 15 |
| 124 | N.O. | −700 | 1.17 | 40 | good | 0.35 | 15 | 20 | 15 |
| 125 | N.O. | −700 | 1.18 | 40 | good | 0.35 | 15 | 20 | 20 |
| 126 | N.O. | −700 | 1.16 | 40 | good | 0.36 | 20 | 20 | 20 |
| 127 | N.O. | −700 | 1.28 | 45 | good | 0.35 | 20 | 25 | 25 |
| 128 | N.O. | −700 | 1.32 | 50 | good | 0.38 | 25 | 30 | 30 |
| 129 | N.O. | −700 | 1.19 | 40 | good | 0.35 | 15 | 20 | 25 |
| 130 | N.O. | −700 | 1.18 | 40 | good | 0.39 | 15 | 20 | 25 |
| 131 | N.O. | −700 | 1.27 | 40 | good | 0.34 | 15 | 20 | 20 |
| 132 | N.O. | −700 | 1.29 | 40 | good | 0.35 | 15 | 25 | 20 |

*N.O.: Not observed.

TABLE 12

| Hole-transporting compound used in Examples | |
|---|---|
| Ex. | Compound No. |
| 99 | 250 |
| 100 | 279 |
| 101 | 269 |
| 102 | 291 |
| 103 | 277 |
| 104 | 321 |
| 105 | 251 |
| 106 | 252 |
| 107 | 322 |
| 108 | 249 |
| 109 | 299 |
| 110 | 298 |
| 111 | 297 |
| 112 | 293 |
| 113 | 294 |
| 114 | 295 |
| 115 | 296 |
| 116 | 292 |
| 117 | 263 |
| 118 | 264 |
| 119 | 266 |
| 120 | 268 |

TABLE 13

| Electron beam irradiation conditions | | |
|---|---|---|
| Ex. | Acceleration voltage (kV) | Dose (Mrad) |
| 124 | 200 | 20 |
| 125 | 300 | 20 |
| 126 | 150 | 50 |
| 127 | 150 | 100 |
| 128 | 150 | 150 |

EXAMPLE 133

An electrophotographic photosensitive member as prepared in the same manner as in Example 1 except that the paint for the charge transport layer was caused to contain 0.6 part of a photopolymerization initiator of formula (J) below and, after being applied onto the charge generation layer, cured by 20 sec of exposure to ultra violet rays at a photointensity of 750 mW/cm$^2$ from a metal halide lamp, thereby forming a 20 $\mu$m-thick charge transport layer to obtain a photosensitive member. The photosensitive member was evaluated in the same manner as in Example 1. The results are summarized in Table 14 together with those of the following Examples.

(J)

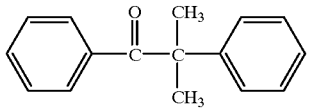

EXAMPLES 134–142

Electrophotographic photosensitive members were prepared and evaluated in the same manner as in Example 133 except for using hole-transporting compounds identified by Compound Nos. shown in Table 15 instead of Compound No. 24.

EXAMPLES 143–145

Electrophotographic photosensitive members were prepared and evaluated in the same manner as in Example 133 except for using Compound Nos. 29, 30 and 56, respectively, instead of Compound No. 24 and a photopolymerization initiator of formula (K) below instead of the formula (J).

(K)

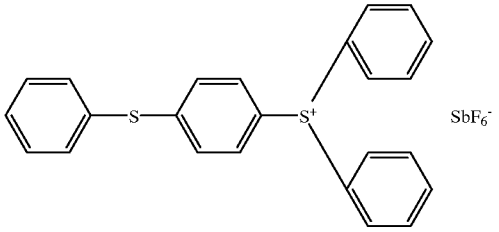

EXAMPLE 146

An electrophotographic photosensitive member was prepared and evaluated in the same manner as in Example 133 except for using Compound No. 17 instead of Compound No. 24 and further using 0.3 part of the photopolymerization initiator of formula (J) and 0.3 part of the photopolymerization initiator of formula (K) instead of the 0.6 part of the photopolymerization initiator of the formula (J).

EXAMPLE 147

An electrophotographic photosensitive member was prepared and evaluated in the same manner as in Example 133 except for using a thermal polymerization initiator of formula (L) below instead of the photo-polymerization initiator of the formula (J) and curing the charge transport layer by thermal curing at 40° C. for 1 hour.

(L)

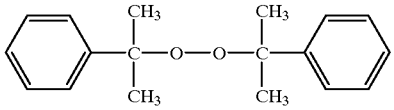

EXAMPLES 148 and 149

Electrophotographic photosensitive members were prepared and evaluated in the same manner as in Example 147 except for using Compound Nos. 55 and 57, respectively, instead of Compound No. 24.

EXAMPLE 150

An electrophotographic photosensitive member was prepared and evaluated in the same manner as in Example 133 except for using a paint for the charge transport layer prepared by reducing the amount of Compound No. 24 to 48 parts and adding 12 parts of the acrylate monomer of the formula (B) used in Example 19.

EXAMPLE 151

An electrophotographic photosensitive member was prepared and evaluated in the same manner as in Example 143 except for using a paint for the charge transport layer prepared by reducing the amount of Compound No. 29 to 48 parts and adding 12 parts of an epoxy monomer of formula (M) below:

(M)

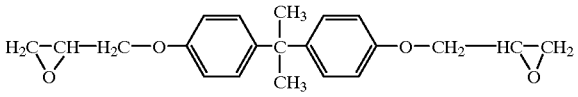

EXAMPLE 152

An electrophotographic photosensitive member was prepared and evaluated in the same manner as in Example 133 except for using a paint for the charge transport layer prepared by reducing the amount of Compound No. 24 to 48 parts and adding 12 parts of the acrylate oligomer of the formula (D) used in Example 21.

EXAMPLE 153

An electrophotographic photosensitive member was prepared and evaluated in the same manner as in Example 147 except for using a paint for the charge transport layer prepared by reducing the amount of Compound No. 24 to 48 parts and adding 12 parts of the acrylate monomer of the formula (B) used in Example 19.

EXAMPLE 154

An electrophotographic photosensitive member was prepared in the same manner as in Example 27 except that the paint for the surface protective layer was caused to contain 0.6 part of the photopolymerization initiator of formula (J) used in Example 133 and, after being applied onto the charge generation layer, cured by 20 sec of exposure to ultra violet rays at a photointensity of 750 mW/cm$^2$ from a metal halide lamp, thereby forming a 20 $\mu$m-thick charge transport layer to obtain a photosensitive member. The photosensitive member was evaluated in the same manner as in Example 1.

EXAMPLE 155

An electrophotographic photosensitive member was prepared and evaluated in the same manner as in Example 154 except for using Compound No. 29 instead of Compound No. 24 and the photoinitiator of the formula (K) instead of the formula (J) for forming the surface protective layer.

EXAMPLE 156

An electrophotographic photosensitive member was prepared and evaluated in the same manner as in Example 154 except for using a paint for the surface protective layer prepared by reducing the amount of Compound No. 24 to 30 parts and adding 30 parts of the acrylate monomer of formula (B) used in Example 19.

EXAMPLE 157

An electrophotographic photosensitive member was prepared and evaluated in the same manner as in Example 155 except for using a paint for the surface protective layer prepared by reducing the amount of Compound No. 29 to 30 parts and adding 30 parts of the epoxy monomer of formula (M) used in Example 151.

EXAMPLE 158

An electrophotographic photosensitive member was prepared and evaluated in the same manner as in Example 156 except for using the acrylate oligomer of formula (D) used in Example 21 instead of the acrylate monomer of the formula (B).

TABLE 14

| Performance evaluation results | | | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 133 | N.O. | −700 | 1.65 | 60 | good | 0.58 | 10 | 10 | 10 |
| 134 | N.O. | −700 | 1.68 | 55 | good | 0.42 | 10 | 10 | 15 |
| 135 | N.O. | −700 | 1.68 | 60 | good | 0.59 | 10 | 10 | 10 |
| 136 | N.O. | −700 | 1.66 | 70 | good | 0.59 | 10 | 10 | 10 |
| 137 | N.O. | −700 | 1.73 | 80 | good | 0.62 | 10 | 10 | 10 |
| 138 | N.O. | −700 | 1.69 | 70 | good | 0.69 | 10 | 10 | 15 |
| 139 | N.O. | −700 | 2.28 | 75 | good | 0.60 | 20 | 15 | 20 |
| 140 | N.O. | −700 | 2.60 | 90 | good | 0.62 | 30 | 20 | 30 |
| 141 | N.O. | −700 | 2.59 | 90 | good | 0.62 | 30 | 25 | 30 |
| 142 | N.O. | −700 | 1.69 | 70 | good | 0.63 | 10 | 10 | 20 |
| 143 | N.O. | −700 | 2.45 | 95 | good | 0.65 | 30 | 20 | 35 |
| 144 | N.O. | −700 | 2.47 | 95 | good | 0.65 | 30 | 20 | 35 |
| 145 | N.O. | −700 | 2.39 | 90 | good | 0.66 | 30 | 25 | 30 |
| 146 | N.O. | −700 | 2.19 | 85 | good | 0.62 | 25 | 20 | 30 |
| 147 | N.O. | −700 | 1.69 | 75 | good | 0.59 | 10 | 10 | 20 |
| 148 | N.O. | −700 | 1.67 | 75 | good | 0.61 | 10 | 10 | 20 |
| 149 | N.O. | −700 | 1.70 | 75 | good | 0.61 | 10 | 10 | 20 |
| 150 | N.O. | −700 | 2.05 | 85 | good | 0.58 | 20 | 20 | 25 |
| 151 | N.O. | −700 | 2.69 | 95 | good | 0.65 | 30 | 25 | 30 |
| 152 | N.O. | −700 | 2.00 | 70 | good | 0.59 | 20 | 15 | 20 |
| 153 | N.O. | −700 | 1.99 | 70 | good | 0.58 | 20 | 20 | 20 |
| 154 | N.O. | −700 | 1.63 | 60 | good | 0.59 | 10 | 10 | 15 |
| 155 | N.O. | −700 | 2.22 | 80 | good | 0.66 | 25 | 25 | 30 |
| 156 | N.O. | −700 | 1.82 | 65 | good | 0.58 | 10 | 10 | 15 |
| 157 | N.O. | −700 | 2.50 | 80 | good | 0.64 | 30 | 30 | 30 |
| 158 | N.O. | −700 | 1.72 | 70 | good | 0.57 | 10 | 10 | 15 |

*N.O.: Not observed.

TABLE 15

| Hole-transporting compounds used in Examples | |
|---|---|
| Ex. | Compound No. |
| 134 | 25 |
| 135 | 10 |
| 136 | 78 |
| 137 | 77 |
| 138 | 28 |
| 139 | 20 |
| 140 | 4 |
| 141 | 76 |
| 142 | 16 |
| 143 | 29 |
| 144 | 30 |
| 145 | 56 |

EXAMPLE 159

An electrophotographic photosensitive member was prepared and evaluated in the same manner as in Example 133 except for using Compound No. 170 instead of Compound No. 24 in the paint for the charge transport layer cured by photoirradiation. The results are summarized in Table 16 together with those of the following Examples.

EXAMPLES 160–171

Electrophotographic photosensitive members were prepared and evaluated in the same manner as in Example 159 except for using hole-transporting compounds identified by Compound Nos. shown in Table 17 instead of Compound No. 170.

EXAMPLE 172–174

Electrophotographic photosensitive members were prepared and evaluated in the same manner as in Example 133 except for using Compound Nos. 172, 173 and 175, respectively, instead of Compound No. 170 and the photopolymerization initiator of the formula (K) used in Example 143, etc. instead of the formula (J).

EXAMPLE 175

An electrophotographic photosensitive member was prepared and evaluated in the same manner as in Example 159 except for using Compound No. 186 instead of Compound No. 170 and further using 0.3 part of the photopolymerization initiator of formula (J) and 0.3 part of the photopolymerization initiator of formula (K) instead of the 0.6 part of the photopolymerization initiator (J).

EXAMPLE 176

An electrophotographic photosensitive member was prepared and evaluated in the same manner as in Example 133 except for using the thermal polymerization initiator of the formula (L) used in Example 147 instead of the photopolymerization initiator of the formula (J) and curing the charge transport layer by thermal curing at 140° C. for 1 hour.

EXAMPLES 177 and 178

Electrophotographic photosensitive members were prepared and evaluated in the same manner as in Example 176 except for using Compound Nos. 174 and 176, respectively, instead of Compound No. 170.

EXAMPLE 179

An electrophotographic photosensitive member was prepared and evaluated in the same manner as in Example 159 except for using a paint for the charge transport layer prepared by reducing the amount of Compound No. 170 to 48 parts and adding 12 parts of the acrylate monomer of the formula (B) used in Example 19.

EXAMPLE 180

An electrophotographic photosensitive member was prepared and evaluated in the same manner as in Example 172 except for using a paint for the charge transport layer prepared by reducing the amount of Compound No. 172 to 48 parts and adding 12 parts of the epoxy monomer of the formula (M) used in Example 151.

EXAMPLE 181

An electrophotographic photosensitive member was prepared and evaluated in the same manner as in Example 159 except for using a paint for the charge transport layer prepared by reducing the amount of Compound No. 170 to 48 parts and adding 12 parts of the acrylate oligomer of the formula (D) used in Example 21.

EXAMPLE 182

An electrophotographic photosensitive member was prepared and evaluated in the same manner as in Example 176 except for using a paint for the charge transport layer prepared by reducing the amount of Compound No. 170 to 48 parts and adding 12 parts of the acrylate monomer of the formula (B) used in Example 19.

EXAMPLE 183

An electrophotographic photosensitive member was prepared in the same manner as in Example 62 except that the paint for the surface protective layer was caused to contain 0.6 part of the photopolymerization initiator of formula (J) used in Example 133 and, after being applied onto the charge transport layer, cured by 20 sec of exposure to ultra violet rays at a photointensity of 750 mW/cm$^2$ from a metal halide lamp, thereby forming a 5 $\mu$m-thick surface protective layer to obtain a photosensitive member. The photosensitive member was evaluated in the same manner as in Example 1.

EXAMPLE 184

An electrophotographic photosensitive member was prepared and evaluated in the same manner as in Example 183 except for using Compound No. 29 instead of Compound No. 170 and the photoinitiator of the formula (K) instead of the formula (J) for forming the surface protective layer.

EXAMPLE 185

An electrophotographic photosensitive member was prepared and evaluated in the same manner as in Example 179 except for using a paint for the charge transport layer prepared by reducing the amount of Compound No. 170 to 30 parts and adding 30 parts of the acrylate monomer of formula (B) used in Example 19.

EXAMPLE 186

An electrophotographic photosensitive member was prepared and evaluated in the same manner as in Example 180 except for using a paint for the charge transport layer prepared by reducing the amount of Compound No. 172 to 30 parts and adding 30 parts of the epoxy monomer of formula (M) used in Example 151.

EXAMPLE 187

An electrophotographic photosensitive member was prepared and evaluated in the same manner as in Example 186 except for using the acrylate oligomer of formula (D) used in Example 21 instead of the acrylate monomer of the formula (B).

TABLE 16

| | | Performance evaluation results | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 159 | N.O. | −700 | 1.68 | 70 | good | 0.59 | 5 | 10 | 10 |
| 160 | N.O. | −700 | 1.73 | 70 | good | 0.57 | 5 | 10 | 10 |
| 161 | N.O. | −700 | 1.70 | 65 | good | 0.55 | 5 | 10 | 10 |
| 162 | N.O. | −700 | 1.71 | 75 | good | 0.58 | 5 | 10 | 10 |
| 163 | N.O. | −700 | 1.69 | 70 | good | 0.40 | 5 | 10 | 10 |
| 164 | N.O. | −700 | 1.68 | 70 | good | 0.65 | 5 | 10 | 10 |
| 165 | N.O. | −700 | 2.35 | 90 | good | 0.58 | 10 | 10 | 15 |
| 166 | N.O. | −700 | 2.35 | 90 | good | 0.57 | 10 | 10 | 15 |
| 167 | N.O. | −700 | 2.62 | 95 | good | 0.59 | 25 | 20 | 30 |
| 168 | N.O. | −700 | 2.55 | 95 | good | 0.60 | 25 | 20 | 30 |
| 169 | N.O. | −700 | 2.25 | 95 | good | 0.57 | 15 | 10 | 15 |
| 170 | N.O. | −700 | 2.18 | 90 | good | 0.58 | 15 | 10 | 15 |
| 171 | N.O. | −700 | 1.71 | 70 | good | 0.60 | 5 | 10 | 15 |
| 172 | N.O. | −700 | 2.56 | 95 | good | 0.65 | 25 | 25 | 20 |
| 173 | N.O. | −700 | 2.61 | 95 | good | 0.63 | 25 | 25 | 20 |
| 174 | N.O. | −700 | 2.58 | 95 | good | 0.63 | 25 | 25 | 20 |
| 175 | N.O. | −700 | 2.40 | 90 | good | 0.59 | 20 | 15 | 20 |
| 176 | N.O. | −700 | 1.72 | 70 | good | 0.57 | 5 | 15 | 10 |
| 177 | N.O. | −700 | 1.72 | 70 | good | 0.58 | 5 | 15 | 10 |

TABLE 16-continued

| Performance evaluation results | | | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 176 | N.O. | −700 | 1.69 | 70 | good | 0.58 | 5 | 15 | 10 |
| 179 | N.O. | −700 | 1.99 | 80 | good | 0.53 | 15 | 15 | 15 |
| 180 | N.O. | −700 | 2.80 | 95 | good | 0.59 | 30 | 25 | 25 |
| 181 | N.O. | −700 | 1.92 | 75 | good | 0.51 | 15 | 15 | 10 |
| 182 | N.O. | −700 | 1.93 | 75 | good | 0.55 | 15 | 15 | 10 |
| 183 | N.O. | −700 | 1.70 | 65 | good | 0.59 | 5 | 10 | 10 |
| 184 | N.O. | −700 | 2.35 | 90 | good | 0.65 | 20 | 25 | 25 |
| 185 | N.O. | −700 | 1.80 | 75 | good | 0.50 | 5 | 10 | 10 |
| 186 | N.O. | −700 | 2.59 | 95 | good | 0.61 | 25 | 30 | 20 |
| 187 | N.O. | −700 | 1.75 | 70 | good | 0.49 | 5 | 15 | 10 |

*N.O.: Not observed.

TABLE 17

| Hole-transporting compounds used in Examples | |
|---|---|
| Ex. | Compound No. |
| 160 | 144 |
| 161 | 124 |
| 162 | 113 |
| 163 | 112 |
| 164 | 171 |
| 165 | 142 |
| 166 | 122 |
| 167 | 141 |
| 168 | 121 |
| 169 | 189 |
| 170 | 190 |
| 171 | 185 |
| 172 | 172 |
| 173 | 173 |
| 174 | 175 |

COMPARATIVE EXAMPLE 8

An electrophotographic photosensitive member was prepared and evaluated in the same manner as in Example 133 except for using the hole-transporting compound of formula (H) used in Comparative Example 5 and disclosed in JP-A 5-216249 instead of Compound No. 24 to form a charge transport layer. As a result, the photosensitive member exhibited good initial electrophotographic performances, but the durability thereof was substantially inferior to that of Example 133.

The results are summarized in Table 18 together with those of the following Comparative Examples.

COMPARATIVE EXAMPLE 9

An electrophotographic photosensitive member was prepared and evaluated in the same manner as in Example 153 except for using the hole-transporting of the formula (h) used in Comparative Example 9 instead of Compound No. 24 in the paint mixture including 48 parts of Compound No. 24 and 12 parts of the acrylate monomer of the formula (B) used in Example 19. As a result, the photosensitive member exhibited good initial electrophotographic performances, but the durability thereof was substantially inferior to that of Example 153.

[Precipitation]

N.O.: Not observed.

[Image (after or during durability test)]

R8: Scars/fog occurred from 5000 sheets.

R9: scars/fog occurred from 7000 sheets.

TABLE 18

| Performance evaluation results in Comparative Examples | | | | | | | | | |
|---|---|---|---|---|---|---|---|---|---|
| | | Performance | | | | | | | |
| | | | | | After 10000 sheets | | | | |
| | | Initial | | | | | Potential change | | |
| Comp. Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 8 | N.O. | −700 | 1.12 | −35 | R8 | 8.5 | 30 | 40 | 50 |
| 9 | N.O. | −700 | 1.20 | −50 | R9 | 6 | 30 | 30 | 30 |

Notes to this table are found before this table.

EXAMPLE 188

An electrophotographic photosensitive member was prepared in the same manner as in Example 66 except that the paint for the charge transport layer was caused to contain 0.6 part of the photopolymerization initiator of the formula (J) used in Example 133 and, after being applied onto the charge generation layer, cured by 20 sec of exposure to ultra violet rays at a photointensity of 750 mW/cm$^2$ from a metal halide lamp, thereby forming a 20 $\mu$m-thick charge transport layer to obtain a photosensitive member. The photosensitive member was evaluated in the same manner as in Example 66. The results are summarized in Table 19 together with those of the following Examples.

EXAMPLES 189–198

Electrophotographic photosensitive members were prepared and evaluated in the same manner as in Example 188 except for using hole-transporting compounds identified by Compound Nos. shown in Table 20 instead of Compound No. 213.

EXAMPLES 199–201

Electrophotographic photosensitive members were prepared and evaluated in the same manner as in Example 188 except for using Compound Nos. 235, 236 and 238, respectively, instead of Compound No. 213 and the photopolymerization initiator of the formula (K) used in Example 143 instead of the formula (J).

EXAMPLE 202

An electrophotographic photosensitive member was prepared and evaluated in the same manner as in Example 188 except for using Compound No. 215 instead of Compound No. 213 and further using 0.3 part of the photopolymerization initiator of formula (J) and 0.3 part of the photopolymerization initiator of formula (K) instead of the 0.6 part of the photopolymerization initiator (J).

EXAMPLE 203

An electrophotographic photosensitive member was prepared and evaluated in the same manner as in Example 188 except for using the thermal polymerization initiator of formula (L) used in Example 147 instead of the photopolymerization initiator of the formula (J) and curing the charge transport layer by thermal curing at 140° C. for 1 hour.

EXAMPLES 204 and 205

Electrophotographic photosensitive members were prepared and evaluated in the same manner as in Example 203 except for using Compound Nos. 239 and 237, respectively, instead of Compound No. 213.

EXAMPLE 206

An electrophotographic photosensitive member was prepared and evaluated in the same manner as in Example 188 except for using a paint for the charge transport layer prepared by reducing the amount of Compound No. 213 to 48 parts and adding 12 parts of the acrylate monomer of the formula (B) used in Example 19.

EXAMPLE 207

An electrophotographic photosensitive member was prepared and evaluated in the same manner as in Example 199 except for using a paint for the charge transport layer prepared by reducing the amount of Compound No. 235 to 48 parts and adding 12 parts of the epoxy monomer of formula (M) used in Example.

EXAMPLE 208

An electrophotographic photosensitive member was prepared and evaluated in the same manner as in Example 188 except for using a paint for the charge transport layer prepared by reducing the amount of Compound No. 213 to 48 parts and adding 12 parts of the acrylate oligomer of the formula (D) used in Example 21.

EXAMPLE 209

An electrophotographic photosensitive member was prepared and evaluated in the same manner as in Example 203 except for using a paint for the charge transport layer prepared by reducing the amount of Compound No. 213 to 48 parts and adding 12 parts of the acrylate monomer of the formula (B) used in Example 19.

EXAMPLE 210

An electrophotographic photosensitive member was prepared in the same manner as in Example 94 except that the paint for the surface protective layer was caused to contain 0.6 part of the photopolymerization initiator of formula (J) used in Example 133 and, after being applied onto the charge generation layer, cured by 20 sec of exposure to ultra violet rays at a photointensity of 750 mW/cm$^2$ from a metal halide lamp, thereby forming a 5 $\mu$m-thick surface protective layer to obtain a photosensitive member. The photosensitive member was evaluated in the same manner as in Example 94.

EXAMPLE 211

An electrophotographic photosensitive member was prepared and evaluated in the same manner as in Example 210 except for using Compound No. 235 instead of Compound No. 213 and the photoinitiator of the formula (K) instead of the formula (J) for forming the surface protective layer.

EXAMPLE 212

An electrophotographic photosensitive member was prepared and evaluated in the same manner as in Example 210 except for using a paint for the surface protective layer prepared by reducing the amount of Compound No. 213 to 30 parts and adding 30 parts of the acrylate monomer of formula (B) used in Example 19.

EXAMPLE 213

An electrophotographic photosensitive member was prepared and evaluated in the same manner as in Example 211 except for using a paint for the surface protective layer prepared by reducing the amount of Compound No. 235 to 30 parts and adding 30 parts of the epoxy monomer of formula (M) used in Example 151.

EXAMPLE 214

An electrophotographic photosensitive member was prepared and evaluated in the same manner as in Example 212 except for using the acrylate oligomer of formula (D) used in Example 21 instead of the acrylate monomer of the formula (B).

TABLE 19

| Performance evaluation results | | | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 188 | N.O. | −700 | 2.32 | 95 | good | 0.68 | 20 | 20 | 25 |
| 189 | N.O. | −700 | 2.25 | 95 | good | 0.72 | 20 | 20 | 25 |
| 190 | N.O. | −700 | 2.30 | 95 | good | 0.71 | 20 | 20 | 25 |
| 191 | N.O. | −700 | 2.31 | 95 | good | 0.69 | 20 | 20 | 30 |
| 192 | N.O. | −700 | 2.31 | 95 | good | 0.76 | 20 | 20 | 25 |
| 193 | N.O. | −700 | 2.42 | 100 | good | 0.72 | 30 | 30 | 35 |
| 194 | N.O. | −700 | 2.45 | 100 | good | 0.72 | 40 | 40 | 30 |
| 195 | N.O. | −700 | 2.29 | 95 | good | 0.68 | 20 | 25 | 25 |
| 195 | N.O. | −700 | 2.28 | 95 | good | 0.65 | 20 | 20 | 20 |
| 197 | N.O. | −700 | 2.35 | 100 | good | 0.66 | 20 | 25 | 25 |
| 198 | N.O. | −700 | 2.30 | 85 | good | 0.71 | 20 | 20 | 25 |
| 199 | N.O. | −700 | 2.49 | 110 | good | 0.75 | 30 | 30 | 30 |
| 200 | N.O. | −700 | 2.50 | 105 | good | 0.73 | 30 | 30 | 30 |
| 201 | N.O. | −700 | 2.48 | 110 | good | 0.78 | 30 | 30 | 30 |
| 202 | N.O. | −700 | 2.50 | 110 | good | 0.72 | 20 | 20 | 20 |
| 203 | N.O. | −700 | 2.31 | 90 | good | 0.67 | 15 | 20 | 25 |
| 204 | N.O. | −700 | 2.32 | 90 | good | 0.71 | 15 | 20 | 25 |
| 205 | N.O. | −700 | 2.32 | 95 | good | 0.58 | 15 | 20 | 20 |
| 206 | N.O. | −700 | 2.31 | 95 | good | 0.68 | 20 | 25 | 25 |
| 207 | N.O. | −700 | 2.55 | 110 | good | 0.75 | 30 | 35 | 35 |
| 208 | N.O. | −700 | 2.42 | 100 | good | 0.69 | 20 | 25 | 20 |
| 209 | N.O. | −700 | 2.41 | 100 | good | 0.68 | 20 | 25 | 15 |
| 210 | N.O. | −700 | 2.44 | 90 | good | 0.70 | 20 | 20 | 20 |
| 211 | N.O. | −700 | 2.50 | 100 | good | 0.74 | 30 | 30 | 35 |
| 212 | N.O. | −700 | 2.39 | 90 | good | 0.67 | 20 | 25 | 25 |
| 213 | N.O. | −700 | 2.56 | 105 | good | 0.72 | 35 | 35 | 35 |
| 214 | N.O. | −700 | 2.42 | 95 | good | 0.69 | 20 | 25 | 20 |

*N.O.: Not observed.

TABLE 20

| Hole-transporting compounds used in Examples | |
|---|---|
| Ex. | Compound No. |
| 188 | 213 |
| 189 | 227 |
| 190 | 222 |
| 191 | 226 |
| 192 | 234 |
| 193 | 220 |
| 194 | 221 |
| 195 | 245 |
| 196 | 244 |
| 197 | 243 |
| 198 | 214 |
| 199 | 235 |
| 200 | 236 |
| 201 | 238 |

EXAMPLE 215

An electrophotographic photosensitive member was prepared and evaluated in the same manner as in Example 188 except for using Compound No. 246 instead of Compound No. 213 in the paint for the charge transport layer cured by photoirradiation. The results are summarized in Table 21 together with those of the following Examples.

EXAMPLES 216–225

Electrophotographic photosensitive members were prepared and evaluated in the same manner as in Example 215 except for using hole-transporting compounds identified by Compound Nos. shown in Table 22 instead of Compound No. 246.

EXAMPLES 226–228

Electrophotographic photosensitive members were prepared and evaluated in the same manner as in Example 215 except for using Compound Nos. 293, 294 and 296, respectively, instead of Compound No. 246 and the photopolymeization initiator of the formula (K) used in Example 143, etc. instead of the formula (J).

EXAMPLE 229

An electrophotographic photosensitive member was prepared and evaluated in the same manner as in Example 215 except for using Compound No. 264 instead of Compound No. 246 and. further using 0.3 part of the photopolymerization initiator of formula (J) and 0.3 part of the photopolymerization initiator of formula (K) instead of the 0.6 part of the photopolymerization initiator (J).

EXAMPLE 230

An electrophotographic photosensitive member was prepared and evaluated in the same manner as in Example 215 except for using the thermal polymerization initiator of the formula (L) used in Example 147 instead of the photopolymerization initiator of the formula (J) and curing the charge transport layer by thermal curing at 140° C. for 1 hour.

EXAMPLES 231 and 232

Electrophotographic photosensitive members were prepared and evaluated in the same manner as in Example 230 except for using Compound Nos. 292 and 295, respectively, instead of Compound No. 246.

EXAMPLE 233

An electrophotographic photosensitive member was prepared and evaluated in the same manner as in Example 215 except for using a paint for the charge transport layer prepared by reducing the amount of Compound No. 246 to 48 parts and adding 12 parts of the acrylate monomer of the formula (B) used in Example 19.

EXAMPLE 234

An electrophotographic photosensitive member was prepared and evaluated in the same manner as in Example 226 except for using a paint for the charge transport layer prepared by reducing the amount of Compound No. 293 to 48 parts and adding 12 parts of the epoxy monomer of the formula (M) used in Example 151.

EXAMPLE 235

An electrophotographic photosensitive member was prepared and evaluated in the same manner as in Example 215 except for using a paint for the charge transport layer prepared by reducing the amount of Compound No. 246 to 48 parts and adding 12 parts of the acrylate oligomer of the formula (D) used in Example 21.

EXAMPLE 236

An electrophotographic photosensitive member was prepared and evaluated in the same manner as in Example 230 except for using a paint for the charge transport layer prepared by reducing the amount of Compound No. 246 to 48 parts and adding 12 parts of the acrylate monomer of the formula (B) used in Example 19.

EXAMPLE 237

An electrophotographic photosensitive member was prepared in the same manner as in Example 129 except that the paint for the surface protective layer was caused to contain 0.6 part of the photopolymerization initiator of formula (J) used in Example 133 and, after being applied onto the charge generation layer, cured by 20 sac of exposure ultra violet rays at a photointensity of 750 mW/cm$^2$ from a metal halide lamp, thereby forming a 20 $\mu$m-thick surface protective layer to obtain a photosensitive member. The photosensitive member was evaluated in the same manner as in Example 1.

EXAMPLE 238

An electrophotographic photosensitive member was prepared and evaluated in the same manner as in Example 237 except for using Compound No. 293 instead of Compound No. 246 and the photoinitiator of the formula (K) instead of the formula (J) for forming the surface protective layer.

EXAMPLE 239

An electrophotographic photosensitive member was prepared and evaluated in the same manner as in Example 237 except for using a paint for the surface protective layer prepared by reducing the amount of Compound No. 246 to 30 parts and adding 30 parts of the acrylate monomer of formula (B) used in Example 19.

EXAMPLE 240

An electrophotographic photosensitive member was prepared and evaluated in the same manner as in Example 238 except for using a paint for the surface protective layer prepared by reducing the amount of Compound No. 293 to 30 parts and adding 30 parts of the epoxy monomer of formula (M) used in Example 151.

EXAMPLE 241

An electrophotographic photosensitive member was prepared and evaluated in the same manner as in Example 289 except for using the acrylate oligomer of formula (D) used in Example 21 instead of the acrylate monomer of the formula (B).

TABLE 21

| | | Performance evaluation results | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 215 | N.O. | −700 | 2.05 | 90 | good | 0.56 | 10 | 20 | 20 |
| 216 | N.O. | −700 | 2.03 | 90 | good | 0.64 | 10 | 20 | 20 |
| 217 | N.O. | −700 | 2.05 | 90 | good | 0.62 | 10 | 20 | 20 |
| 218 | N.O. | −700 | 2.09 | 90 | good | 0.35 | 10 | 20 | 20 |
| 219 | N.O. | −700 | 2.11 | 85 | good | 0.30 | 10 | 20 | 20 |
| 220 | N.O. | −700 | 2.25 | 95 | good | 0.72 | 20 | 25 | 30 |
| 221 | N.O. | −700 | 2.42 | 105 | good | 0.62 | 30 | 30 | 40 |
| 222 | N.O. | −700 | 2.08 | 90 | good | 0.52 | 10 | 20 | 20 |
| 223 | N.O. | −700 | 2.10 | 90 | good | 0.61 | 10 | 20 | 20 |
| 224 | N.O. | −700 | 2.15 | 95 | good | 0.62 | 20 | 25 | 30 |
| 225 | N.O. | −700 | 2.09 | 90 | good | 0.58 | 10 | 20 | 20 |
| 226 | N.O. | −700 | 2.66 | 105 | good | 0.61 | 30 | 35 | 40 |
| 227 | N.O. | −700 | 2.69 | 105 | good | 0.64 | 30 | 35 | 40 |
| 228 | N.O. | −700 | 2.59 | 110 | good | 0.63 | 30 | 35 | 40 |
| 229 | N.O. | −700 | 2.68 | 105 | good | 0.50 | 30 | 35 | 40 |
| 230 | N.O. | −700 | 2.00 | 90 | good | 0.51 | 10 | 15 | 20 |

TABLE 21-continued

| Performance evaluation results | | | | | | | | | |
|---|---|---|---|---|---|---|---|---|---|
| | | Performance | | | | | | | |
| | | | | | After 10000 sheets | | | | |
| | | Initial | | | | | Potential change | | |
| Ex. | Precipitation * | Vd (V) | Sensitivity ($\mu$J/cm$^2$) | Vsl (V) | Image | Abrasion ($\mu$m) | ΔVd (V) | ΔVl (V) | Vsl (V) |
| 231 | N.O. | −700 | 2.08 | 90 | good | 0.53 | 10 | 15 | 20 |
| 232 | N.O. | −700 | 2.06 | 90 | good | 0.54 | 10 | 15 | 20 |
| 233 | N.O. | −700 | 2.18 | 95 | good | 0.49 | 20 | 20 | 30 |
| 234 | N.O. | −700 | 2.79 | 105 | good | 0.52 | 35 | 40 | 45 |
| 235 | N.O. | −700 | 2.21 | 95 | good | 0.47 | 20 | 20 | 20 |
| 236 | N.O. | −700 | 2.23 | 95 | good | 0.50 | 20 | 20 | 30 |
| 237 | N.O. | −700 | 2.10 | 90 | good | 0.55 | 10 | 20 | 20 |
| 238 | N.O. | −700 | 2.59 | 100 | good | 0.61 | 20 | 30 | 35 |
| 239 | N.O. | −700 | 2.09 | 95 | good | 0.40 | 15 | 20 | 20 |
| 240 | N.O. | −700 | 2.58 | 105 | good | 0.48 | 30 | 30 | 40 |
| 241 | N.O. | −700 | 2.09 | 90 | good | 0.40 | 15 | 20 | 20 |

*N.O.: Not observed.

TABLE 22

| Hole-transporting compounds used in Examples | |
|---|---|
| Ex. | Compound No. |
| 215 | 246 |
| 216 | 250 |
| 217 | 279 |
| 218 | 269 |
| 219 | 291 |
| 220 | 277 |
| 221 | 251 |
| 222 | 299 |
| 223 | 298 |
| 224 | 297 |
| 225 | 263 |
| 226 | 293 |
| 227 | 294 |
| 228 | 296 |

What is claimed is:

1. An electrophotographic photosensitive member, comprising:

an electroconductive support and a photosensitive layer disposed on the electroconductive support;

wherein the photosensitive layer comprises a polymerizate of a hole-transporting compound having at least two chain polymerization function groups in its molecule represented by formula (1) below:

$$(P^1)_a A\text{-}(Z\text{—}(P^2)_d)_b \quad (1),$$

wherein A denotes a hole-transporting group, $P^1$ and $P^2$ independently denote a chain polymerization function group and Z denotes a bonding organic group;

a and b and d are independently an integer of at least 0 satisfying $a+b\times d\geqq 2$ provided that if $a\geqq 2$, plural groups $P^1$ can be identical or different;

if $b\geqq 2$, plural groups Z can be identical or different; and if $b\times d\geqq 2$, plural groups $P^2$ can be identical or different; and the hole-transporting group A is such that a combination of A with a number (a+b) of hydrogen atoms instead of $(P^1)_a$ and $-(Z\text{—}(P^2)_d)_b$ as in the formula (1) would provide a hole-transporting compound that is a compound represented by a formula selected from formulae (4) and (6), or a condensed cyclic hydrocarbon compound or condensed heterocyclic compound having a group represented by formula (5) below:

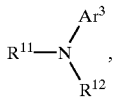

(4)

wherein $R^{11}$ and $R^{12}$ independently denote an alkyl group, aralkyl group or aryl group each capable of having a substituent; and $Ar^3$ denotes an aryl group capable of having a substituent with the proviso that the compound of the formula (4) includes at least one group represented by formula (5) below:

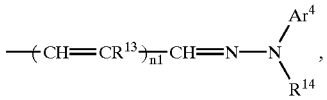

(5)

wherein $R^{13}$ and $R^{14}$ independently denote an alkyl group, aralkyl group or aryl group each capable of having a substituent, or a hydrogen atom;

$Ar^4$ denotes an aryl group capable of having a substituent; and n1 denotes 0, 1 or 2;

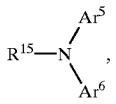

(6)

wherein $Ar^5$ and $Ar^6$ independently denote an aryl group capable of having a substituent; and $R^{15}$ denotes an alkyl group, aralkyl group or aryl group each capable of having a substituent with the proviso that the compound of the formula (6) includes at least one group represented by formula (7) below:

(7)

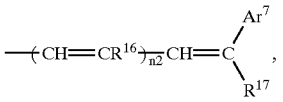

wherein $R^{16}$ and $R^{17}$ independently denote an alkyl group, aralkyl group or aryl group each capable of having a substituent, or a hydrogen atom; $Ar^7$ denotes an aryl group capable of having a substituent; n2 is 0, 1 or 2, and wherein the polymerizate is obtained by irradiating a coating layer comprising the hole-transporting layer with an electron beam to chain polymerize the hole-transporting compound by unsaturation polymerization or ring-opening polymerization.

2. A photosensitive member according to claim 1, wherein the chain-polymerization function groups of the hole-transporting compound are represented by a formula selected from the group consisting of formulae (8)–(10) below:

(8)

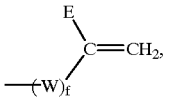

wherein E denotes a hydrogen atom, a halogen atom, an alkyl group capable of having a substituent, an aralkyl group capable of having a substituent, an aryl group capable of having a substituent, CN group, nitro group, an alkoxy group, —$COOR^{18}$ or —$CONR^{19}R^{20}$ wherein $R^{18}$–$R^{20}$ independently denote a hydrogen atom, a halogen atom, an alkyl group capable of having a substituent, an aralkyl group capable of having a substituent, or an aryl group capable of having a substituent; and W denotes a divalent group selected from an arylene group capable of having a substituent; an alkylene group capable of having a substituent; —COO—, —O—, —OO—, —S— or —$CONR^{21}$;

wherein $R^{21}$ denotes a hydrogen atom, a halogen atom, an alkyl group capable of having a substituent, an aralkyl group capable of having a substituent, or an aryl group capable of having a substituent; and f is 0 or 1;

(9)

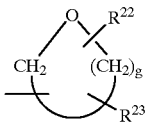

wherein $R^{22}$ and $R^{23}$ independently denote a hydrogen atom, an alkyl group capable of having a substituent, an aralkyl group capable of having a substituent, or an aryl group capable of having a substituent; and g is an integer of 1–10;

(10)

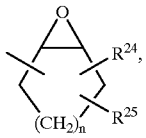

wherein $R^{24}$ and $R^{25}$ independently denote a hydrogen atom, an alkyl group capable of having a substituent, an aralkyl group capable of having a substituent, or an aryl group capable of having a substituent; and h is an integer of 0–10.

3. A photosensitive member according to claim 2, wherein the chain-polymerization function groups are represented by the formula (8).

4. A photosensitive member according to claim 2, wherein the chain-polymerization function groups are represented by the formula (9).

5. A photosensitive member according to claim 2, wherein the chain-polymerization function groups are represented by the formula (10).

6. A photosensitive member according to claim 1, wherein the chain-polymerization function groups of the hole-transporting compound are represented by a formula selected from formulae (11)–(17) below:

(11)

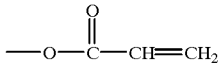

(12)

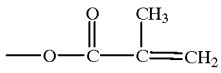

(13)

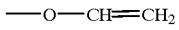

(14)

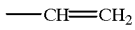

(15)

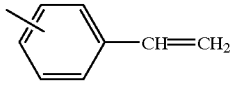

(16)

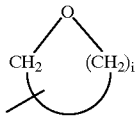

(i = 1, 2, or 3)

(17)

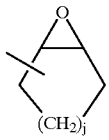

(j = 1, 2, or 3).

7. A photosensitive member according to claim 6, wherein the chain-polymerization function groups are represented by the formula (11) or (12).

8. A photosensitive member according to claim 1, wherein Z is an organic group obtained by selecting one member or combining at least two members arbitrarily selected from the group consisting of an alkylene group capable of having a substituent, an arylene group capable of having a substituent, —$CR^{26}$=$CR^{27}$— (wherein $R^{26}$ and $R^{27}$ independently denote an alkyl group, an aryl group or a hydrogen atom), —CO—, —SO—, —$SO_2$—, an oxygen atom and a sulfur atom.

9. A photosensitive member according to claim 1, wherein the group A in the formula (1) is a group such that a combination of A with a number (a+b) of hydrogen atoms would provide a hole-transporting compound of the formula (4).

10. A photosensitive member according to claim 1, wherein the group A in the formula (1) is a group such that a combination of A with a number (a+b) of hydrogen atoms would provide a hole-transporting compound of the formula (6).

11. A photosensitive member according to claim 1, wherein the group A in the formula (1) is a group such that a combination of A with a number (a+b) of hydrogen atoms would provide a hole-transporting cyclic hydrocarbon compound having a group of the formula (5).

12. A photosensitive member according to claim 1, wherein the polymerizate of the hole-transporting compound comprises a three-dimensionally crosslinked structure.

13. A photosensitive member according to claim 1, wherein the electron beam is irradiated at an acceleration voltage of at most 300 kV.

14. A photosensitive member according to claim 1, wherein the electron beam is irradiated at a dose of 1–100 Mrad.

15. A photosensitive member according to claim 1, wherein Z in the formula (1) is an organic group represented by formula (18) or (19) below:

$$-(X^1)_p-(Ar^7)_q-(X^2)_r-(Ar^8)_s-(X^3)_t- \quad (18),$$

wherein $X^1$–$X^3$ independently denote an alkylene group having at most 20 carbon atoms capable of having a substituent;

$-(CR^{28}=CR^{29})_{m1}-$, —CO, —SO—, —$SO_2$—, —O— or —S—; $Ar^7$ and $Ar^8$ independently denote an arylene group capable of having a substituent;

$R^{28}$ and $R^{29}$ independently denote an alkyl group capable of having a substituent, an aryl group capable of having a substituent, or a hydrogen atom; m1 is an integer of 1–5;

p to t independently denote an integer of 0–10 provided that p to t cannot be simultaneously 0;

$$-(X^4)_u-(Ar^9)_v-(X^5)_w- \quad (19),$$

wherein $X^4$ and $X^5$ independently denote $-(CH_2)_x-$, $-(CH=CR^{30})_y-$, —CO—, —O—;

$Ar^9$ denotes an arylene group capable of having a substituent; $R^{30}$ denotes an alkyl group capable of having a substituent, an aryl group capable of having a substituent, or a hydrogen atom;

x is an integer of 1–10;

y is an integer of 1–5, and u to w are independently an integer of 0–10, provided that u to w cannot be simultaneously 0.

16. A process cartridge, comprising:

an electrophotographic photosensitive member and at least one means selected from the group consisting of charging means, developing means and cleaning means;

said electrophotographic photosensitive member and said at least one means being integrally supported and detachably mountable to a main assembly of an electrophotographic apparatus, wherein said electrophotographic photosensitive member is an electrophotographic photosensitive member according to any one of claims 1–8, 9–11, 12, 13, 14 and 15.

17. An electrophotographic apparatus, comprising:

an electrophotographic photosensitive member, and charging means, developing means and transfer means respectively disposed opposite to the electrophotographic photosensitive member, wherein said electrophotographic photosensitive member is an electrophotographic photosensitive member according to any one of claims 1–8, 9–11, 12, 13, 14 and 15.

* * * * *

UNITED STATES PATENT AND TRADEMARK OFFICE

CERTIFICATE OF CORRECTION

PATENT NO. : 6,416,915 B1
DATED : July 9, 2002
INVENTOR(S) : Toshihiro Kikuchi et al.

It is certified that error appears in the above-identified patent and that said Letters Patent is hereby corrected as shown below:

Column 1,
Line 44, “layer,” should read -- layer, --.

Column 2,
Line 26, “pendanrts,” should read -- pendants, --;
Line 43, “and.” should read -- and --;
Line 51, “above mentioned” should read -- above-mentioned --.

Column 3,
Line 27, “condensed.” should read -- condensed --.

Column 7,
Line 60, “In” should read -- in --.

Column 10,
Line 20, “independent” should read -- independently --.

Column 11,
Line 27, “benzothiophenyl.” should read -- benzothiophenyl, --;
Line 37, “substituent:” should read -- substitutent; --.

Column 12,
Line 6, “substituted;” should read -- substituted --.

Column 110,
Line 15, “from .” should read -- from --.

Column 111,
Line 12, “addition.” should read -- addition, --.

Column 112,
Line 36, “hours” should read -- hours. --.

UNITED STATES PATENT AND TRADEMARK OFFICE

CERTIFICATE OF CORRECTION

PATENT NO. : 6,416,915 B1
DATED : July 9, 2002
INVENTOR(S) : Toshihiro Kikuchi et al.

It is certified that error appears in the above-identified patent and that said Letters Patent is hereby corrected as shown below:

Column 115,
Line 24, “ $\xrightarrow{ClPPh_2—NaH}$ ” should read -- $\xrightarrow{ClPPh_2 \cdot NaH}$ --.

Column 119,
Line 39, “(18.4 g;” should read -- (18.4 g: --;
Line 45, “stirring” should read -- stirring. --.

Column 127,
Line 14, “form” should read -- from --.

Column 128,
Line 42, “In” should read -- in --.

Column 129,
Line 23, “as” should read -- since --;
Line 25, “, so that even” should read -- , even --;
Line 46, “in” should read -- is --.

Column 130,
Line 3, “ordinary a” should read -- an ordinary --;
Line 4, “combination” should read -- combination. --.

Column 134,
Line 2, “of.” should read -- of --.

Column 162,
Line 52, “and.” should read -- and --.

Column 164,
Line 4, “sac” should read -- sec --.

UNITED STATES PATENT AND TRADEMARK OFFICE

CERTIFICATE OF CORRECTION

PATENT NO. : 6,416,915 B1 
DATED : July 9, 2002
INVENTOR(S) : Toshihiro Kikuchi et al.

It is certified that error appears in the above-identified patent and that said Letters Patent is hereby corrected as shown below:

Column 170,
Line 30, "claims 1-8, 9-11, 12, 13, 14 and 15." should read -- claims 1-15. --;
Line 38, "claims 1-8, 9-11, 12, 13, 14" should read -- claims 1-15. --;
Line 39, "and 15." should be deleted.

Column 168,
Line 8,

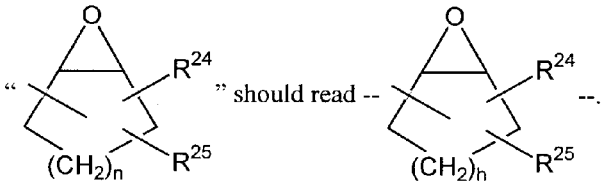

Signed and Sealed this

First Day of April, 2003

JAMES E. ROGAN
*Director of the United States Patent and Trademark Office*